US012797931B2

(12) United States Patent
Kimura et al.

(10) Patent No.: US 12,797,931 B2
(45) Date of Patent: Nov. 17, 2026

(54) EXTRUSION MOLDING METHOD OF DIFFERENTIAL THICKNESS PIPE AND EXTRUSION MOLDING APPARATUS OF DIFFERENTIAL THICKNESS PIPE

(71) Applicant: SANGO CO., LTD., Nagoya (JP)

(72) Inventors: Takashi Kimura, Nagoya (JP); Kentaro Nozu, Nagoya (JP); Yasunari Oki, Nagoya (JP)

(73) Assignee: SANGO CO., LTD., Nagoya (JP)

( * ) Notice: Subject to any disclaimer, the term of this patent is extended or adjusted under 35 U.S.C. 154(b) by 210 days.

(21) Appl. No.: 18/730,097

(22) PCT Filed: Jan. 26, 2024

(86) PCT No.: PCT/JP2024/002383
§ 371 (c)(1),
(2) Date: Jul. 18, 2024

(87) PCT Pub. No.: WO2024/166709
PCT Pub. Date: Aug. 15, 2024

(65) Prior Publication Data

US 2025/0135518 A1 May 1, 2025

(30) Foreign Application Priority Data

Feb. 8, 2023 (JP) ..... 2023-017620

(51) Int. Cl.
*B21C 37/16* (2006.01)
*B21C 25/08* (2006.01)
*B21J 5/06* (2006.01)

(52) U.S. Cl.
CPC ..... *B21C 25/08* (2013.01); *B21C 37/16* (2013.01)

(58) Field of Classification Search
CPC ..... B21C 25/08; B21C 37/16; B21J 5/06
See application file for complete search history.

(56) References Cited

U.S. PATENT DOCUMENTS 4,007,616 A * 2/1977 Aleck ..... B21D 51/24 72/38
4,292,831 A * 10/1981 Simon ..... B21K 1/06 72/266

(Continued)

FOREIGN PATENT DOCUMENTS

JP S5619731 A 2/1981
JP 2004082560 A 3/2004

(Continued)

OTHER PUBLICATIONS

International Search Report (PCT/ISA/210) with translation mailed on Mar. 26, 2024 by the Japan Patent Office as the International Searching Authority for International Application No. PCT/JP2024/002383. (6 pages).

(Continued)

*Primary Examiner* — Mohammed S. Alawadi
(74) *Attorney, Agent, or Firm* — BUCHANAN INGERSOLL & ROONEY PC

(57) ABSTRACT

An extrusion molding method utilizes a mandrel with a small outer diameter region having an outer diameter corresponding to a raw pipe inner diameter and a large outer diameter region having a larger outer diameter than the raw pipe inner diameter on its tip and base end sides respectively. The mandrel is pushed into the raw pipe set in a container which has a small inner diameter region having an inner diameter smaller than a raw pipe outer diameter and a large inner diameter region which has a larger inner diameter than the raw pipe outer diameter on its tip and base end sides respectively to expand a diameter of raw pipe end part on a base end side of the raw pipe. Thereafter, the base end side of the raw pipe having the mandrel inserted inside is pushed into the small inner diameter region of the container.

20 Claims, 27 Drawing Sheets

(56) References Cited

U.S. PATENT DOCUMENTS

| | | | | |
|---|---|---|---|---|
| 2019/0076902 | A1* | 3/2019 | Mizumura | B21K 1/12 |
| 2022/0314290 | A1 | 10/2022 | Nozu et al. | |

FOREIGN PATENT DOCUMENTS

| | | | |
|---|---|---|---|
| JP | 2013-230494 | A | 11/2013 |
| JP | 6256668 | B1 | 1/2018 |
| JP | 2021041461 | A | 3/2021 |
| JP | 6933762 | B2 | 9/2021 |
| WO | 2017154481 | A1 | 9/2017 |

OTHER PUBLICATIONS

Written Opinion (PCT/ISA/237) with translation mailed on Mar. 26, 2024 by the Japan Patent Office as the International Searching Authority for International Application No. PCT/JP2024/002383. (6 pages).

Office Action (Notice of Reasons for Refusal) issued on May 27, 2025, in corresponding Japanese Patent Application No. 2024-539824 and English translation of the Office Action. (8 pages).

* cited by examiner (a)

(b)

EXTRUSION MOLDING METHOD OF DIFFERENTIAL THICKNESS PIPE AND EXTRUSION MOLDING APPARATUS OF DIFFERENTIAL THICKNESS PIPE

TECHNICAL FIELD

The present invention relates to an extrusion molding method of a differential thickness pipe and an extrusion molding apparatus of a differential thickness pipe.

BACKGROUND ART

In the art, a differential thickness pipe (which may be referred to as a "butted pipe" or "butted tube", etc.) in which a thick-walled part is formed in a part in an axis direction of the pipe for the purpose of attaining a weight reduction in a thin-walled part (part other than the thick-walled part) while attaining desired mechanical strength in the thick-walled part has been known.

As an extrusion molding method for obtaining a differential thickness pipe as mentioned above, a method described in Japanese Patent No. 6933762 (PTL1, Patent Literature 1) by the present inventor has been known, for example. In accordance with this method, from a raw pipe having a fixed outer diameter and wall thickness, a large diameter part (ear part) whose outer diameter remains an outer diameter of the raw pipe and a small diameter part whose diameter is reduced and which is extending in an axis direction (extrusion direction) can be formed integrally while forming two parts with different wall thicknesses in the small diameter part (differential thickness part).

In order to obtain a differential thickness pipe comprising a large diameter part of a large which has a larger outer diameter in the above-mentioned method, it is necessary to make the outer diameter of the raw pipe larger accordingly. In this case, when the outer diameter of the small diameter part which the differential thickness pipe comprises is maintained without being changed, as a result, a diameter reduction rate (diameter reduction amount) in the extrusion molding of the differential thickness pipe becomes larger and processing load increases. Therefore, there is a possibility that it may become difficult or impossible to attain a target diameter reduction rate, depending on a processing limit of an extrusion molding apparatus, which is determined by a material constituting the raw pipe and materials of members constituting the extrusion molding apparatus and extrusion performance of the extrusion molding apparatus, etc., for example. Moreover, even in a diameter reduction processing (extrusion processing) within the processing limit, the larger the diameter reduction amount becomes, the larger extrusion resistance becomes. Therefore, extrusion output must be reduced inevitably, and there is a possibility that it may become difficult or impossible to form a small diameter part having a desired shape (for example, length in its axial direction, etc.).

On the other hand, in Japanese Patent No. 6256668 (PTL2, Patent Literature 2), a forming method in which a plug is pushed into a raw pipe from an base end part of the raw pipe in a push-inn direction of the plug in a state where a tip end part of the raw pipe is blocked such that the end part does not move further to the tip end side and thereby a relative position of the raw pipe with respective to a die in a longitudinal direction of the raw pipe is fixed is proposed (for example, refer to paragraph [0022], etc.). In accordance with this, by expanding an outer diameter of the base end part of the raw pipe to make an expanded diameter part and performing ironing processing on a part of the raw pipe on its tip end side from the expanded diameter part (non-expanded diameter part) to expand an inner diameter of a region adjacent to the expanded diameter part on the tip end side while maintaining its outer diameter, a wall thickness of the non-expanded diameter part can be changed (differential thickness can be formed).

However, in the above-mentioned method, since the tip end part of the raw pipe is blocked, a material which constitutes the non-expanded diameter part whose inner diameter is expanded with advance of the plug flows to the base end side in a direction opposite to a direction of movement of the plug, the non-expanded diameter part is prolonged to the base end side, and contact area with the plug increases. As a result, since processing load increases due to an increase in frictional force between the non-expanded diameter part and the plug with advance of the plug, the above-mentioned method is not suitable for molding a long object (differential thickness pipe long in its axis direction).

CITATION LIST

Patent Literature

[PTL1] Japanese Patent No. 6933762
[PTL2] Japanese Patent No. 6256668

SUMMARY OF INVENTION

Technical Problem

As mentioned above, in the art, an extrusion molding method of a differential thickness pipe in which a diameter difference between a large diameter part (ear part) and a small diameter part (differential thickness part whose diameter is reduced) can be set to be larger and length in its axis direction can be set arbitrarily without being accompanied by excessive increase in processing load has been demanded.

Solution to Problem

In light of the above-mentioned subject, as a result of wholeheartedly research, the present inventors have found that the above-mentioned subject can be solved by pushing a mandrel (core bar) which has a small outer diameter region having an outer diameter corresponding to an inner diameter of a raw pipe and a large outer diameter region having an outer diameter larger than the inner diameter of the raw pipe on its tip and base end sides respectively into the inside of the raw pipe set in a container (die) which has a small inner diameter region having an inner diameter smaller than an outer diameter of the raw pipe and a large inner diameter region which has a larger inner diameter than the outer diameter of the raw pipe on its tip and base end sides respectively to expand a diameter of an end part of the raw pipe on a base end side of the raw pipe and thereafter pressing the end part of the raw pipe on the base end side of the raw pipe with a sleeve to push the raw pipe having the mandrel inserted inside into the small inner diameter region of the container to reduce the diameter of the raw pipe.

Specifically, an extrusion molding method of a differential thickness pipe according to the present invention (which may be referred to as a "present invention method" hereafter) includes a first process to a third process performed in an extrusion molding apparatus. The extrusion molding apparatus comprises a mandrel that is a core bar having a predetermined shape, a sleeve that is a cylindrical member disposed coaxially with the mandrel on an outside of the mandrel, a container that is a die in which a container hole that is a penetration hole having a predetermined shape is formed, and a drive mechanism configured so as to push the mandrel and the sleeve into the container hole.

The first process is a process in which a raw pipe having a predetermined shape is set at a predetermined position in the inside of the container hole. The second process is a process in which the mandrel is pushed into the raw pipe by the drive mechanism to expand a diameter on a base end side of the raw pipe, and the base end side is an upstream side in an extrusion direction. The third process is a process in which a diameter on a tip end side of the raw pipe is reduced by pressing an end part on the base end side of the raw pipe with the sleeve to push the raw pipe into the tip end side of the container hole to perform extrusion processing, after a first time point that is a time point when the second process is started.

The raw pipe is a circular cylindrical member which has a first outer diameter that is a predetermined outer diameter, a first inner diameter that is a predetermined inner diameter and a first wall thickness that is a predetermined wall thickness. The differential thickness pipe which is molded by the present invention method comprises a first small diameter region, a second small diameter region and a large diameter region, in order toward the base end side from the tip end side. The first small diameter region is a region having a second outer diameter that is a predetermined outer diameter smaller than the first outer diameter, a second inner diameter that is an inner diameter equal to the first inner diameter and a second wall thickness that is a predetermined wall thickness smaller than the first wall thickness. The second small diameter region is a region having a third outer diameter that is an outer diameter equal to the second outer diameter and a third wall thickness that is a predetermined wall thickness smaller than the second wall thickness. The large diameter region is a region having a fourth outer diameter that is a predetermined outer diameter larger than the first outer diameter and a fourth wall thickness that is a predetermined wall thickness.

The mandrel comprises a small cross section region, a large cross section region and a cross section expansion region. The small cross section region is a circular columnar region formed on the tip end side and having a first cross section that is a circular cross section having a fifth outer diameter that is an outer diameter corresponding to the first inner diameter and the second inner diameter. The large cross section region is a columnar region formed on the base end side and having a second cross section that is a cross section corresponding to cross sections of inner spaces of the second small diameter region and the large diameter region. The cross section expansion region is a region formed between the small cross section region and the large cross section region and having a cross section expanding from the first cross section to the second cross section as approaching from the small cross section region to the large cross section region.

The sleeve comprises a pressing region which is a cylindrical region formed on the tip end side and having a seventh outer diameter that is an outer diameter equal to the fourth outer diameter and a columnar inner space having a third cross section that is a cross section corresponding to the second cross section.

Shapes of the cross sections of the inner spaces of the second small diameter region and the large diameter region of the differential thickness pipe are not limited in particular, and can be various shapes, such as a polygon, an ellipse and a circle, for example, respectively. In other words, shapes of the inner spaces of the second small diameter region and the large diameter region are not limited in particular, and can be various shapes, such as a polygonal column, an elliptic column and circular column, for example, respectively.

For example, the inner space of the second small diameter region can have a circular columnar shape which has a third inner diameter that is a predetermined inner diameter larger than the first inner diameter, and the inner space of the large diameter region can have a circular columnar shape which has a fourth inner diameter that is a predetermined inner diameter equal to the third inner diameter. In this case, the large cross section region of the mandrel has a circular columnar shape which has a sixth outer diameter that is an outer diameter corresponding to the fourth inner diameter, and the cross section expansion region of the mandrel has a truncated cone-like shape whose outer diameter increases from the fifth outer diameter that is the outer diameter of the small cross section region to the sixth outer diameter that is the outer diameter of the large cross section region as approaching from the small cross section region to the large cross section region. Moreover, the pressing region of the sleeve has a circular cylindrical shape which has the seventh outer diameter and a seventh inner diameter that is an inner diameter equal to the third inner diameter and the fourth inner diameter.

The container hole comprises a large inner diameter region, a small inner diameter region and an inner diameter decreasing region. The large inner diameter region is a region formed on the base end side and having a sixth inner diameter that is an inner diameter corresponding to the fourth outer diameter. The small inner diameter region is a region formed on the tip end side and having a seventh inner diameter that is an inner diameter corresponding to the second outer diameter and the third outer diameter. The inner diameter decreasing region is a region formed between the large inner diameter region and the small inner diameter region and having an inner diameter decreasing from the sixth inner diameter to the seventh inner diameter as approaching from the large inner diameter region to the small inner diameter region.

Furthermore, in the present invention method, at a second time point that is a time point when the third process is started, an end part on the tip end side in the extrusion direction of the mandrel has reached an end part on the tip end side of the raw pipe or a position on the tip end side rather than the end part on the tip end side of the raw pipe, and an end part on the base end side of the small cross section region is located on the base end side rather than an end part on the base end side of the small inner diameter region of the container hole.

The present invention method according to another aspect is an extrusion molding method of a differential thickness pipe, in which a differential thickness pipe having a predetermined shape is molded by pushing a raw pipe having a predetermined shape into a container hole using a sleeve, in an extrusion molding apparatus. The extrusion molding apparatus used in the present invention method according to this aspect comprises a mandrel that is a core bar having a predetermined shape, a sleeve that is a cylindrical member disposed coaxially with the mandrel on an outside of the mandrel, a container that is a die in which a container hole that is a penetration hole having a predetermined shape is formed, and a drive mechanism configured so as to push at least the sleeve into the container hole.

The raw pipe is a circular cylindrical member which has an eleventh outer diameter that is a predetermined outer diameter, an eleventh inner diameter that is a predetermined inner diameter and an eleventh wall thickness that is a predetermined wall thickness. The differential thickness pipe comprises an eleventh small outer diameter region, an eleventh large outer diameter region and an eleventh outer diameter increasing region. The eleventh small outer diameter region is a region formed on a tip end side which is a downstream side in an pressing direction that is a direction in which the raw pipe is pushed into the container hole and having a twelfth outer diameter that is a predetermined outer diameter smaller than the eleventh outer diameter, a twelfth inner diameter that is an inner diameter equal to the eleventh inner diameter and a twelfth wall thickness that is a predetermined wall thickness smaller than the eleventh wall thickness. The eleventh large outer diameter region is a region formed on a base end side which is an upstream side in the pressing direction and having a thirteenth outer diameter that is a predetermined outer diameter larger than the eleventh outer diameter, a thirteenth inner diameter that is an inner diameter equal to the eleventh inner diameter and a thirteenth wall thickness that is a predetermined wall thickness larger than the eleventh wall thickness. The eleventh outer diameter increasing region is a region formed between the eleventh small outer diameter region and the eleventh large outer diameter region and having an outer diameter increasing from the twelfth outer diameter to the thirteenth outer diameter and a wall thickness increasing from the twelfth wall thickness to the thirteenth wall thickness as approaching from the eleventh small outer diameter region to the eleventh large outer diameter region, and an inner diameter fixed at a fourteenth inner diameter equal to the eleventh inner diameter.

The mandrel comprises a basic outer diameter region which is a circular columnar region formed on the tip end side and having a fourteenth outer diameter that is an outer diameter corresponding to the eleventh inner diameter. The sleeve comprises an eleventh pressing region which is a cylindrical region formed on the tip end side and having a fifteenth outer diameter that is an outer diameter equal to the thirteenth outer diameter and a circular columnar inner space having a fifteenth inner diameter that is an inner diameter corresponding to the fourteenth outer diameter. The container hole comprises an eleventh large diameter region, an eleventh small inner diameter region and an eleventh inner diameter decreasing region. The eleventh large inner diameter region is a region formed on the base end side and having a sixteenth inner diameter that is an inner diameter corresponding to the thirteenth outer diameter. The eleventh small inner diameter region is a region formed on the tip end side and having a seventeenth inner diameter that is an inner diameter corresponding to the twelfth outer diameter. The eleventh inner diameter decreasing region is a region formed between the eleventh large inner diameter region and the eleventh small inner diameter region and having an inner diameter decreasing from the sixteenth inner diameter to the seventeenth inner diameter as approaching from the eleventh large inner diameter region to the eleventh small inner diameter region.

The present invention method according to this aspect includes an eleventh process to a thirteenth process listed below.

The eleventh process is a process in which the raw pipe is set at a predetermined position in the inside of the container hole by making an end part on the tip end side of the raw pipe contact with the eleventh inner diameter decreasing region of the container hole.

The twelfth process is a process in which the outer diameter of the raw pipe is expanded to the thirteenth outer diameter while maintaining the inner diameter of the raw pipe at the eleventh inner diameter by pressing an end part on the base end side of the raw pipe with the sleeve to cause plastic flow of a material constituting the raw pipe to fill up a space between the container and the mandrel in the eleventh large inner diameter region and the eleventh inner diameter decreasing region of the container hole with the material in a state where the mandrel is inserted through the raw pipe.

The thirteenth process is a process in which the tip end side of the raw pipe is subjected to diameter reduction by further pressing the end part on the base end side of the raw pipe with the sleeve to perform extrusion processing in which the material constituting the raw pipe is extruded into the eleventh small inner diameter region of the container hole through a gap between an end part on the base end side of the eleventh small inner diameter region of the container hole and the mandrel in a state where the mandrel is inserted through the raw pipe.

Furthermore, at an eleven time point that is a time point when the twelfth process is started, an end part on the tip end side of the mandrel has reached an eleven position that is the same position in the pressing direction as a position of an end part on the base end side of the eleventh small inner diameter region of the container hole or a position on the tip end side rather than the eleventh position. In addition, at a twelfth time point that is a time point when the thirteenth process is started, the end part on the tip end side of the mandrel has reached a twelfth position that is a position on the tip end side by a predetermined distance rather than the end part on the base end side of the eleventh small inner diameter region of the container hole or a position on the tip end side rather than the twelfth position in the pressing direction.

Moreover, the present invention relates also to an extrusion molding apparatus of a differential thickness pipe (which may be referred to as a "present invention apparatus" hereafter) for molding a differential thickness pipe by performing out the above-mentioned present invention method.

Advantageous Effects of Invention

In the present invention method, as mentioned above, in the first process, the raw pipe is set in the container in which the container hole having the small inner diameter region which has an inner diameter smaller than the outer diameter of the raw pipe and the large inner diameter region which has an inner diameter larger than the outer diameter of the raw pipe on the tip end side and base end side respectively. Then, in the second process, the end part on the base end side of the raw pipe is expanded by pushing the mandrel which has the small outer diameter region having an outer diameter corresponding to the inner diameter of the raw pipe and the large outer diameter region having an outer diameter larger than the inner diameter of the raw pipe into the inside of the raw pipe. Furthermore, in the third process, the raw pipe through which the mandrel is inserted is pushed into the small inner diameter region of the container by pressing the end part on the base end side of the raw pipe with the sleeve.

Therefore, in accordance with the present invention, as compared with a case where a diameter difference between a large diameter part and a small diameter part of a differential thickness pipe is increased by enlarging an outer diameter of a raw pipe, increase in processing load can be reduced. Moreover, as will be mentioned in detail later, increase in processing load in association with lengthening of a differential thickness pipe to be molded can be reduced. Namely, in accordance with the present invention, an extrusion molding method and extrusion molding apparatus of a differential thickness pipe in which a diameter difference between a large diameter part (ear part) and a small diameter part (differential thickness part whose diameter is reduced) can be set to be larger and length in its axis direction can be set arbitrarily without being accompanied by excessive increase in processing load can be provided.

Moreover, in the differential thickness pipe molded by the present invention method according to another aspect, the eleventh large outer diameter region is formed by thickening from the raw pipe, and the eleventh small outer diameter region is formed by thinning from the raw pipe. Therefore, as compared with a case where a large outer diameter region is formed by holding an outer diameter of a raw pipe and a small outer diameter region is formed by largely reducing the outer diameter of the raw pipe, a larger diameter difference can be attained with smaller processing load. Furthermore, since the wall thickness of the large outer diameter region can be enlarged, a differential thickness pipe suitable for use in which high mechanical strength is demanded in a large diameter part or the like, for example, can be molded.

In addition, the length in its axial direction of the eleventh large outer diameter region and the eleventh small outer diameter region changes depending on the length in its axial direction and the diameter expansion amount in the twelfth process of the raw pipe, and the diameter reduction amount and the push-in amount of the raw pipe by the sleeve in the thirteenth process. Namely, the length in its axial direction of the eleventh large outer diameter region and the eleventh small outer diameter region of the differential thickness pipe can be set up arbitrarily.

Other objectives, other features and accompanying advantages of the present invention will be easily understood from the following explanation about respective embodiments of the present invention, which will be described referring to drawings.

DESCRIPTION OF EMBODIMENTS

First Embodiment

Hereafter, an extrusion molding method of a differential thickness pipe according to a first embodiment of the present invention (which may be referred to as a "first method" hereafter) will be explained, referring to drawings.

<Configuration>

The first method includes a first process to a third process performed in an extrusion molding apparatus. The extrusion molding apparatus comprises a mandrel that is a core bar having a predetermined shape, a sleeve that is a cylindrical member disposed coaxially with the mandrel on an outside of the mandrel, a container that is a die in which a container hole that is a penetration hole having a predetermined shape is formed, and a drive mechanism configured so as to push the mandrel and the sleeve into the container hole.

Although a fundamental configuration of an extrusion molding apparatus is well known to a person skilled in the art and therefore detailed explanation about the same is omitted, its components including the mandrel, the sleeve and the container are constituted by a material which has properties (for example, mechanical strength and durability, etc.) which can withstand processing conditions such as load which acts on the components in an extrusion processing which will be mentioned later, for example. Moreover, the drive mechanism for pushing the mandrel and the sleeve into the container hole can be chosen suitably from various well-known drive mechanisms in the art according to properties (for example, mechanical strength and hardness, etc.) of a material constituting a raw pipe which is subjected to the extrusion processing. Typically, a press machine such as a hydraulic press machine, for example, is adopted as the drive mechanism.

Figure 1:
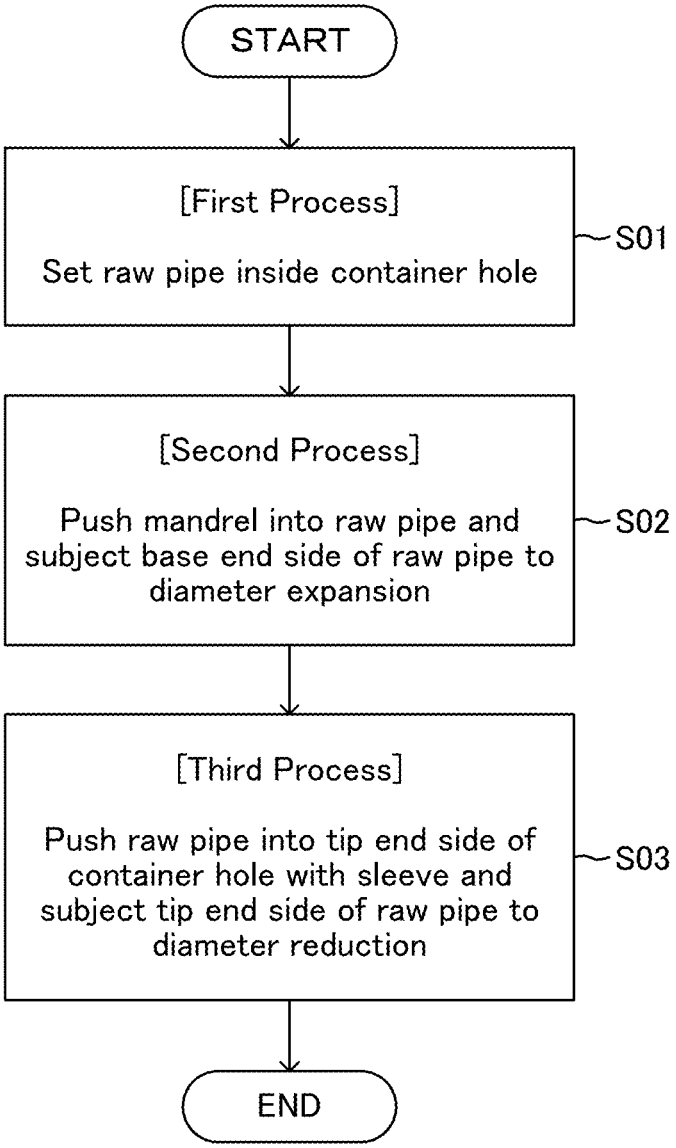
FIG. 1 is a flow chart for showing a flow of respective processes included in an extrusion molding method of a differential thickness pipe according to a first embodiment of the present invention (first method).

FIG. 1 is a flow chart for showing a flow of respective processes included in the first method. The first process performed in Step S01 is a process in which a raw pipe having a predetermined shape is set at a predetermined position in the inside of the container hole. Specifically, in the first process, the raw pipe is set at the predetermined position in the inside of the container hole by bringing an end part on a tip end side of the raw pipe into contact with an inner diameter decreasing region formed between a large inner diameter region and a small inner diameter region of the container hole formed in the container (these respective regions will be mentioned later).

In order to mold a differential thickness pipe having a predetermined shape by the first method, the raw pipe needs to be set coaxially with respect to the mandrel, the sleeve and the container. Although methods for setting the raw pipe in this way are not limited in particular, the raw pipe can be set coaxially with respect to the mandrel, the sleeve and the container by preparing a taper part tapering at an end part on a tip end side of the mandrel and inserting the taper part into the raw pipe when starting diameter expansion of the raw pipe in a second process, for example.

The second process performed in Step S02 is a process in which the mandrel is pushed into the raw pipe by the drive mechanism to expand a diameter on a base end side of the raw pipe, and the base end side is an upstream side in an extrusion direction. The third process performed in Step S03 is a process in which a diameter on a tip end side of the raw pipe is reduced by pressing an end part on the base end side of the raw pipe with the sleeve to push the raw pipe into a tip end side of the container hole, and performing extrusion processing, after a first time point that is a time point when the second process is started, and the tip end side is a downstream side in the extrusion direction. Although will be mentioned later in detail, the differential thickness pipe having a predetermined shape can be molded by performing these first process to third process included in the first method.

The raw pipe, the mandrel, the sleeve and the container, as well as the differential thickness pipe molded by performing the first method will be explained in detail below, referring to drawings.

Figure 2:
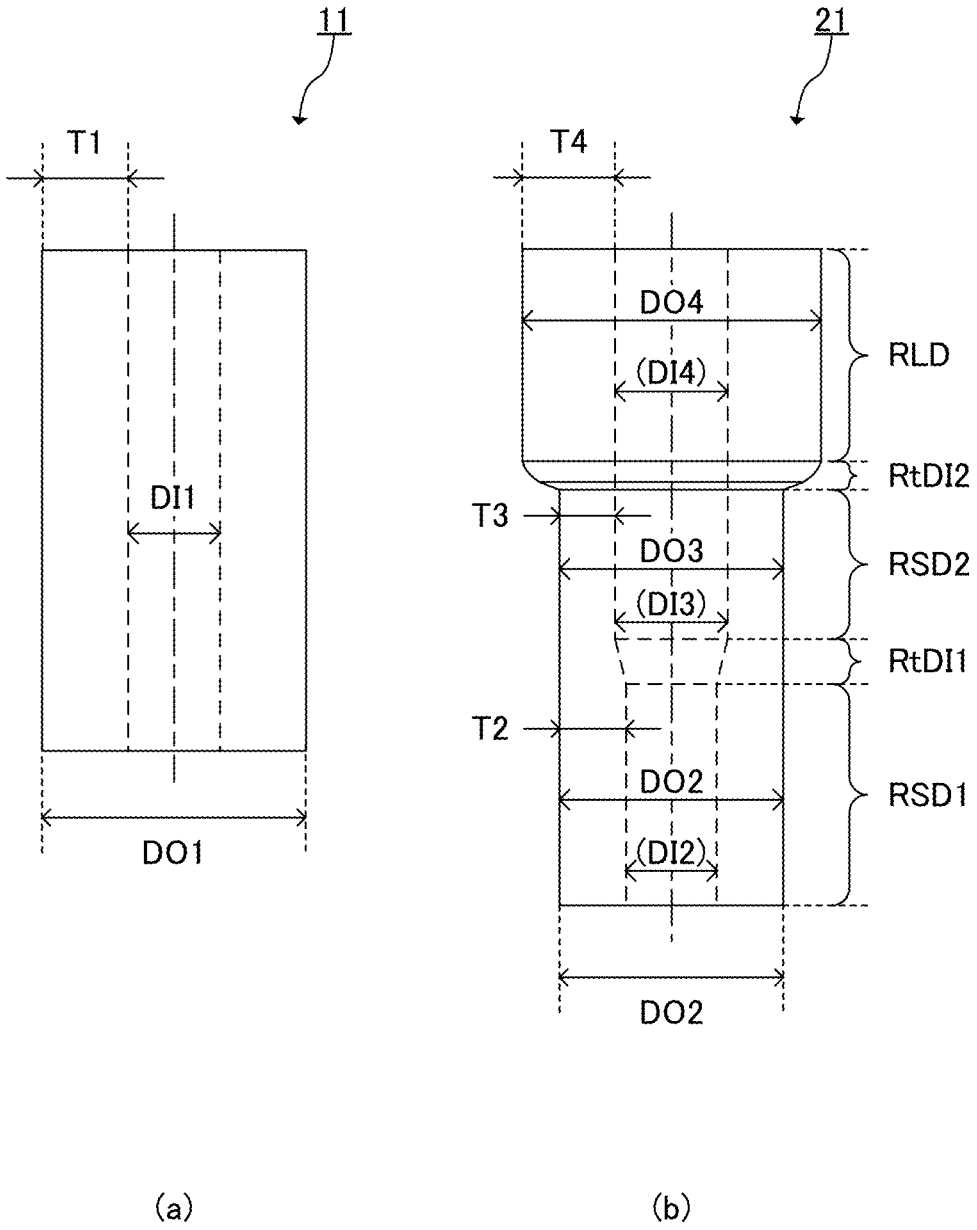
FIG. 2 is a schematic sectional view for showing an example of a configurations of a raw pipe used in the first method and a differential thickness pipe molded from the raw pipe.

FIG. 2 is a schematic sectional view for showing an example of a configurations of a raw pipe used in the first method and a differential thickness pipe molded from the raw pipe. As shown in (a) of FIG. 2, the raw pipe 11 is a circular cylindrical member which has a first outer diameter DO1 that is a predetermined outer diameter, a first inner diameter DI1 that is a predetermined inner diameter and a first wall thickness T1 that is a predetermined wall thickness.

Shapes of the raw pipe are not necessarily limited to a simple circular cylindrical shape as exemplified in FIG. 2, and a part having a different structure may be prepared at the end part on the tip end side of the raw pipe unless it hinders the execution of the first process. Specifically, for example, a circular cylindrical part having a predetermined outer diameter smaller than the outer diameter of the small inner diameter region of the container hole, a predetermined inner diameter not larger than the first inner diameter DI1 that is the inner diameter of the raw pipe, and a predetermined wall thickness smaller than the first wall thickness T1 that is the wall thickness of the raw pipe.

Moreover, the material constituting the raw pipe 11 is not limited as long as it is possible to mold the raw pipe into a desired shape by plastic deformation in extrusion processing. Typically, the material constituting the raw pipe 11 is metal such as lead, tin, aluminum, copper, zirconium, titanium, molybdenum, vanadium, niobium or steel, etc., for example.

Next, as shown in (b) of FIG. 2, the differential thickness pipe molded by the first method comprises a first small diameter region RSD1, a second small diameter region RSD2 and a large diameter region RLD, in order toward the base end side (upper side in the drawing) from the tip end side (lower side in the drawing). The first small diameter region RSD1 is a region having a second outer diameter DO2 that is a predetermined outer diameter smaller than the first outer diameter DO1 (DO2<DO1), a second inner diameter DI2 that is an inner diameter equal to the first inner diameter DI1 (DI2=DI1) and a second wall thickness T2 that is a predetermined wall thickness smaller than the first wall thickness T1 (T2<T1). The second small diameter region RSD2 is a region having a third outer diameter DO3 that is an outer diameter equal to the second outer diameter DO2 (DO3=DO2) and a third wall thickness T3 that is a predetermined wall thickness smaller than the second wall thickness T2 (T3<T2). The large diameter region RLD is a region having a fourth outer diameter DO4 that is a predetermined outer diameter larger than the first outer diameter DO1 (DO4>DO1) and a fourth wall thickness T4 that is a predetermined wall thickness. Shapes of cross sections of inner spaces of the second small diameter region RSD2 and the large diameter region RLD are identical with each other since both the second small diameter region RSD2 and the large diameter region RLD are formed by expanding an inner space of the raw pipe 11 with the large cross section region of the mandrel which will be mentioned later.

Moreover, between the first small diameter region RSD1 and the second small diameter region RSD2, a first tapered region RtDI1 that is a region having a wall thickness decreasing from the second wall thickness T2 to the third wall thickness T3 and a cross section of its inner space expanding as approaching from the first small diameter region RSD1 to the second small diameter region RSD2 (however, its outer diameter does not change). Furthermore, between the second small diameter region RSD2 and the large diameter region RLD, a second tapered region RtDI2 that is a region having a wall thickness increasing from the third wall thickness T3 to the fourth wall thickness T4 and an outer diameter increasing as approaching from the second small diameter region RSD2 to the large diameter region RLD (however, a cross section of its inner space does not change). Details of these first tapered region RtDI1 and second tapered region RtDI2 will be mentioned later.

In addition, as mentioned above, the shapes of the cross sections of the inner spaces of the second small diameter region RSD2 and the large diameter region RLD are not limited in particular, and can be various shapes, such as a polygon, an ellipse and a circle, for example, respectively. In other words, the shapes of the inner spaces of the second small diameter region RSD2 and the large diameter region RLD are not limited in particular, and can be various shapes, such as a polygonal column, an elliptic column and circular column, for example, respectively. Therefore, as long as a shape of a cross section of the first tapered region RtDI1 expands while approaching from a shape (circle) of a cross section of an inner space of the first small diameter region RSD1 to a shape of a cross section of an inner space of the second small diameter region RSD2 as approaching from the first small diameter region RSD1 to the second small diameter region RSD2, the shape of the inner space of the first tapered region RtDI1 is not limited in particular, either. In addition, as mentioned above, the shapes of the cross sections of the inner spaces of the second small diameter region RSD2 and the large diameter region RLD are identical with each other. Therefore, a shape of a cross section of an inner space of the second tapered region RtDI2 formed between the second small diameter region RSD2 and the large diameter region RLD is also identical with the shapes of the cross sections of the inner spaces of the second small diameter region RSD2 and the large diameter region over the whole area.

The mandrel comprises a small cross section region, a large cross section region and a cross section expansion region. The small cross section region is a circular columnar region formed on the tip end side and having a first cross section that is a circular cross section having a fifth outer diameter that is an outer diameter corresponding to the second inner diameter. The large cross section region is a columnar region formed on the base end side and having a second cross section that is a cross section corresponding to a cross section of inner spaces of the second small diameter region and the large diameter region. The cross section expansion region is a region formed between the small cross section region and the large cross section region and having a cross section expanding from the first cross section to the second cross section as approaching from the small cross section region to the large cross section region.

The sleeve comprises a pressing region which is a cylindrical region formed on the tip end side and having a seventh outer diameter that is an outer diameter equal to the fourth outer diameter and a columnar inner space having a third cross section that is a cross section corresponding to the second cross section.

The container hole comprises a large inner diameter region, a small inner diameter region and an inner diameter decreasing region. The large inner diameter region is a region formed on the base end side and having a sixth inner diameter that is an inner diameter corresponding to the fourth outer diameter. The small inner diameter region is a region formed on the tip end side and having a seventh inner diameter that is an inner diameter corresponding to the second outer diameter and the third outer diameter. The inner diameter decreasing region is a region formed between the large inner diameter region and the small inner diameter region and having an inner diameter decreasing from the sixth inner diameter to the seventh inner diameter as approaching from the large inner diameter region to the small inner diameter region.

In addition, as mentioned above, the shapes of the inner spaces of the second small diameter region and the large diameter region are not limited in particular, and can be various shapes, such as a polygonal column, an elliptic column and circular column, for example, respectively. However, in the following explanation, for the purpose of making it easier to understand the present invention, a case where the inner spaces of the second small diameter region RSD2 and large diameter region RLD of the differential thickness pipe 21 have a circular columnar shape respectively will be explained. Specifically, as shown in parenthesis in (b) of FIG. 2, a case where the inner space of the second small diameter region RSD2 of the differential thickness pipe 21 has a circular columnar shape having a third inner diameter DI3 that is a predetermined inner diameter larger than the first inner diameter DI1 (DI3>DI1) and the inner space of the large diameter region RLD of the differential thickness pipe 21 has a circular columnar shape having a fourth inner diameter DI4 that is a predetermined inner diameter equal to the third inner diameter DI3 (DI4=DI3) will be explained. In this case, as will be explained below referring to (a) of FIG. 3, the inner space of the large cross section region of the mandrel and the inner space of the sleeve also have a circular columnar shape, respectively.

Figure 3:
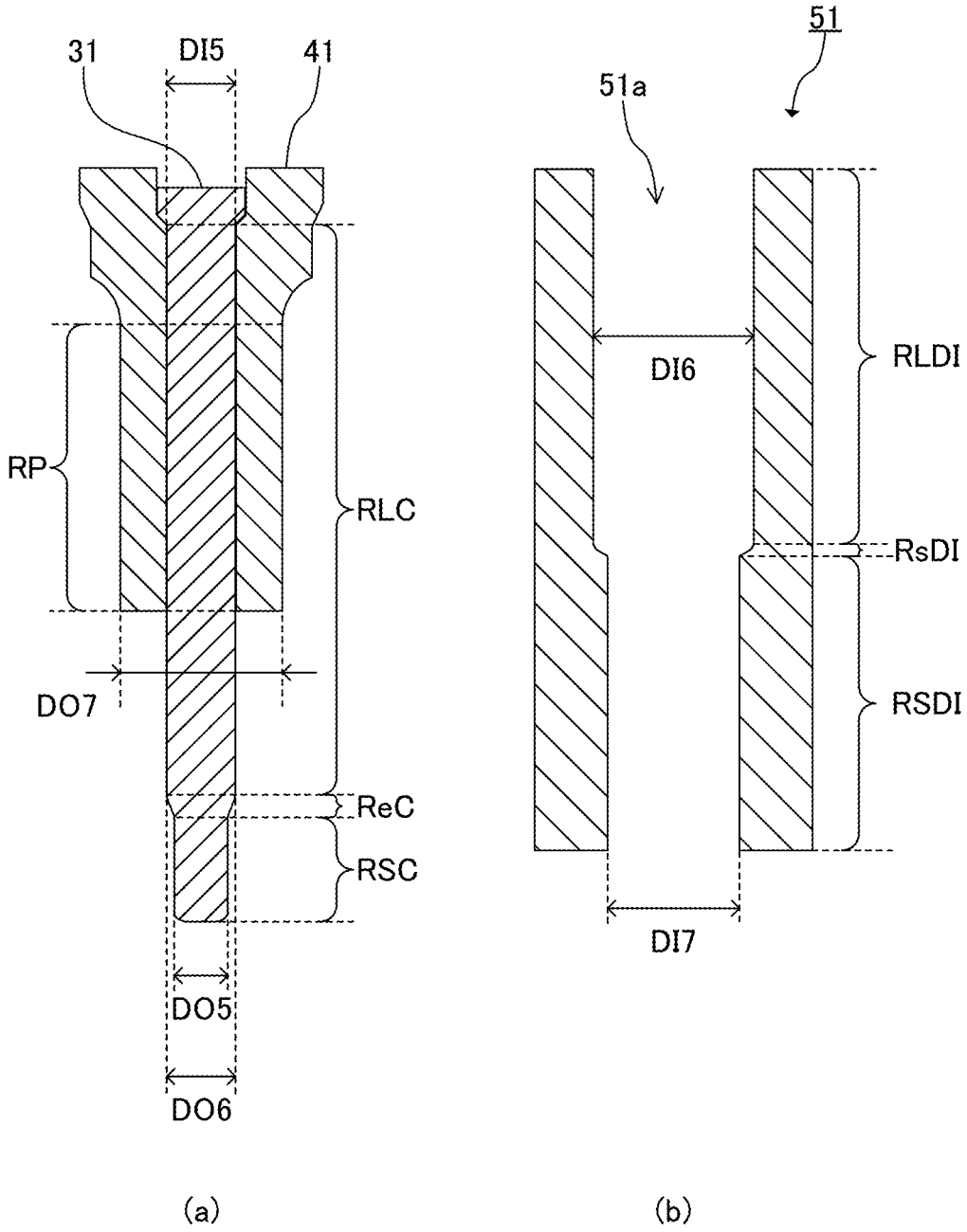
FIG. 3 is a schematic sectional view for showing an example of configurations of a mandrel, a sleeve and a container used in the first method.

FIG. 3 is a schematic sectional view for showing an example of configurations of a mandrel, a sleeve and a container used in the first method. (a) of FIG. 3 is a schematic sectional view for showing an example of configurations of the mandrel and the sleeve used in the first method. As shown in (a) of FIG. 3, the mandrel 31 comprises a small cross section region RSC, a large cross section region RLC and a cross section expansion region ReC. The small cross section region RSC is a circular columnar region formed on the tip end side and having a first cross section that is a circular cross section having a fifth outer diameter DO5 that is an outer diameter corresponding to the second inner diameter DI2. The large cross section region RLC is a columnar region formed on the base end side and having a second cross section that is a circular cross section having a sixth outer diameter that is an outer diameter corresponding to the third inner diameter DI3 and the fourth inner diameter DI4 (namely, a cross section corresponding to cross sections of inner spaces of the second small diameter region RSD2 and the large diameter region RLD). The cross section expansion region ReC is a region formed between the small cross section region RSC and the large cross section region RLC and having a truncated cone-like shape whose outer diameter increases from the fifth outer diameter DO5 to the sixth outer diameter DO6 as approaching from the small cross section region to the large cross section region (namely, a region formed between the small cross section region RSC and the large cross section region RLC and having a cross section expanding from the first cross section to the second cross section as approaching from the small cross section region to the large cross section region). In the second process, the base end side of the raw pipe 11 can be expanded to mold the large diameter region RLD of the differential thickness pipe 21 by inserting the small cross section region RSC of the mandrel 31 having such a shape into the inner space of the raw pipe 11 from the base end side (upper side in the drawing) and pushing the cross section expansion region ReC and the large cross section region RLC into the tip end side (lower side in the drawing).

The sleeve comprises a pressing region RP which is a region formed on the tip end side and having a circular cylindrical shape with a seventh outer diameter DO7 that is an outer diameter equal to the fourth outer diameter DO4 and a fifth inner diameter DI5 that is an inner diameter corresponding to the sixth outer diameter DO6 (namely, a cylindrical region having a columnar inner space with a third cross section that is a cross section corresponding to the second cross section). In the third process, extrusion processing can be performed by pressing the end part on the base end side (upper side in the drawing) of the raw pipe 11 with the end part on the tip end side (lower side in the drawing) of the pressing region RP to push the raw pipe 11 into the tip end side of the container hole.

Next, (b) of FIG. 3 is a schematic sectional view for showing an example of a configuration of the container used in the first method. As shown in (b) of FIG. 3, the container hole 51*a* formed in the container 51 comprises a large inner diameter region RLDI, a small inner diameter region RSDI and an inner diameter decreasing region RsDI. The large inner diameter region RLDI is a region formed on the base end side and having a sixth inner diameter DI6 that is an inner diameter corresponding to the fourth outer diameter DO4. The small inner diameter region RSDI is a region formed on the tip end side and having a seventh inner diameter DI7 that is an inner diameter corresponding to the second outer diameter DO2 and the third outer diameter DO3. The inner diameter decreasing region RsDI is a region formed between the large inner diameter region RLDI and the small inner diameter region RSDI and having an inner diameter decreasing from the sixth inner diameter DI6 to the seventh inner diameter DI7 as approaching from the large inner diameter region RLDI to the small inner diameter region RSDI. In the third process, the first small diameter region RSD1, the first tapered region RtDI1, the second small diameter region RSD2 and the second tapered region RtDI2 of the differential thickness pipe 21 can be molded by pushing the raw pipe 11 into the container hole 51*a* having such a shape with the sleeve 41.

In addition, in a time period when the first small diameter region RSD1 of the differential thickness pipe 21 is formed, it is necessary to perform extrusion processing through a gap corresponding to the second wall thickness T2 that is the thickness of the first small diameter region RSD1. Therefore, in the first method, at a second time point that is a time point when the third process is started, an end part on the tip end side in the extrusion direction of the mandrel 31 has reached an end part on the tip end side of the raw pipe 11 or a position on the tip end side rather than the end part on the tip end side of the raw pipe 11. In other words, when an end part on the tip end side of the sleeve 41 comes into contact with the end part on the tip end side of the raw pipe 11, the end part on the tip end side of the mandrel 31 has reached the end part on the tip end side of the raw pipe 11 or has already passed the end part on the tip end side of the raw pipe 11. In addition, at the second time point, an end part on the base end side of the small cross section region RSC of the mandrel 31 is located on the base end side rather than the end part on the base end side of the small inner diameter region RSD1 of the container hole 51*a*. Thereby, a material which should form the first small diameter region RSD1 of the differential thickness pipe 21 can be extruded to the tip end side through a gap between the small cross section region RSC of the mandrel 31 and the small inner diameter region RSDI of the container hole 51*a*, which is the a gap corresponding to the second wall thickness T2 that is the thickness of the first small diameter region RSD1. Namely, extrusion processing of the first small diameter region RSD1 of the differential thickness pipe 21 can be performed. In addition, a distance between the end part on the base end side of the small cross section region RSC of the mandrel 31 and the end part on the base end side of the small inner diameter region RSDI of the container hole 51*a* can be determined properly based on the length in the extrusion direction and the second wall thickness T2 of the first small diameter region RSD1 of the differential thickness pipe 21 which should be formed, etc., for example.

Moreover, the length of the small cross section region RSC of the mandrel 31 can also be properly determined based on the length in the extrusion direction of the first small diameter region RSD1 of the differential thickness pipe 21 which should be molded, etc., for example. Specifically, in a case where the end part on the tip end side of the small cross section region RSC of the mandrel 31 has not yet reached the end part on the base end side of the small inner diameter region RSDI of the container hole 51*a* at a time point when the material which should form the first small diameter region RSD1 of the differential thickness pipe 21 reaches the end part on the base end side of the small inner diameter region RSDI of the container hole 51*a*, such as a case where the length of the small cross section region RSC of the mandrel 31 is excessively short, for example, there is a possibility that the material may go around further to the tip end side rather than the small cross section region RSC of the mandrel 31 and therefore the wall thickness on the tip end side of the first small diameter region RSD1 of the differential thickness pipe 21 may become thicker than the second wall thickness T2, for example. From a viewpoint of avoiding such a problem, it is preferable that the end part on the tip end side of the small cross section region RSC of the mandrel 31 has reached the end part on the base end side of the small inner diameter region RSDI of the container hole 51*a* or a position on the tip end side rather than the end part on the base end side of the small inner diameter region RSDI of the container hole 51*a* at a time point when the material which should form the first small diameter region RSD1 of the differential thickness pipe 21 reaches the end part on the base end side of the small inner diameter region RSDI of the container hole 51*a* at the latest.

Figure 4:
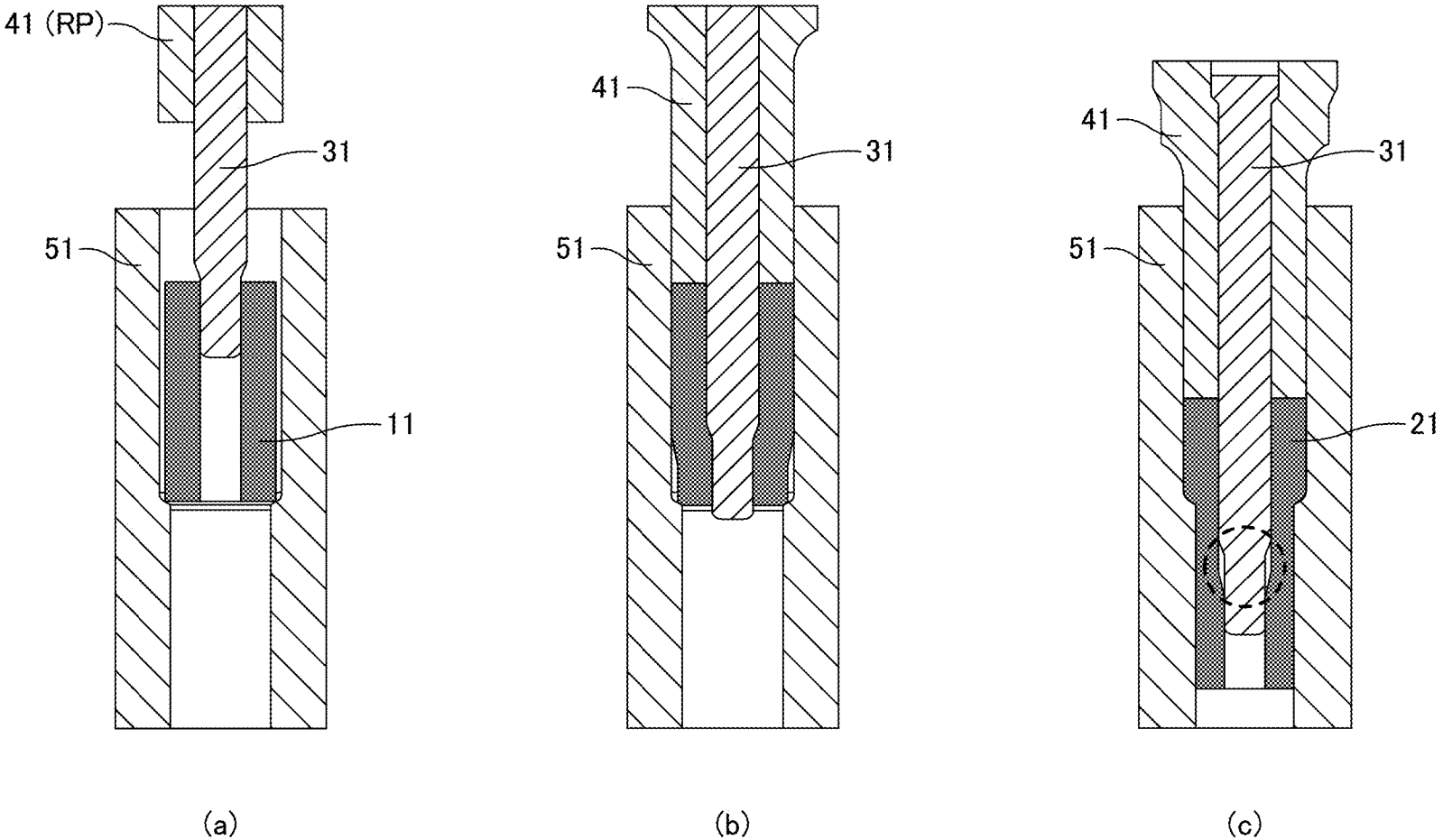
FIG. 4 is a schematic sectional view for showing an example of change of a shape of a raw pipe in association with execution of the first method.

FIG. 4 is a schematic sectional view for showing an example of change of a shape of a raw pipe in association with execution of the first method. In FIG. 4, in order to make the drawing brief, reference signs given to the respective parts shown in FIG. 2 and FIG. 3 are omitted. However, since the reference signs shown in FIG. 2 and FIG. 3 will be used in the following explanation regarding FIG. 4 for accuracy purposes, please refer to FIG. 2 and FIG. 3 if needed.

In (a) of FIG. 4, a state where the first process included in the first method has been completed, the raw pipe 11 has been inserted in the large diameter region RLDI of the container hole 51*a* formed in the container 51 and the end part on the tip end side of the raw pipe 11 is in contact with the inner diameter decreasing region RsDI. Namely, the raw pipe 11 has been set at a predetermined position in the inside of the container hole 51*a*. In the example shown in (a) of FIG. 4, the raw pipe 11 is set coaxially with the mandrel 31, the sleeve 41 and the container 51 by the small cross section region RSC of the mandrel 31 being inserted in the raw pipe 11.

Next, in (b) of FIG. 4, in the second process included in the first method, the mandrel 31 is pushed into the raw pipe 11 by the drive mechanism which is not shown, the base end side of the pipe 11 is expanded by the large cross section region RLC of the mandrel 31 and the end part on the tip end side of the sleeve 41 is in contact with the end part on the base end side of the raw pipe 11. Namely, in (b) of FIG. 4, a state at the second time point when the third process is about to be started is shown. In the example shown in (b) of FIG. 4, the end part on the tip end side of the mandrel 31 has reached a position on the tip end side rather than the end part on the tip end side of the raw pipe 11. Therefore, in a time period when the first small diameter region RSD1 of the differential thickness pipe 21 is being formed in the third process performed thereafter, extrusion processing of the first small diameter region RSD1 of the differential thickness pipe 21 is performed through a gap between the small cross section region RSC of the mandrel 31 and the small inner diameter region RSDI of the container hole 51*a* that is a gap corresponding to the second wall thickness T2 that is the wall thickness of the first small diameter region RSD1. Therefore, the problem that the material which should form the first small diameter region RSD1 of the differential thickness pipe 21 goes around further to the tip end side rather than the small cross section region RSC of the mandrel 31 and therefore the wall thickness on the tip end side of the first small diameter region RSD1 of the differential thickness pipe 21 becomes thicker than the second wall thickness T2, for example, as mentioned above, can be avoided. In addition, the end part on the base end side of the small cross section region RSC of the mandrel 31 is located at a position on the base end side rather than the end part on the base end side of the small inner diameter region RSDI of the container hole 51*a*. Therefore, the material which should form the first small diameter region RSD1 of the differential thickness pipe 21 can be extruded ton the tip end side through the gap between the small cross section region RSC of the mandrel 31 and the small inner diameter region RSDI of the container hole 51*a* to form the first small diameter region RSD1 of the differential thickness pipe 21.

When the mandrel 31 and the sleeve 41 are further pushed into the tip end side in the second process and extrusion processing advances further, the material constituting the raw pipe 11 is extruded to the tip end side through a gap between the cross section expansion region ReC of the mandrel 31 and the small inner diameter region RSDI of the container hole 51*a* to form the first tapered region RtDI1 of the differential thickness pipe 21, and thereafter the material constituting the raw pipe 11 is extruded to the tip end side through a gap between the large cross section region RLC of the mandrel 31 and the small inner diameter region RSDI of the container hole 51*a* to form the second small diameter region RSD2 of the differential thickness pipe 21.

In (c) of FIG. 4, a state where the extrusion processing of the first small diameter region RSD1 and the second small diameter region RSD2 of the differential thickness pipe 21 has been finished as mentioned above in the third process and molding of the differential thickness pipe 21 has been completed is shown. As shown in the portion surrounded by a thick dashed line in (c) of FIG. 4, an inclination of an inner peripheral surface of the first tapered region RtDI1 of the differential thickness pipe 21 is gentler than an inclination of an outer peripheral surface of the cross section expansion region ReC of the mandrel 31. This is because the inclination of the inner peripheral surface of the first tapered region RtDI1 becomes longer in the extrusion direction and gentler than the inclination of the outer peripheral surface of the cross section expansion region ReC since the gap between the end part on the base end side of the small inner diameter region RSDI and the mandrel 31 becomes narrower gradually and a flow velocity of the material extruded to the tip end side becomes higher as the cross section expansion region ReC of the mandrel 31 passes a position opposing to the end part on the base end side of the small inner diameter region RSDI of the container hole 51*a*.

Moreover, a gap has arisen between a part adjacent on the base end side to the first tapered region RtDI1 of the differential thickness pipe 21 and the mandrel 31. This is because a flow velocity of the material extruded to the tip end side becomes higher and the first tapered region RtDI1 and second small diameter region RSD2 of the differential thickness pipe 21 become longer in the extrusion direction since the gap between the end part on the base end side of the small inner diameter region RSDI and the mandrel 31 becomes narrower gradually as the cross section expansion region ReC of the mandrel 31 passes the position opposing to the end part on the base end side of the small inner diameter region RSDI of the container hole 51*a* and a cross sectional area of a gap between the large cross section region RLC of the mandrel 31 and the small inner diameter region RSDI of the container hole 51*a* is smaller than a cross sectional area of the raw pipe (whose diameter has been expanded to form the large diameter region RLD of the differential thickness pipe 21) pushed into the gap.

The above-mentioned gap becomes longer as the extrusion processing of the second small diameter region RSD2 of the differential thickness pipe 21 in the third process advances, and a contact area between the differential thickness pipe 21 and the mandrel 31 decreases. As a result, since processing load decreases as the extrusion processing of the second small diameter region RSD2 of the differential thickness pipe 21 in the third process advances, the first method is suitable for molding a long object (differential thickness pipe long in its axis direction).

<Effects>

As explained above, in the first method, in the first process, the raw pipe is set in the container in which the container hole having the small inner diameter region which has an inner diameter smaller than the outer diameter of the raw pipe and the large inner diameter region which has an inner diameter larger than the outer diameter of the raw pipe on the tip end side and base end side respectively. Then, in the second process, the end part on the base end side of the raw pipe is expanded by pushing the mandrel which has the small outer diameter region having an outer diameter corresponding to the inner diameter of the raw pipe and the large outer diameter region having an outer diameter larger than the inner diameter of the raw pipe into the inside of the raw pipe. Furthermore, in the third process, the raw pipe through which the mandrel is inserted is pushed into the small inner diameter region of the container by pressing the end part on the base end side of the raw pipe with the sleeve.

Therefore, in accordance with the first method, as compared with a case where a diameter difference between a large diameter part and a small diameter part of a differential thickness pipe is increased by enlarging an outer diameter of a raw pipe, increase in processing load can be reduced. Moreover, increase in processing load in association with lengthening of a differential thickness pipe to be molded can be reduced. Namely, in accordance with the first method, a diameter difference between a large diameter part (ear part) and a small diameter part (differential thickness part whose diameter is reduced) can be set to be larger and length in its axis direction can be set arbitrarily without being accompanied by excessive increase in processing load.

Figure 5:
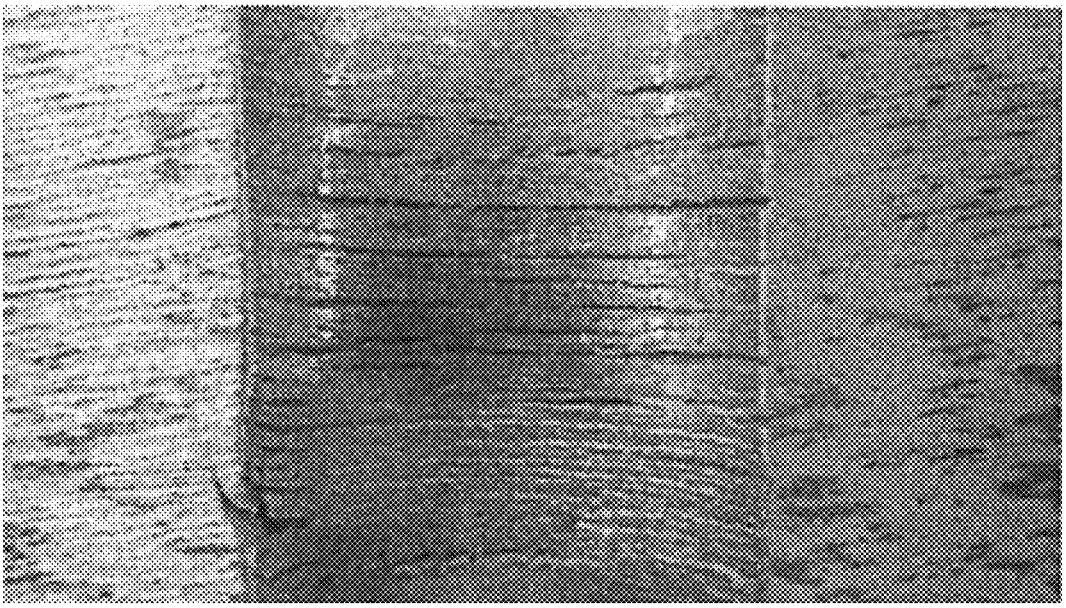
FIG. 5 is photographs for showing smoothing of an inner peripheral surface of a raw pipe in association with execution of the second process.
Figure 5:
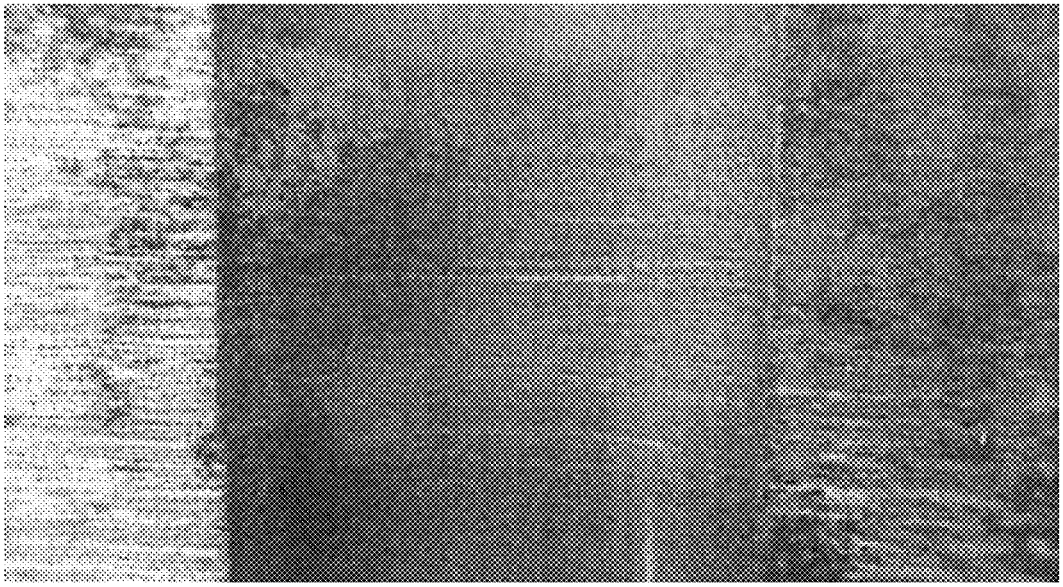

In addition to the above, in the second process included in the first method, the mandrel is pushed into the raw pipe and the diameter of the base end side of the raw pipe is expanded by the large cross section region of the mandrel. In this process, since the inner peripheral surface of the raw pipe is drawn by the mandrel, processing marks generated when drilling a hole (inner space) of the raw pipe, etc., are crushed and the inner peripheral surface of the raw pipe is smoothed. FIG. 5 is photographs for showing smoothing of an inner peripheral surface of a raw pipe in association with execution of the second process. (a) of FIG. 5 is a photograph of an inner peripheral surface of a raw pipe before the second process is performed or in accordance with a method in which the diameter expansion of the base end side of the raw pipe by the large cross section region of the mandrel is not performed, and processing marks generated when drilling a hole of the raw pipe are observed. There is a possibility that such a processing mark may become a starting point of occurrence of defects such as a crack when such a processing mark receives stress such as tensile stress, for example, in extrusion processing performed in the following third process and/or in use as a differential thickness pipe after molding. On the other hand, (b) of FIG. 5 is a photograph of an inner peripheral surface of the first small diameter region of the differential thickness pipe molded by the first method, it is found that processing marks as shown in (a) of FIG. 5 are not observed and the inner peripheral surface has been smoothed. Namely, in accordance with the first method, a possibility that defects such as a crack may occur when receiving stress, such as tensile stress, for example, in extrusion processing performed in the following third process and/or in use as a differential thickness pipe after molding.

<Modification>

As explained referring to (b) of FIG. 2, the differential thickness pipe 21 molded by the above-mentioned first method comprises the first small diameter region RSD1, the second small diameter region RSD2 and the large diameter region RLD, in order toward the base end side from the tip end side. The second small diameter region RSD2 of this differential thickness pipe 21 is constituted by one part having the third outer diameter DO3 that is an outer diameter equal to the second outer diameter DO2 that is an outer diameter smaller than the first outer diameter DO1 that is an outer diameter of the raw pipe 11, an inner space having a cross section corresponding to the cross section of the large cross section region RLC of the mandrel 31 and a third wall thickness that is a wall thickness smaller than the second wall thickness T2 that is the wall thickness of the first small diameter region RSD1. However, the second small diameter region RSD2 of the differential thickness pipe 21 is not necessarily constituted by one part, and may comprise several parts having different shapes of the cross section of an inner space differs.

Figure 6:
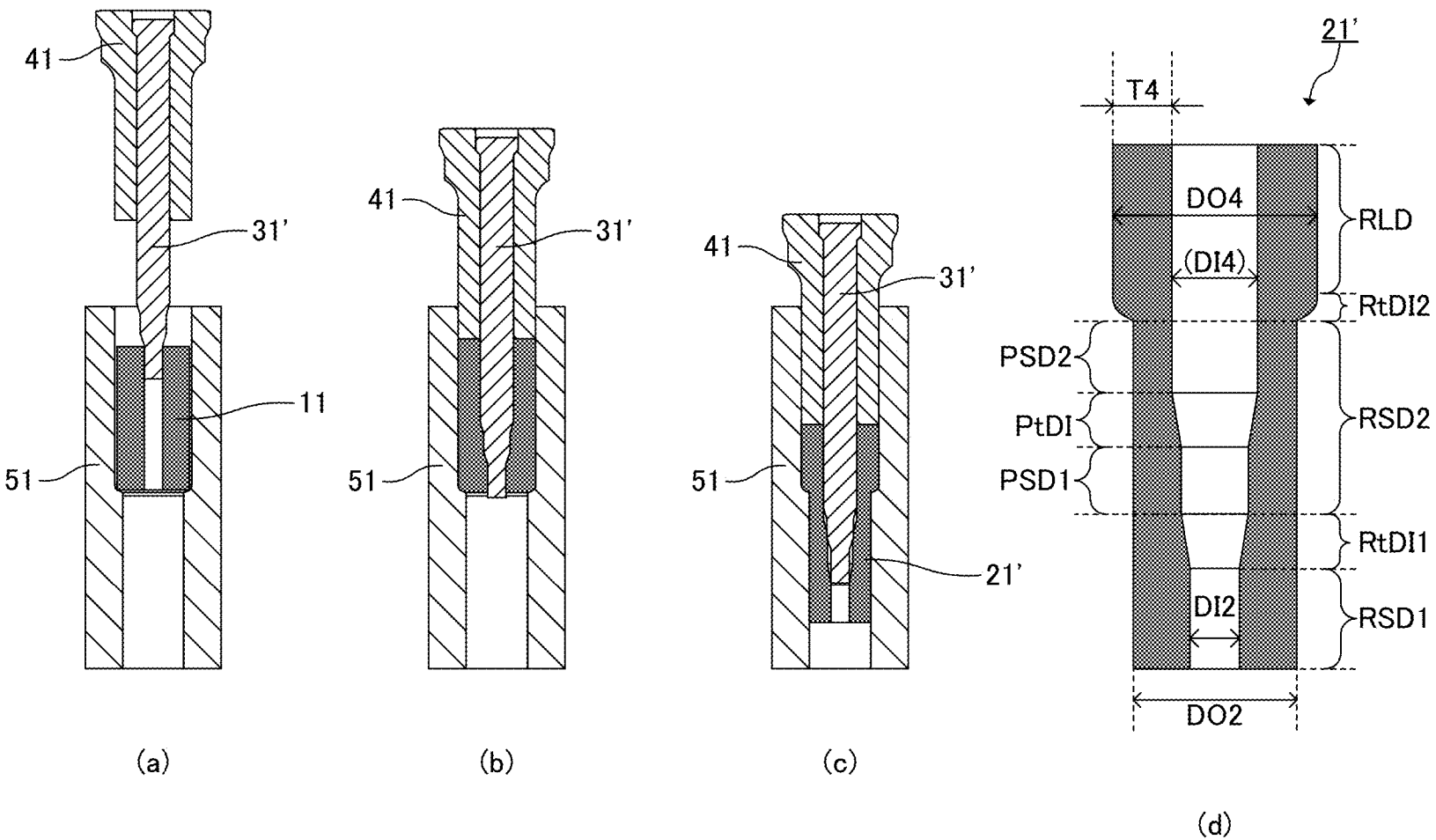
FIG. 6 is a schematic sectional view for showing an example of change of a shape of a raw pipe in a case where a differential thickness pipe which has a second small diameter region which comprises two parts with different shapes by the first method according to a modification.

FIG. 6 is a schematic sectional view for showing an example of change of a shape of a raw pipe in a case where a differential thickness pipe which has a second small diameter region which comprises two parts with different shapes by the first method according to a modification. States shown in (a) to (c) of FIG. 6 correspond to the states shown in (a) to (c) of FIG. 4 referred to in the explanation about the first method, respectively. Also in FIG. 6, similarly to FIG. 4, in order to make the drawing brief, reference signs given to the respective parts shown in FIG. 2 and FIG. 3 are omitted. However, since the reference signs shown in FIG. 2 and FIG. 3 will be used in the following explanation regarding FIG. 6 for accuracy purposes, please refer to FIG. 2 and FIG. 3 if needed. (d) of FIG. 6 is a schematic sectional view of the differential thickness pipe 21' molded by the first method according to the modification.

In the example shown in FIG. 6, the large cross section region RLC of the mandrel 31' comprises a part formed on the base end side and having a cross section corresponding to the cross section of the inner space of the large diameter region RLD of the differential thickness pipe 21' to be molded and a portion formed on the tip end side and having a cross section corresponding to the cross section of the inner space of the second small diameter region RSD2 of the differential thickness pipe 21' to be molded. Therefore, as exemplified in (b) of FIG. 6, in a region on the base end side of the raw pipe 11 which has a diameter expanded by the large cross section region RLC of the mandrel 31' in the second process included in the first method, two parts which have inner spaces having cross sections with different sizes (and a part which is formed between these two parts and has an inner space having a cross section expanding as approaching from the tip end side to the base end side) are formed. Thereafter, the first small diameter region RSD1 and second small diameter region RSD2 of the differential thickness pipe 21' are formed by execution of extrusion processing in the third process, and molding of the differential thickness pipe 21' is completed as exemplified in (c) of FIG. 6.

In the second small diameter region RSD2 of the differential thickness pipe 21' molded as mentioned above, as exemplified in (d) of FIG. 6, a part PSD2 which has a columnar inner space having a cross section identical with the cross section of the inner space of the large diameter region RLD (circular columnar inner space having the fourth inner diameter DI4 when the cross section is circular) is formed on the base end side, and a part PSD1 which has a columnar inner space having an intermediate cross section between the cross section of the inner space of the large diameter region RLD and the cross section of the inner space of the first small diameter region RSD1 (circular columnar inner space when the respective cross sections are circular) is formed on the tip end side. Moreover, between these two parts PSD1 and PSD2, a taper-shaped part PtDI which has an inner space having a cross section expanding from the cross section of the inner space of the part PSD1 to the cross section of the inner space of the part PSD2 as approaching from the tip end side to the base end side is formed. Namely, the second small diameter region RSD2 of the differential thickness pipe 21' exemplified in (d) of FIG. 6 is formed to be multistage with these two parts PSD1 and PSD2 and the taper-shaped part PtDI.

As mentioned above, in accordance with the first method according to the modification, the differential thickness pipe which has the second small diameter region including a plurality of parts having different shapes of cross sections of inner spaces can be molded. When forming a plurality of parts having different shapes of cross sections in the large cross section region RLC of the mandrel 31' as mentioned above, as a matter of course, it is necessary to form the large cross section region RLC such that the cross section of the part on the tip end side is smaller than the cross section of the part on the base end side.

Moreover, in the above-mentioned modification, a case where the second small diameter region of a differential thickness pipe is formed to be multistage so as to include a plurality of parts having different shapes of cross sections of inner spaces was explained. However, configurations of multistage differential thickness pipes are not limited to the above. For example, depending on mechanical strength, an extent of work hardening and/or easiness of plastic flow of the material constituting the raw pipe, and/or mechanical strength of members constituting an extrusion molding apparatus and/or machining ability of an extrusion molding apparatus, etc., the outer peripheral surface of the first small diameter region, the second small diameter region and/or the large diameter region of the differential thickness pipe can be also formed to be multistage by preparing a plurality of parts which have different inner diameters in the large inner diameter region and/or small inner diameter region of the container, for example.

Figure 7:
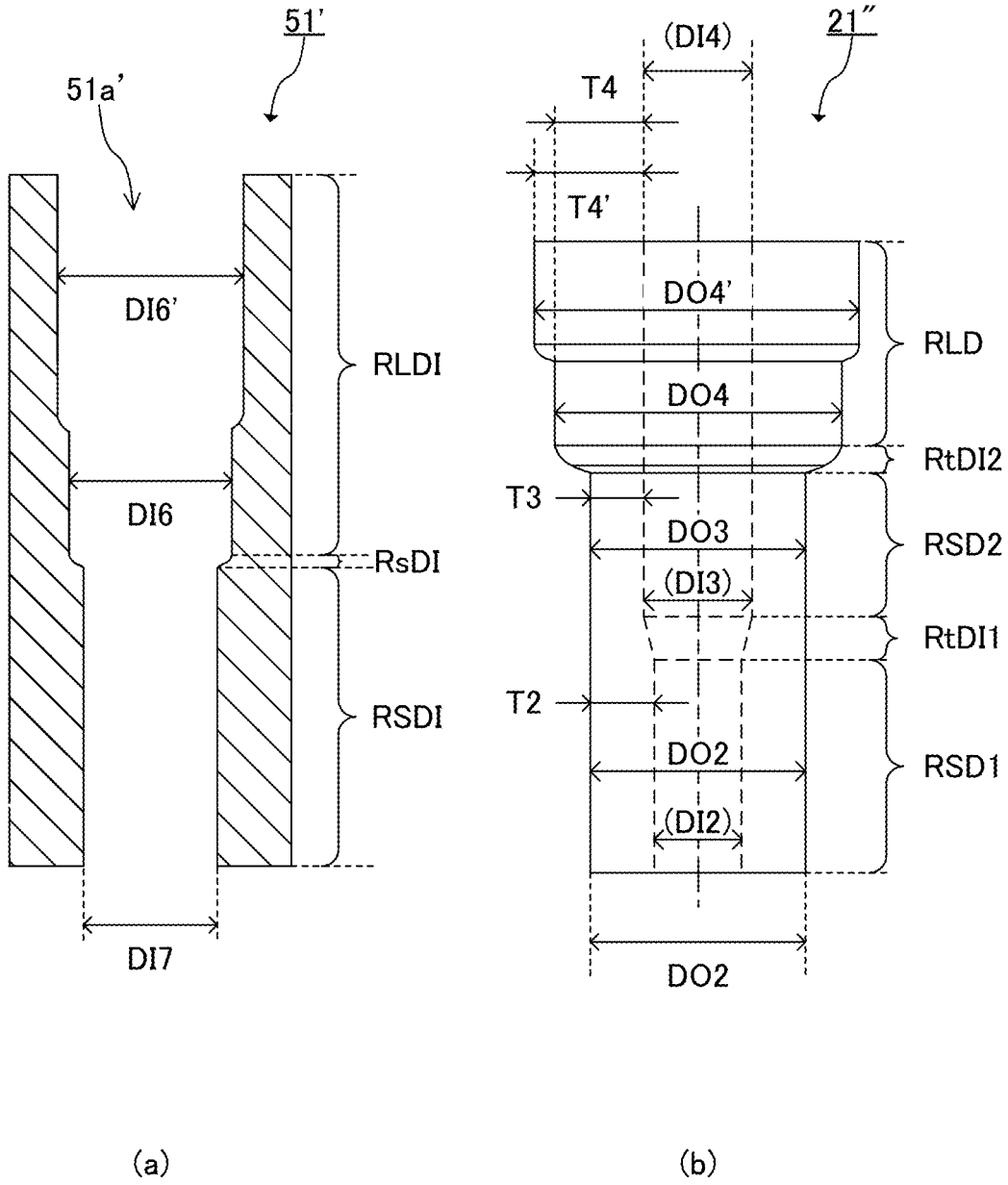
FIG. 7 is a schematic sectional view of a container used in the first method according to another modification and a differential thickness pipe molded using the container.

FIG. 7 is a schematic sectional view of a container used in the first method according to another modification and a differential thickness pipe molded using the container. In a container hole 51*a*' formed in a container 51' exemplified in (a) of FIG. 7, a large inner diameter region RLDI is formed so as to have a multistage (double-stage) configuration comprising a part formed on the tip end side and having a sixth inner diameter DI6 and a part formed on the base end side and having an inner diameter DI6' larger than the sixth inner diameter DI6. By performing the first method using the container 51' which has such a configuration and a sleeve corresponding to the container 51', which is not shown, a differential thickness pipe 21" which has a large diameter region RLD formed so as to have a multistage configuration comprising a part formed on the tip end side and having a fourth outer diameter DO4 and a part formed on the base end side and having an outer diameter DO4' larger than the fourth outer diameter DO4, as exemplified in (b) of FIG. 7. Although not shown, similarly to the above, when the small inner diameter region RSDI of the container is formed to be multistage, the differential thickness pipe 21" which has the first small diameter region RSD1 and/or second small diameter region RSD2 formed to be multistage can also be molded.

Second Embodiment

Hereafter, an extrusion molding method of a differential thickness pipe according to a second embodiment of the present invention (which may be referred to as a "second method" hereafter.) will be explained, referring to drawings.

As mentioned above in the explanation about the first method, the gap between the end part on the base end side of the small inner diameter region and the mandrel becomes narrower gradually as the cross section expansion region of the mandrel passes a position opposing to the end part on the base end side of the small inner diameter region of the container hole in the third process. Moreover, the cross sectional area of the gap between the large cross section region of the mandrel and the small inner diameter region of the container hole is smaller than the cross sectional area of the raw pipe (whose diameter has been expanded to form the large diameter region of the differential thickness pipe) pushed into the gap. As a result, the flow velocity of the material extruded to the tip end side from the gap between the large cross section region of the mandrel and the small inner diameter region of the container hole becomes higher, and the first tapered region and second small diameter region of the differential thickness pipe become longer in the extrusion direction. For this reason, a gap arises between a part adjacent on the base end side to the first tapered region of the differential thickness pipe and the mandrel.

In the above-mentioned process, since the first tapered region and second small diameter region of the differential thickness pipe are prolonged toward the tip end side faster than the mandrel, the mandrel is pulled by the first small diameter region of the differential thickness pipe to the tip end side. Therefore, when the mandrel is fixed to the sleeve such that the mandrel does not advance to the tip end side faster than the sleeve, the sleeve will be pulled to the tip end side by the first tapered region and second small diameter region of the differential thickness pipe through the mandrel. Namely, a part of processing load required to press the raw pipe to perform extrusion processing in the third process can be provided by the tensile stress by the first tapered region and second small diameter region of the differential thickness pipe being prolonged faster toward the tip end side.

<Configuration>

Then, the second method is the above-mentioned first method, wherein the mandrel and the sleeve are fixed such that a distance between the end part on the tip end side of the mandrel and the end part on the tip end side of the sleeve in the extrusion direction does not become larger than a distance between the end part on the tip end side of the mandrel and the end part on the tip end side of the sleeve at the second time point.

Here, (a) of FIG. 3 which was referred to in the explanation about the first method is referred to anew. The mandrel 31 exemplified in (a) of FIG. 3 is inserted in the columnar inner space formed in the sleeve 41. Namely, the sleeve 41 is disposed outside the mandrel 31 coaxially. A part which has a cross section larger than the cross section of the inner space of the sleeve 41 (an outer diameter larger than the fifth inner diameter DI5) is formed at the end part on the base end side of the mandrel 31, and this part is in contact with the sleeve 41 at the end part on the base end side of the inner space of the sleeve 41. Therefore, the mandrel 31 cannot advance to the tip end side rather than the position exemplified in (a) of FIG. 3 with respect to the sleeve 41. Namely, the mandrel 31 and the sleeve 41 are fixed such that the distance between the end part on the tip end side of the mandrel 31 and the end part on the tip end side of the sleeve 41 does not become further larger.

<Effects>

In accordance with the above, since the mandrel is pulled to the tip end side by the first small diameter region of the differential thickness pipe as mentioned above when extrusion processing of the first tapered region and second small diameter region of the differential thickness pipe is performed in the third process, it comes to that the mandrel 31 will drive the sleeve 41 toward the tip end side. As a result, since a part of processing load required to press the raw pipe by the sleeve 41 to perform extrusion processing in the third process can be provided by the tensile stress by the first tapered region and second small diameter region of the differential thickness pipe being prolonged faster toward the tip end side, processing load in the third process can be reduced. Such an effect is very effective when a long differential thickness pipe is molded.

In order to attain the above-mentioned effect, it is sufficient that the mandrel and the sleeve are fixed such that the distance between the end part on the tip end side of the mandrel and the end part on the tip end side of the sleeve in the extrusion direction does not become larger than the distance between the end part on the tip end side of the mandrel and the end part on the tip end side of the sleeve at the second time point as the above. However, from the point of view of reduction of manufacturing cost by simplification of a configuration of an extrusion molding apparatus, etc., for example, a positional relation between the mandrel and the sleeve may be fixed from beginning to end.

Third Embodiment

By the way, as mentioned at the beginning of the present specification, the present invention relates not only to an extrusion molding method of a differential thickness pipe including the above-mentioned first and second methods mentioned above, but also to an extrusion molding apparatus of a differential thickness pipe. Therefore, extrusion molding apparatuses of a differential thickness pipe according to various embodiments of the present invention will be explained below.

First, an extrusion molding apparatus of a differential thickness pipe according to a third embodiment of the present invention (which may be referred to as a "third apparatus" hereafter.) will be explained.

<Configuration>

The third apparatus is an extrusion molding apparatus which comprises a mandrel that is a core bar having a predetermined shape, a sleeve that is a cylindrical member disposed coaxially with the mandrel on an outside of the mandrel, a container that is a die in which a container hole that is a penetration hole having a predetermined shape is formed, and a drive mechanism configured so as to push the mandrel and the sleeve into the container hole. The third apparatus is configured so as to mold a differential thickness pipe having a predetermined shape by performing a first process to a third process.

Since details of the first process to the third process as well as the mandrel, the sleeve and the container had been already mentioned referring to FIG. 1 to FIG. 4 in the explanation about the first method, the explanation thereof is omitted here.

In addition, as mentioned above, the shapes of the cross sections of the inner spaces of the second small diameter region RSD2 and the large diameter region RLD of the differential thickness pipe are not limited in particular, and can be various shapes, such as a polygon, an ellipse and a circle, for example, respectively. Typically, as mentioned referring to FIG. 2 and FIG. 3 in the explanation about the first method, the inner space of the second small diameter region RSD2 of the differential thickness pipe 21 has a circular columnar shape having the third inner diameter DI3 that is a predetermined inner diameter larger than the first inner diameter DI1 (DI3>DI1) and the inner space of the large diameter region RLD of the differential thickness pipe 21 has a circular columnar shape having the fourth inner diameter DI4 that is a predetermined inner diameter equal to the third inner diameter DI3 (DI4=DI3). In this case, the inner space of the large cross section region RLC of the mandrel 31 and the inner space of the sleeve 41 also have a circular columnar shape, respectively.

<Effects>

By performing the first process to the third process in the third apparatus which has the configuration as mentioned above, as compared with a case where a diameter difference between a large diameter part and a small diameter part of a differential thickness pipe is increased by enlarging an outer diameter of a raw pipe, increase in processing load can be reduced. Moreover, increase in processing load in association with lengthening of a differential thickness pipe to be molded can be reduced. Namely, in accordance with the third apparatus, a diameter difference between a large diameter part (ear part) and a small diameter part (differential thickness part whose diameter is reduced) can be set to be larger and length in its axis direction can be set arbitrarily without being accompanied by excessive increase in processing load.

Fourth Embodiment

Next, an extrusion molding apparatus of a differential thickness pipe according to a fourth embodiment of the present invention (which may be referred to as a "fourth apparatus" hereafter.) will be explained.

<Configuration>

The fourth apparatus is the above-mentioned third apparatus, wherein the mandrel and the sleeve are fixed such that a distance between the end part on the tip end side of the mandrel and the end part on the tip end side of the sleeve in the extrusion direction does not become larger than a distance between the end part on the tip end side of the mandrel and the end part on the tip end side of the sleeve at the second time point.

<Effects>

In accordance with the fourth apparatus, since the mandrel is pulled to the tip end side by the first small diameter region of the differential thickness pipe as mentioned above when extrusion processing of the first tapered region and second small diameter region of the differential thickness pipe is performed in the third process, it comes to that the mandrel 31 will drive the sleeve 41 toward the tip end side. As a result, since a part of processing load required to press the raw pipe by the sleeve 41 to perform extrusion processing in the third process can be provided by the tensile stress by the first tapered region and second small diameter region of the differential thickness pipe being prolonged faster toward the tip end side, processing load in the third process can be reduced. Such an effect is very effective when a long differential thickness pipe is molded.

In order to attain the above-mentioned effect, it is sufficient that the mandrel and the sleeve are fixed such that the distance between the end part on the tip end side of the mandrel and the end part on the tip end side of the sleeve in the extrusion direction does not become larger than the distance between the end part on the tip end side of the mandrel and the end part on the tip end side of the sleeve at the second time point as the above. However, from the point of view of reduction of manufacturing cost by simplification of a configuration of an extrusion molding apparatus, etc., for example, a positional relation between the mandrel and the sleeve may be fixed from beginning to end.

Fifth Embodiment

Next, an extrusion molding method of a differential thickness pipe according to a fifth embodiment of the present invention (which may be referred to as a "fifth method" hereafter.) will be explained. It should be taken into account that drawings referred to in the following explanation are schematic views exemplified for the purpose of explanation of the present invention to the last, and sizes, size relations and positional relations, etc. of respective components illustrated in respective drawings do not indicate requirements of the present invention strictly and correctly. The same thing as the above also applies to other embodiments of the present invention which will be mentioned later.

In the above-mentioned extrusion molding methods of a differential thickness pipe according to the first embodiment and second embodiment of the present invention (the first method and the second method), the mandrel comprising a region having an outer diameter larger than the inner diameter of the raw pipe is pushed into the inside of the raw pipe to expand the end part on the base end side of the raw pipe and thereafter the end part on the base end side of the raw pipe is pressed by the sleeve to push the raw pipe into the small inner diameter region of the container to reduce the diameter of the raw pipe. Thereby, as compared with a case where a diameter difference between a large diameter part and a small diameter part of a differential thickness pipe is increased by enlarging an outer diameter of a raw pipe, a diameter difference between a large diameter part and a small diameter part (differential thickness part whose diameter is reduced) can be set to be larger and length in its axis direction can be set arbitrarily without being accompanied by excessive increase in processing load.

However, since not only the outer diameter but also the inner diameter of the large diameter part are expanded by the mandrel in the above-mentioned method, the wall thickness of the large diameter part decrease. However, in a use in which high mechanical strength is required for the large diameter part, etc., for example, it is preferable to maintain or increase the wall thickness of the raw pipe in the large diameter part.

<Configuration>

Then, the fifth method is an extrusion molding method of a differential thickness pipe, in which a differential thickness pipe having a predetermined shape is molded by pushing a raw pipe having a predetermined shape into a container hole using a sleeve, in an extrusion molding apparatus. The extrusion molding apparatus used in the fifth method comprises a mandrel that is a core bar having a predetermined shape, a sleeve that is a cylindrical member disposed coaxially with the mandrel on an outside of the mandrel, a container that is a die in which a container hole that is a penetration hole having a predetermined shape is formed, and a drive mechanism configured so as to push at least the sleeve into the container hole.

Although a fundamental configuration of an extrusion molding apparatus is well known to a person skilled in the art and therefore detailed explanation about the same is omitted as mentioned in the explanation about the first method, its components including the mandrel, the sleeve and the container are constituted by a material which has properties (for example, mechanical strength and durability, etc.) which can withstand processing conditions such as load which acts on the components in each of processes which will be mentioned later, for example. Moreover, the drive mechanism for pushing the mandrel and the sleeve into the container hole can be chosen suitably from various well-known drive mechanisms in the art according to properties (for example, mechanical strength and hardness, etc.) of a material constituting a raw pipe which is subjected to the extrusion processing. Typically, a press machine such as a hydraulic press machine, for example, is adopted as the drive mechanism.

The raw pipe, the mandrel, the sleeve and the container, as well as the differential thickness pipe molded by performing the fifth method will be explained in detail below, referring to drawings.

Figure 8:
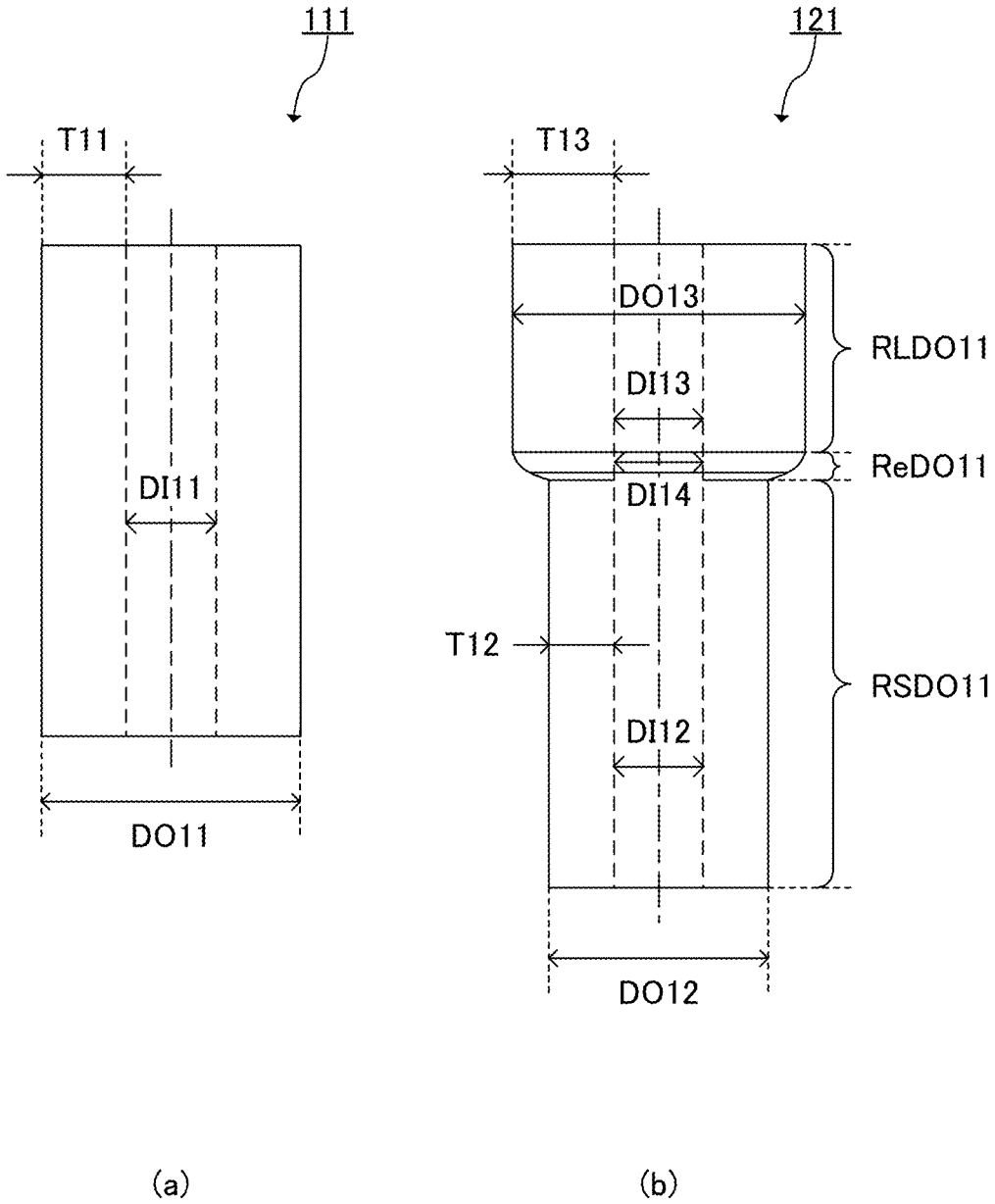
FIG. 8 is a schematic sectional view for showing an example of configurations of a raw pipe used in an extrusion molding method according to a fifth embodiment of the present invention (fifth method) and a differential thickness pipe molded from the raw pipe.

FIG. 8 is a schematic sectional view for showing an example of configurations of a raw pipe used in the fifth method and a differential thickness pipe molded from the raw pipe. As shown in (a) of FIG. 8, the raw pipe 111 is a circular cylindrical member which has an eleventh outer diameter DO11 that is a predetermined outer diameter, an eleventh inner diameter DI11 that is a predetermined inner diameter and an eleventh wall thickness T11 that is a predetermined wall thickness.

Shapes of the raw pipe are not necessarily limited to a simple circular cylindrical shape as exemplified in FIG. 8, and a part having a different structure may be prepared at the end part on the tip end side and/or base end side of the raw pipe unless it hinders the execution of the fifth process. A method for molding a differential thickness pipe which has a predetermined shape from such a raw pipe will be mentioned later in detail in explanation about other embodiments of the extrusion molding method of a differential thickness pipe according to the present invention (the present invention method).

Similarly to the raw pipe 11 used in the first method, the material constituting the raw pipe 111 is not limited as long as it is possible to mold the raw pipe into a desired shape by plastic deformation in extrusion processing. Typically, the material constituting the raw pipe 111 is metal such as lead, tin, aluminum, copper, zirconium, titanium, molybdenum, vanadium, niobium or steel, etc., for example.

Next, as shown in (b) of FIG. 8, the differential thickness pipe 121 molded by the fifth method comprises an eleventh small outer diameter region RSDO11, an eleventh large outer diameter region RLDO11 and an eleventh outer diameter increasing region ReDO11. The eleventh small outer diameter region RSDO11 is a region formed on a tip end side that is a downstream side in a pressing direction that is a direction in which the raw pipe 111 is pushed into the container hole and having a twelfth outer diameter DO12 that is a predetermined outer diameter smaller than the eleventh outer diameter DO11 (DO12<DO11), a twelfth inner diameter DI12 that is an inner diameter equal to the eleventh inner diameter DI11 (DI12=DI11) and a twelfth wall thickness T12 that is a predetermined wall thickness smaller than the eleventh wall thickness T11 (T12<T11). The eleventh large outer diameter region RLDO11 is a region formed on a base end side that is an upstream side in the pressing direction and having a thirteenth outer diameter DO13 that is a predetermined outer diameter larger than the eleventh outer diameter DO11 (DO13>DO11), a thirteenth inner diameter DI13 that is an inner diameter equal to the eleventh DI11 (DI13=DI11) and a thirteenth wall thickness T13 that is a predetermined wall thickness larger than the eleventh wall thickness T11 (T13>T11).

The eleventh outer diameter increasing region ReDO11 is a region formed between the eleventh small outer diameter region RSDO11 and the eleventh large outer diameter region RLDO11 and having an outer diameter increasing from the twelfth outer diameter DO12 to the thirteenth outer diameter DO13 as approaching from the eleventh small outer diameter region RSDO11 to the eleventh large outer diameter region RLDO11 and an inner diameter fixed at a fourteenth inner diameter DI14 equal to the eleventh inner diameter DI11 (DI14=DI11). Namely, a shape of a cross section of an inner space of the differential thickness pipe 121 is fixed and identical with the shape of the cross section of the inner space of the raw pipe 111 of the eleventh small outer diameter region RSDO11, the eleventh outer diameter increasing region ReDO11 and the eleventh large outer diameter region RLDO11.

Therefore, the eleventh small outer diameter region RSDO11 of the differential thickness pipe 121 is a region formed by decreasing the wall thickness of the raw pipe 111 from the eleventh wall thickness T11 to the twelfth wall thickness T12 to decrease the outer diameter of the raw pipe 111 from the eleventh outer diameter DO11 to the twelfth outer diameter DO12 through the execution of the fifth method. Moreover, the eleventh large outer diameter region RLDO11 of the differential thickness pipe 121 is a region formed by increasing the wall thickness of the raw pipe 111 from the eleventh wall thickness T11 to the thirteenth wall thickness T13 to increase the outer diameter of the raw pipe 111 from the eleventh outer diameter DO11 to the thirteenth outer diameter DO13 through the execution of the fifth method. Thus, in accordance with the fifth method, in the eleventh large outer diameter region RLDO11 of the differential thickness pipe 121, while maintaining the inner diameter of the raw pipe 111, its outer diameter can be thickened. Therefore, the fifth method is suitable for molding a differential thickness pipe supplied in a use in which high mechanical strength is required for the large diameter part, etc., for example.

Figure 9:
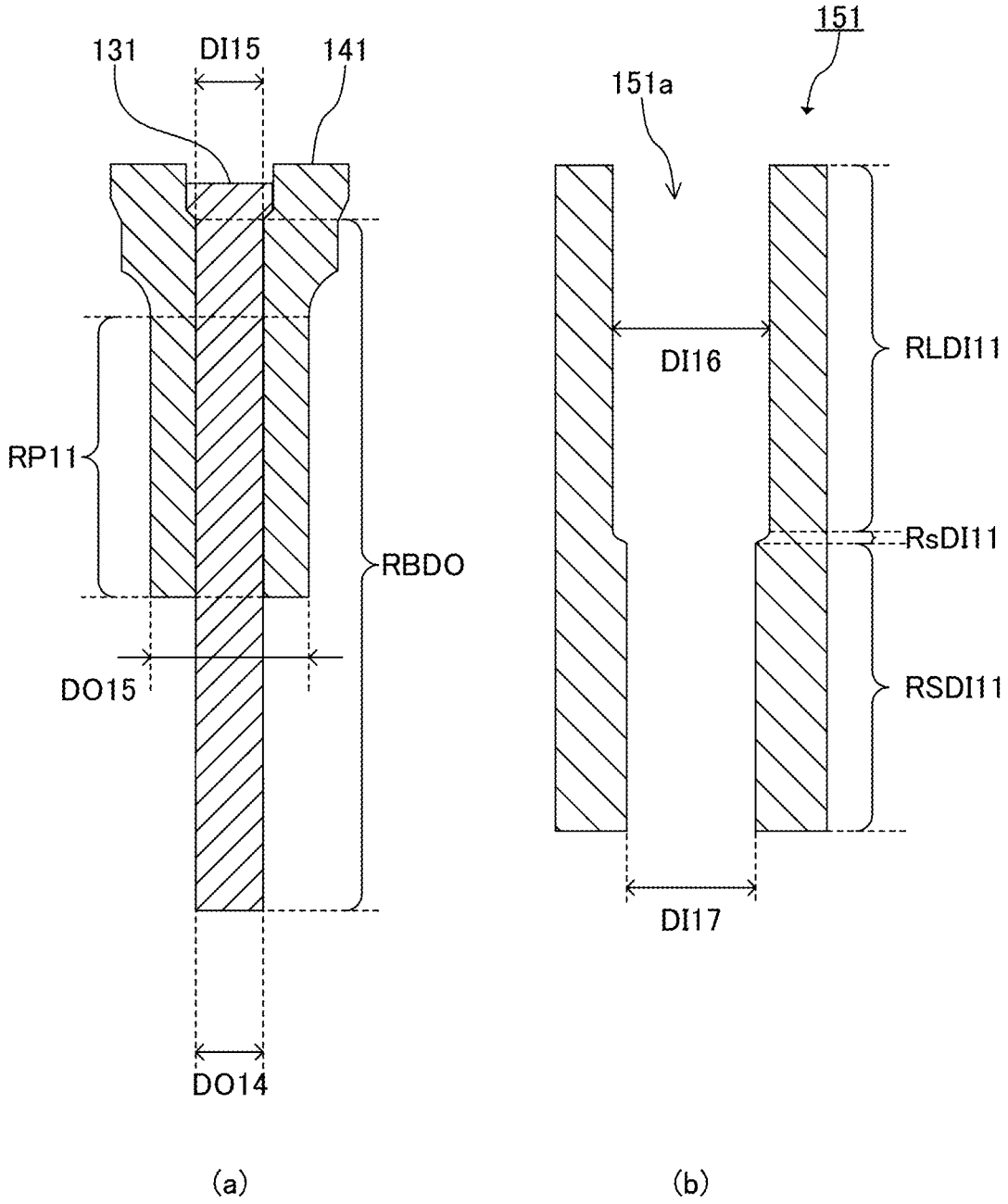
FIG. 9 is a schematic sectional view for showing an example of configurations of a mandrel, a sleeve and a container used in the fifth method.

FIG. 9 is a schematic sectional view for showing an example of configurations of a mandrel, a sleeve and a container used in the fifth method. (a) of FIG. 9 is a schematic sectional view for showing an example of a configurations of the mandrel and the sleeve used in the fifth method. As shown in (a) of FIG. 9, the mandrel 131 comprises a basic outer diameter region RBDO which is a circular columnar region formed on the tip end side and having a fourteenth outer diameter DO14 that is an outer diameter corresponding to the eleventh inner diameter DI11 which is an inner diameter of the raw pipe 111.

The sleeve 141 comprises an eleventh pressing region RP11 which is a cylindrical region formed on the tip end side and having a fifteenth outer diameter DO15 that is an outer diameter equal to the thirteenth outer diameter DO13 that is an outer diameter of the eleventh large outer diameter region RLD11 of the differential thickness pipe 121 and a circular columnar inner space having a fifteenth inner diameter DI15 that is an inner diameter corresponding to the fourteenth outer diameter DO14 that is an outer diameter of the basic outer diameter region RBDO.

Next, (b) of FIG. 9 is a schematic sectional view for showing an example of a configuration of the container used in the fifth method. As shown in (b) of FIG. 9, the container hole 151*a* comprises an eleventh large diameter region RLDI11, an eleventh small inner diameter region RSDI11 and an eleventh inner diameter decreasing region RsDI11. The eleventh large inner diameter region RLDI11 is a region formed on the base end side and having a sixteenth inner diameter DI16 that is an inner diameter corresponding to the thirteenth outer diameter DO13. The eleventh small inner diameter region RSDI11 is a region formed on the tip end side and having a seventeenth inner diameter DI17 that is an inner diameter corresponding to the twelfth outer diameter DO12. The eleventh inner diameter decreasing region RsDI11 is a region formed between the eleventh large inner diameter region RLDI11 and the eleventh small inner diameter region RSDI11 and having an inner diameter decreasing from the sixteenth inner diameter DI16 to the seventeenth inner diameter DI17 as approaching from the eleventh large inner diameter region RLDI11 to the eleventh small inner diameter region RSDI11.

In the fifth method, by performing the eleventh to thirteenth processes which will be explained below, the above-mentioned differential thickness pipe 121 can be molded by pressing the end part on the base end side of the raw pipe 111 with the eleventh pressing region RP11 of the sleeve 141 to push the raw pipe 111 into the container hole 151*a*, in a state where the mandrel 131 is inserted through the inner space of the raw pipe 111 from the base end side (upper side in the drawing).

Figure 10:
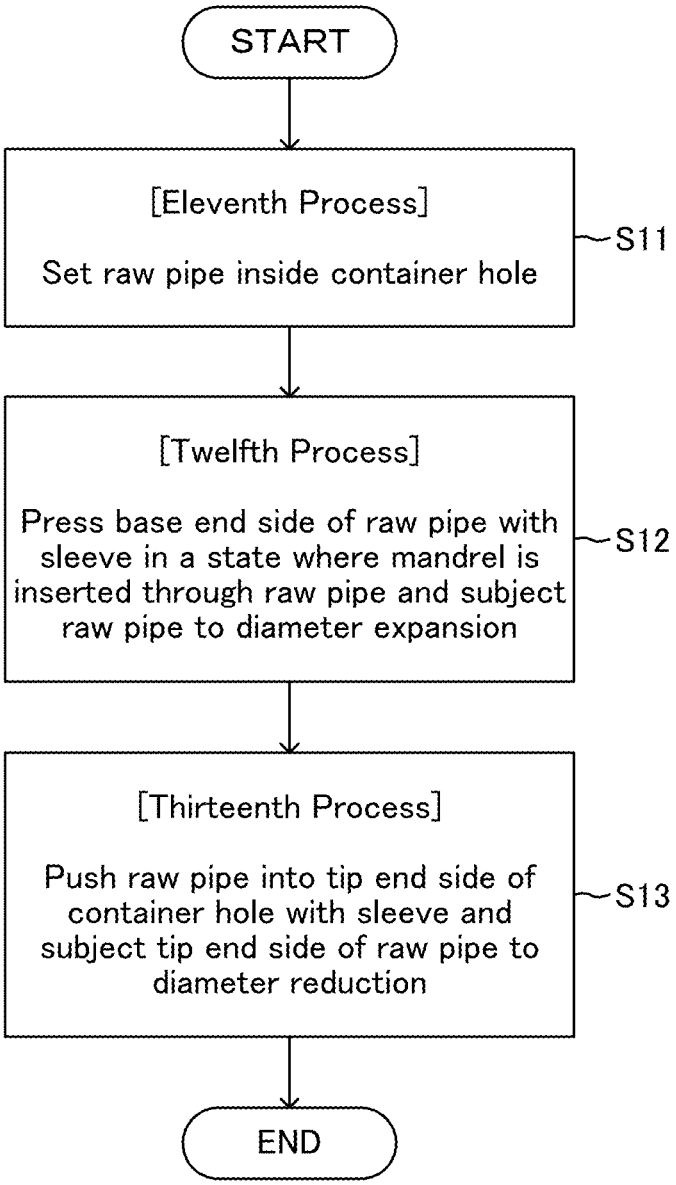
FIG. 10 is a flow chart for showing a flow of respective processes included in the fifth method.

FIG. 10 is a flow chart for showing a flow of respective processes included in the fifth method. The eleventh process performed in Step S11 is a process in which the raw pipe having a predetermined shape is set at a predetermined position in the inside of the container hole. Specifically, in the fifth process, the raw pipe 111 is set at a predetermined position in the inside of the container hole 151*a* by making the end part on the tip end side of the raw pipe 111 contact with the eleventh inner diameter decreasing region RsDI11 formed between the eleventh large inner diameter region RLDI11 and the eleventh small inner diameter region RSDI11 of the container hole 151*a* formed in the container 151.

Next, the twelfth process performed in Step S12 is a process in which diameter expansion of the raw pipe is performed by pressing the base end side of the raw pipe by the sleeve in a state where the mandrel is inserted through the raw pipe. Specifically, in the twelfth process, the end part on the base end side of the raw pipe 111 is pressed by the sleeve 141 in a state where the mandrel 131 is inserted through the raw pipe 111. Thereby, the material constituting the raw pipe 111 flows plastically into a space between the container 151 and the mandrel 131 in the eleventh large inner diameter region RLDI11 and the eleventh inner diameter decreasing region RsDI11 of the container hole 151*a* and the gap is filled up with the material. As a result, the outer diameter of the raw pipe 111 can be expanded to the thirteenth outer diameter DO13 while maintaining the inner diameter of the raw pipe 111 at the eleventh inner diameter DI11.

Next, the thirteenth process performed in Step S13 is a process in which the tip end side of the raw pipe is subjected to diameter reduction by further pressing the base end side of the raw pipe with the sleeve to push the tip end side of the raw pipe into the eleventh small inner diameter region. Specifically, the end part on the base end side of the raw pipe 111 is further pressed by the sleeve 141 in a state where the mandrel 131 is inserted through the raw pipe 111. Thereby, extrusion processing in which the material constituting the raw pipe 111 is extruded into the eleventh small inner diameter region RSDI11 of the container hole 151*a* through a gap between an end part on the base end side of the eleventh small inner diameter region RCDI11 of the container hole 151*a* and the mandrel 131. As a result, the tip end side of the raw pipe 111 can be subjected to diameter reduction. By performing the eleventh to thirteenth processes included in the fifth method in this way, the differential thickness pipe which has a predetermined shape can be molded.

As mentioned above, both of the twelfth and thirteenth processes are performed in a state where the mandrel 131 is inserted through the raw pipe 111. The insertion of the mandrel 131 through the raw pipe 111 may be completed at a time point when the twelfth process is started at the latest. Therefore, the mandrel 131 may be inserted through the raw pipe 111 after the raw pipe 111 is set in the inside of the container hole 151*a* in the eleventh process, or the raw pipe 111 through which the mandrel 131 has been already inserted may be set in the inside of the container hole 151*a* in the eleventh process.

In order to subject the raw pipe 111 to diameter expansion by pressing the base end side of the raw pipe 111 with the sleeve 141 to fill up the gap between the container 151 and the mandrel 131 with the material constituting the raw pipe 111 in the twelfth process as mentioned above, a tip of a mandrel needs to have reached the end part on the base end side of the eleventh small inner diameter region of the container hole in the pressing direction. Therefore, in the fifth method, at an eleven time point that is a time point when the twelfth process is started, an end part on the tip end side of the mandrel has reached an eleven position that is the same position in the pressing direction as a position of an end part on the base end side of the eleventh small inner diameter region of the container hole or a position on the tip end side rather than the eleventh position.

Furthermore, in the thirteenth process, as mentioned above, the base end side of the raw pipe 111 is further pressed by the sleeve 141 and the tip end side of the raw pipe 111 is pushed into the eleventh small inner diameter region RSDI11 of the container hole 151*a* through a gap between the end part on the base end side of the eleventh small inner diameter region RSDI11 of the container hole 151*a* and the mandrel 131 to perform the diameter reduction of the tip end side of the raw pipe 111. At this time, when the projection amount of the mandrel 131 from the end part on the base end side of the eleventh small inner diameter region RSDI11 is too small in the pressing direction, there is a possibility that the material constituting the raw pipe 111 pushed into the eleventh small inner diameter region RSDI11 may go around inward in the radial direction and the eleventh small inner diameter region RSDI11 of the differential thickness pipe 121 may not be molded in a desired shape.

Therefore, in the fifth method, at a twelfth time point that is a time point when the thirteenth process is started, the end part on the tip end side of the mandrel has reached a twelfth position that is a position on the tip end side by a predetermined distance rather than the end part on the base end side of the eleventh small inner diameter region of the container hole or a position on the tip end side rather than the twelfth position in the pressing direction. The "predetermined distance" here is a distance which can prevent the material constituting the raw pipe 111 pushed into the eleventh small inner diameter region RSDI11 from going around inward in the radial direction to mold the eleventh small inner diameter region RSDI11 of the differential thickness pipe 121 in a desired shape. Specific magnitude of such a distance can be properly determined based on results of an preliminary experiment and/or simulation analysis in accordance with a finite element method by variously changing the distance by which the end part on the tip end side of the mandrel projects from the end part on the tip end side of the end part on the base end side of the eleventh small inner diameter region of a container hole in the pressing direction, etc., for example.

In addition, arrangement of the mandrel in the twelfth process and thirteenth process included in the fifth method is not limited in particular as long as the above-mentioned conditions are fulfilled. For example, the mandrel and the sleeve may be formed integrally to be driven integrally by the drive mechanism. On the contrary, when the mandrel and the sleeve are formed as separate objects, the both may be driven integrally by the drive mechanism, each of them may be driven individually, or the mandrel may be fixed at a position with which the above-mentioned conditions are fulfilled and only the sleeve may be driven by the drive mechanism.

Figure 11:
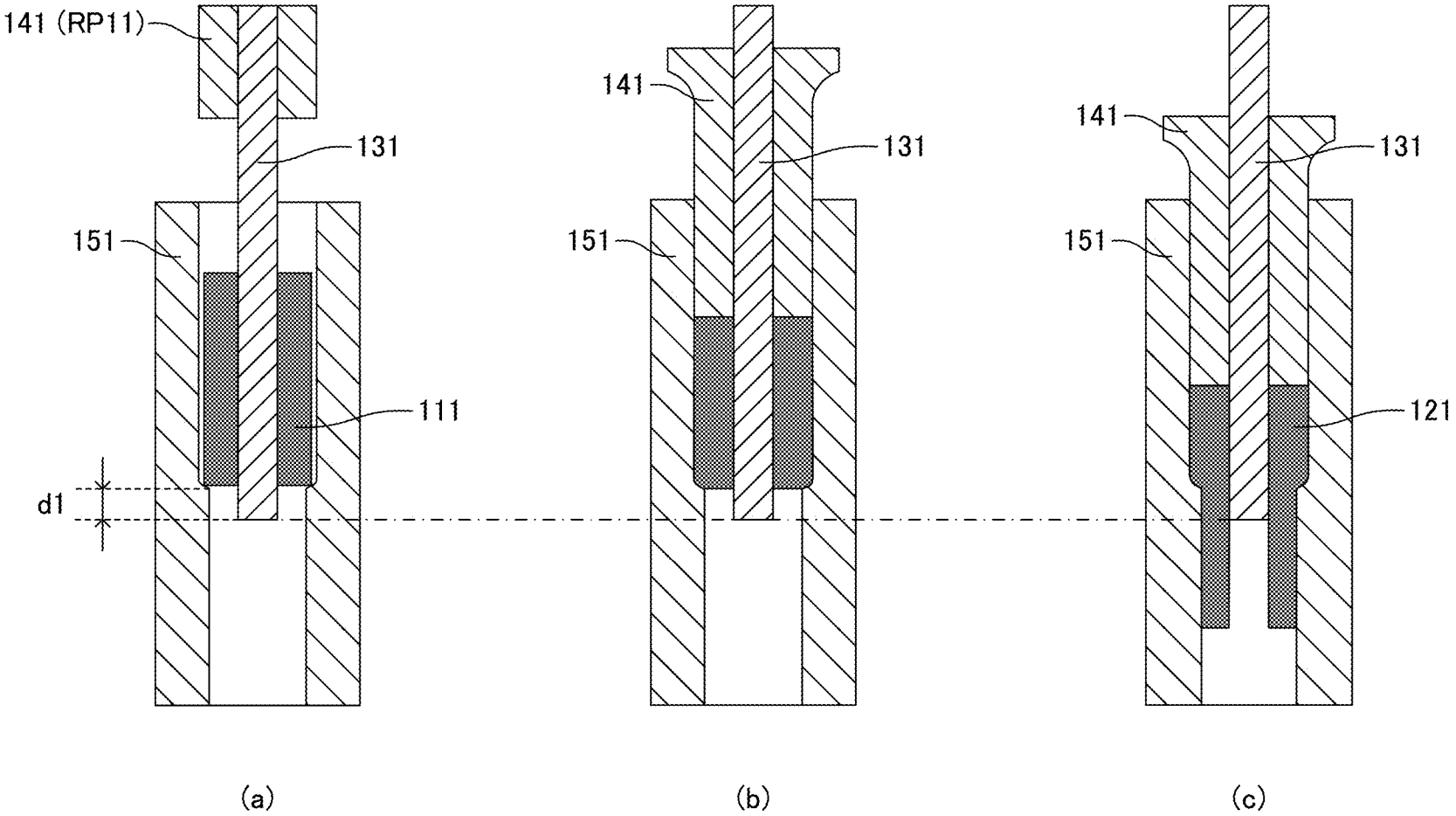
FIG. 11 is a schematic sectional view for showing an example of changes of a positional relation and shapes of a raw pipe, a mandrel, a sleeve, a container and a differential thickness pipe in association with progress of the fifth method.

FIG. 11 is a schematic sectional view for showing an example of changes of a positional relation and shapes of a raw pipe, a mandrel, a sleeve, a container and a differential thickness pipe in association with progress of the fifth method. In FIG. 11, in order to make the drawing brief, reference signs given to the respective parts shown in FIG. 8 and FIG. 9 are omitted. However, since the reference signs shown in FIG. 8 and FIG. 9 will be used in the following explanation regarding FIG. 11 for accuracy purposes, please refer to FIG. 8 and FIG. 9 if needed.

In (a) of FIG. 11, a state where the raw pipe 111 has been set at a predetermined position in the inside of the container hole 151*a* by execution of the eleventh process and furthermore the mandrel 131 has been inserted through the raw pipe 111 is shown. In (b) of FIG. 11, a state where a space between the container 151 and the mandrel 131 has been filled up with the material constituting the raw pipe 111 and the diameter expansion of the raw pipe 111 has been performed by the base end side of the raw pipe 111 being further pressed with the sleeve 141 through execution of the twelfth process is shown. In (c) of FIG. 11, a state where the tip end side of the raw pipe 111 has been pushed into the eleventh small inner diameter region RSDI11 of the container hole 151*a* through a gap between the end part on the base end side of the eleventh small inner diameter region RSDI11 of the container hole 151*a* and the mandrel 131 and diameter reduction of the tip end side of the raw pipe 111 has been performed by the base end side of the raw pipe 111 being further pressed with the sleeve 141 through execution of the thirteenth process is shown.

As exemplified in FIG. 11, in the fifth method, a region where the outer diameter of the raw pipe 111 has been expanded from the eleventh outer diameter DO11 to the thirteenth outer diameter DO13 by the wall thickness of the raw pipe 111 being thickened from the eleventh wall thickness T11 to the thirteenth wall thickness T13 becomes the eleventh large outer diameter region RLDO11 of the differential thickness pipe 121. Moreover, a region where the outer diameter of the raw pipe 111 has been reduced from the eleventh outer diameter DO11 to the twelfth outer diameter DO12 by the wall thickness of the raw pipe 111 being thinned (reduced) from the eleventh wall thickness T11 to the twelfth wall thickness T12 becomes the eleventh small outer diameter region RSDO11 of the differential thickness pipe 121. Thus, in the fifth method, the outer diameter of the raw pipe 111 can be increased by thickening while maintaining the inner diameter of the raw pipe 111 in the eleventh large outer diameter region RLDO11 of the differential thickness pipe 121. Therefore, in accordance with the fifth method, as compared with a case where a diameter difference between a large diameter part and a small diameter part of a differential thickness pipe is increased by enlarging an outer diameter of a raw pipe, a differential thickness pipe with a diameter difference (between the eleventh large outer diameter region RLDO11 and the eleventh small outer diameter region RSDO11) suitable for use in which high mechanical strength is demanded in a large diameter part or the like, for example, can be molded, without being accompanied by excessive increase in processing load.

Moreover, the length in its axial direction of the eleventh large outer diameter region RLDO11 and the eleventh small outer diameter region RSDO11 changes depending on the length in its axial direction and the diameter expansion amount (a difference between the eleventh outer diameter DO11 that is an outer diameter of the raw pipe 111 and the sixteenth inner diameter DI16 that is an inner diameter of the large inner diameter region RLDI of the container hole 151*a*) in the twelfth process of the raw pipe 111, and the amount of diameter reduction (a difference between the eleventh outer diameter DO11 that is an outer diameter of the raw pipe 111 and the seventeenth inner diameter DI17 that is an inner diameter of the eleventh small inner diameter region RSDI11 of the container hole 151*a*) and the push-in amount of the raw pipe 111 by the sleeve 141 in the thirteenth process. Namely, in accordance with the fifth method, the length in its axial direction of the eleventh large outer diameter region RLDO11 and the eleventh small outer diameter region RSDO11 of the differential thickness pipe 121 can be set up arbitrarily.

In the state where the diameter expansion of the raw pipe 111 has been completed by execution of the twelfth process shown in (b) of FIG. 11, the material constituting the raw pipe 111 has not yet started flowing into the eleventh small inner diameter region RSDI11 of the container hole 151*a*. However, for example, depending on easiness of plastic flow of the material constituting the raw pipe 111, configurations of the mandrel, sleeve and container which the extrusion molding apparatus used in the fifth method comprises, as well as pressing speed of the sleeve by the drive mechanism, etc., the material constituting the raw pipe 111 may start flowing into the eleventh small inner diameter region RSDI11 of the container hole 151*a* before the diameter expansion of the raw pipe 111 has been completed. Namely, the thirteenth process may start before execution of the twelfth process has been completed.

By the way, as indicated by a dot and dash line in FIG. 11, in the fifth method exemplified in FIG. 11, the mandrel 131 is fixed at a the position on the tip end side by a predetermined distance d1 in the pressing direction rather than the end part on the base end side of the eleventh small inner diameter region RSDI11 of the container hole 151*a* (the above-mentioned twelfth position), and only the sleeve 141 is driven by a drive mechanism which is not shown. However, as mentioned above, the mandrel 131 and the sleeve 141 may be driven integrally by a drive mechanism.

Figure 12:
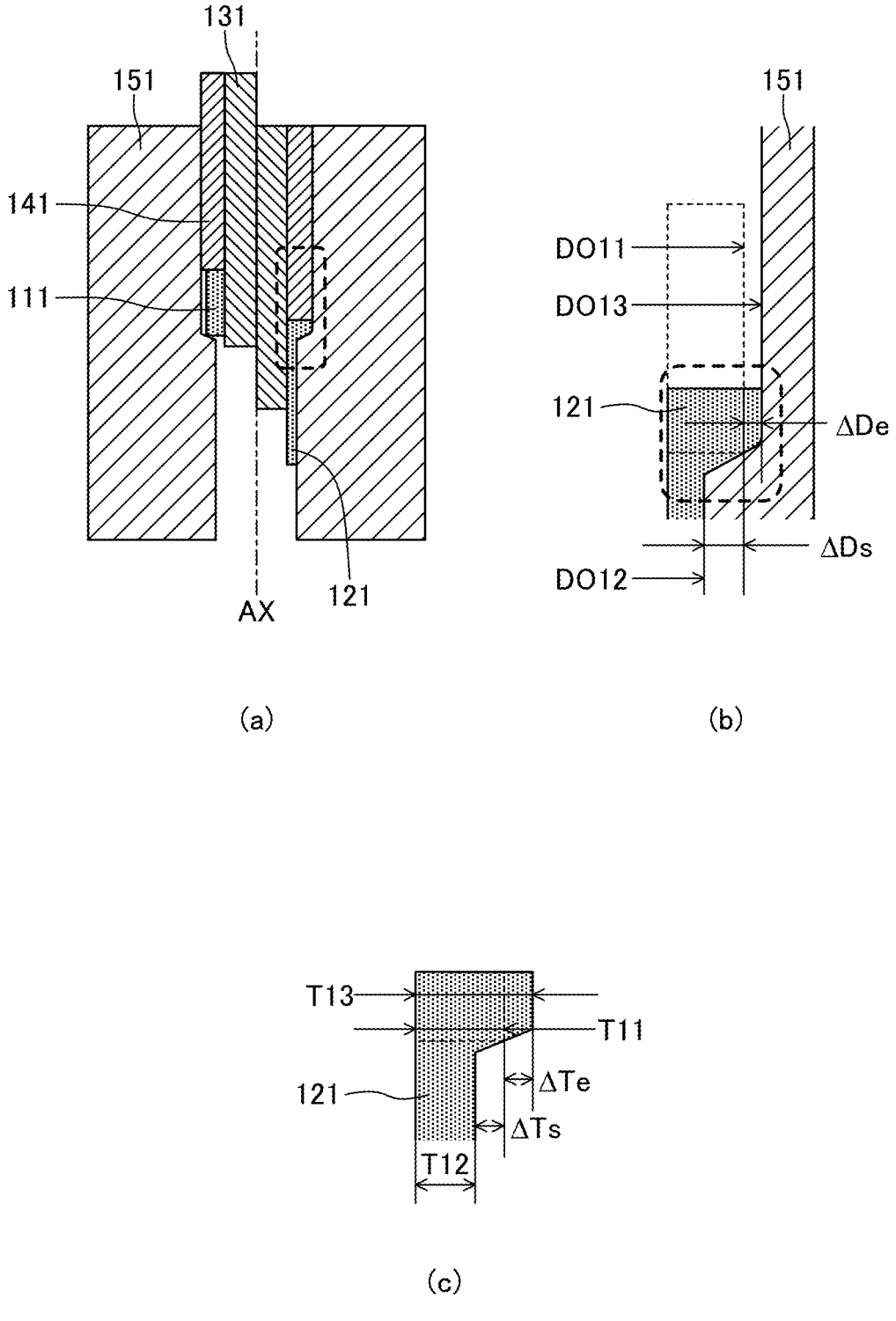
FIG. 12 is a schematic sectional view for showing another example of changes of a positional relation and shapes of a raw pipe, a mandrel, a sleeve, a container and a differential thickness pipe in association with progress of the fifth method.

FIG. 12 is a schematic sectional view for showing another example of changes of a positional relation and shapes of a raw pipe, a mandrel, a sleeve, a container and a differential thickness pipe in association with progress of the fifth method. Also in FIG. 12, in order to make the drawing brief, reference signs given to the respective parts shown in FIG. 8 and FIG. 9 are omitted. However, since the reference signs shown in FIG. 8 and FIG. 9 will be used in the following explanation regarding FIG. 12 for accuracy purposes, please refer to FIG. 8 and FIG. 9 if needed.

In the left side rather than a central axis AX in (a) of FIG. 12, a state where the raw pipe 111 is set at a predetermined position in the inside of the container hole 151*a* by execution of the eleventh process and further the mandrel 131 is inserted through the raw pipe 111 at an eleventh time point that is a time point when the twelfth process is started is shown. In the right side rather than the central axis AX in (a) of FIG. 12, a state where a space between the container 151 and the mandrel 131 has been filled up with the material constituting the raw pipe 111, the diameter expansion of the raw pipe 111 has been performed, further the tip end side of the raw pipe 111 has been pushed into the eleventh small inner diameter region RSDI11 of the container hole 151*a* through a gap between the end part on the base end side of the eleventh small inner diameter region RSDI11 of the container hole 151*a* and the mandrel 131 and diameter reduction of the tip end side of the raw pipe 111 has been performed, and a desired differential thickness pipe 121 has been molded by the base end side of the raw pipe 111 being further pressed with the sleeve 141 through execution of the twelfth process is shown.

In the example shown in FIG. 12, as compared with the example shown in FIG. 11, the push-in amount of the raw pipe 111 by the sleeve 141 is larger. As a result, the length in the axis direction of the eleventh large outer diameter region RLDO11 of the differential thickness pipe 121 is shorter than that in the example shown in FIG. 11, and the eleventh large outer diameter region RLDO in a flange-like shape is formed. Moreover, in the example shown in FIG. 12, the mandrel 131 and the sleeve 141 are formed as separate objects, but they are driven integrally by the drive mechanism which is not shown.

(b) of FIG. 12 is an enlarged view of a portion surrounded by a thick dashed line in (a) of FIG. 12. However, in (b) of FIG. 12, for the purpose of showing the change of a shape from the raw pipe 111 to the differential thickness pipe 121 intelligibly, the mandrel 131 and the sleeve 141 are omitted. As exemplified in (b) of FIG. 12, by execution of the fifth method, in the eleventh large outer diameter region RLDO11 of the differential thickness pipe 121, the eleventh outer diameter DO11 that is an outer diameter of the raw pipe 111 illustrated by a thin dashed line is expanded to the thirteenth outer diameter DO13 (diameter expansion amount=ΔDe). On the other hand, in the eleventh small outer diameter region RSDO11 of the differential thickness pipe 121, the eleventh outer diameter DO11 that is an outer diameter of the raw pipe 111 illustrated by a thin dashed line is reduced to the twelfth outer diameter DO12 (diameter reduction amount=ΔDs).

(c) of FIG. 12 is an enlarged view of a portion surrounded by a thick dashed line in (b) of FIG. 12. However, in (c) of FIG. 12, for the purpose of showing the change of a shape from the raw pipe 111 to the differential thickness pipe 121 intelligibly, not only the mandrel 131 and the sleeve 141 but also the container 151 are omitted. As exemplified in (c) of FIG. 12, by execution of the fifth method, in the eleventh large outer diameter region RLDO11 of the differential thickness pipe 121, the eleventh wall thickness T11 that is a wall thickness of the raw pipe 111 illustrated by a thin dashed line is thickened to the thirteenth wall thickness T13 (thickening amount=ΔTe). On the other hand, in the eleventh small outer diameter region RSDO11 of the differential thickness pipe 121, the eleventh wall thickness T11 that is a wall thickness of the raw pipe 111 illustrated by a thin dashed line is thinned (reduced) to the twelfth wall thickness T12 (thinning amount=ΔTs).

<Effects>

As explained above, in the differential thickness pipe molded by the fifth method, the eleventh large outer diameter region is formed by thickening from the raw pipe, and the eleventh small outer diameter region is formed by thinning from the raw pipe. Therefore, as compared with a case where a large outer diameter region is formed by holding the outer diameter of the raw pipe and a small outer diameter region is formed by largely reducing the outer diameter of the raw pipe, a larger diameter difference can be attained with smaller processing load. Furthermore, in accordance with the fifth method, since the thickness of the large outer diameter region can be enlarged, a differential thickness pipe suitable for use in which high mechanical strength is demanded in a large diameter part or the like, for example, can be molded.

In addition, as mentioned above, the length in its axial direction of the eleventh large outer diameter region and the eleventh small outer diameter region changes depending on the length in its axial direction and the diameter expansion amount in the twelfth process of the raw pipe, and the diameter reduction amount and the push-in amount of the raw pipe by the sleeve in the thirteenth process. Namely, in accordance with the fifth method, the length in its axial direction of the eleventh large outer diameter region and the eleventh small outer diameter region of the differential thickness pipe can be set up arbitrarily.

Sixth Embodiment

Next, an extrusion molding method of a differential thickness pipe according to a sixth embodiment of the present invention (which may be referred to as a "sixth method" hereafter.) will be explained.

The eleventh small outer diameter region of the differential thickness pipe molded by the above-mentioned fifth method is a region which has a straight tubular shape having the twelfth outer diameter, the twelfth inner diameter and the twelfth wall thickness. However, depending on a use of the differential thickness pipe, it may become necessary to form two parts (differential thickness part) which have different thicknesses in the small diameter part (small outer diameter region) like the differential thickness pipe molded by the above-mentioned first method.

<Configuration>

Then, the sixth method is the above-mentioned fifth method, wherein a twelfth small outer diameter region is formed at an end part on the tip end side of the differential thickness pipe and the mandrel further comprises a thirteenth small outer diameter region and a twelfth outer diameter increasing region. The twelfth small outer diameter region is a region having a sixteenth outer diameter that is an outer diameter equal to the twelfth outer diameter, an eighteenth inner diameter that is a predetermined inner diameter smaller than the twelfth inner diameter and a fourteenth wall thickness that is a predetermined wall thickness larger than the twelfth wall thickness. The thirteenth small outer diameter region is a circular columnar region formed on the tip end side rather than the basic outer diameter region of the mandrel and having an eighteenth outer diameter that is an outer diameter corresponding to the eighteenth inner diameter that is an inner diameter of the twelfth small outer diameter region of the differential thickness pipe. The twelfth outer diameter increasing region is a region formed between the thirteenth small outer diameter region and basic outer diameter region of the mandrel and having an outer diameter increasing from the eighteenth outer diameter to the fourteenth outer diameter as approaching from the thirteenth small outer diameter region to the basic outer diameter region.

Furthermore, in the sixth method, at a twelfth time point that is a time point when the thirteenth process is started, the end part on the base end side of the thirteenth small outer diameter region of the mandrel is at a position on the base end side rather than an eleventh position that is a position of the end part on the base end side of the eleventh small inner diameter region of the container hole in the pressing direction. As mentioned above, the thirteenth small outer diameter region is formed on the tip end side of the mandrel. Namely, at the twelfth time point, the end part on the base end side of the eleventh small inner diameter region of the container hole is opposed to the thirteenth small outer diameter region of the mandrel. Therefore, at the twelfth time point, the material constituting the raw pipe 111 begins to flow into the eleventh small inner diameter region RSDI11 of the container hole 151*a* through a gap between the end part on the base end side of the eleventh small inner diameter region of the container hole and the thirteenth small outer diameter region of the mandrel. Thereby, the twelfth small outer diameter region that is a region having the sixteenth outer diameter that is an outer diameter equal to the twelfth outer diameter, the eighteenth inner diameter that is a predetermined inner diameter smaller than the twelfth inner diameter and the fourteenth wall thickness that is a predetermined wall thickness larger than the twelfth wall thickness is formed in the end part on the tip end side of the differential thickness pipe.

<Sixth Method According to First Aspect>

By the way, the shape of the differential thickness pipe molded by the sixth method changes depending on the position of the mandrel at a thirteenth time point that is a time point when the thirteenth process is finished. For example, in the sixth method according to a first aspect, at the thirteenth time point, the end part on the tip end side of the basic outer diameter region of the mandrel is on the tip end side rather than the eleventh position that is a position of the end part on the base end side of the eleventh small inner diameter region of the container hole. The differential thickness pipe molded as the result of this comprises the eleventh large outer diameter region, the eleventh outer diameter increasing region, the eleventh small outer diameter region, the twelfth small outer diameter region formed on the tip end side rather than the eleventh small outer diameter region, and the eleventh inner diameter increasing region. The eleventh inner diameter increasing region is a region formed between the twelfth small outer diameter region and the eleventh small outer diameter region of the differential thickness pipe and having an inner diameter increasing from the eighteenth inner diameter to the twelfth inner diameter and a wall thickness decreasing from the fourteenth wall thickness to the twelfth wall thickness as approaching from the twelfth small outer diameter region to the eleventh small outer diameter region and an outer diameter fixed at a seventeenth outer diameter equal to the twelfth outer diameter.

Figure 13:
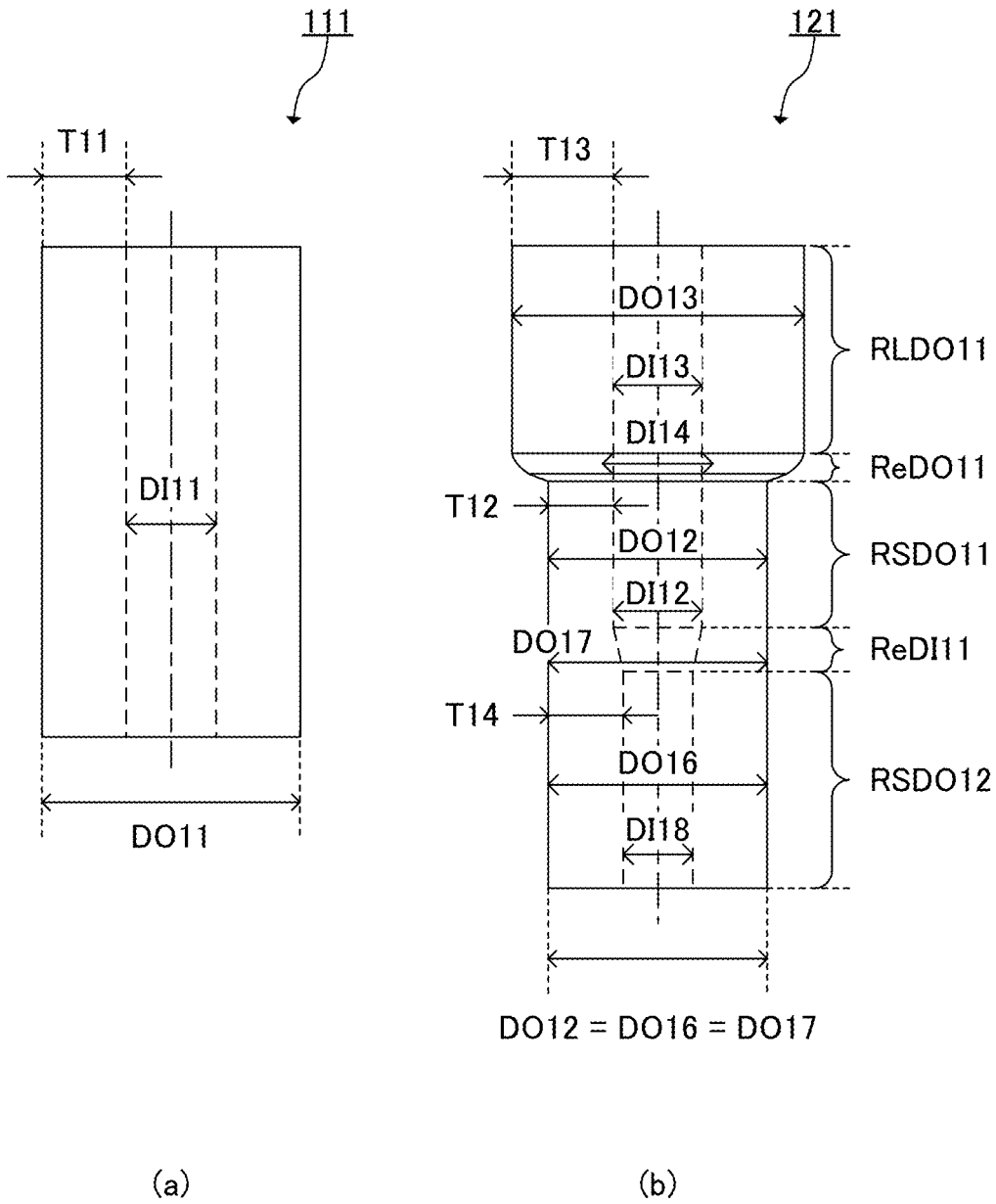
FIG. 13 is a schematic sectional view for showing an example of configurations of a raw pipe used in an aspect of an extrusion molding method according to a sixth embodiment of the present invention (sixth method) and a differential thickness pipe molded from the raw pipe.

FIG. 13 is a schematic sectional view for showing an example of configurations of a raw pipe used in the sixth method according to a first aspect and a differential thickness pipe molded from the raw pipe. The raw pipe exemplified in (a) of FIG. 13 is a circular cylindrical member which has the eleventh outer diameter DO11 that is a predetermined outer diameter, the eleventh inner diameter DI11 that is a predetermined inner diameter and the eleventh wall thickness T11 that is a predetermined wall thickness, similarly to the raw pipe 111 exemplified in (a) of FIG. 8 referred to in the explanation about the fifth method.

Next, as shown in (b) of FIG. 13, the differential thickness pipe 121 molded by the sixth method according to the first aspect has the same configuration as the differential thickness pipe 121 exemplified in (b) of FIG. 8 referred to in the explanation about the fifth method, except that the differential thickness pipe 121 further comprises the twelfth small outer diameter region RSDO12 and the eleventh inner diameter increasing region ReDI11 on the tip end side rather than the eleventh small outer diameter region RSDO11. As mentioned above, the twelfth small outer diameter region RSDO12 is a region having the sixteenth outer diameter DO16 that is an outer diameter equal to the twelfth outer diameter DO12 (DO16=DO12), the eighteenth inner diameter DI18 that is an inner diameter smaller than the twelfth inner diameter DI12 (DI18<DI12) and the fourteenth wall thickness T14 that is a wall thickness larger than the twelfth wall thickness T12 (T14>T12).

The eleventh inner diameter increasing region ReDI11 is a region formed between the twelfth small outer diameter region RSDO12 and the eleventh small outer diameter region RSDO11 of the differential thickness pipe 121 and having an inner diameter increasing from the eighteenth inner diameter DI18 to the twelfth inner diameter DI12 and a wall thickness decreasing from the fourteenth wall thickness T14 to the twelfth wall thickness T12 as approaching from the twelfth small outer diameter region RSDO12 to the eleventh small outer diameter region RSDO11 and an outer diameter fixed at the seventeenth outer diameter DO17 equal to the twelfth outer diameter DO12 (DO17=DO12).

Figure 14:
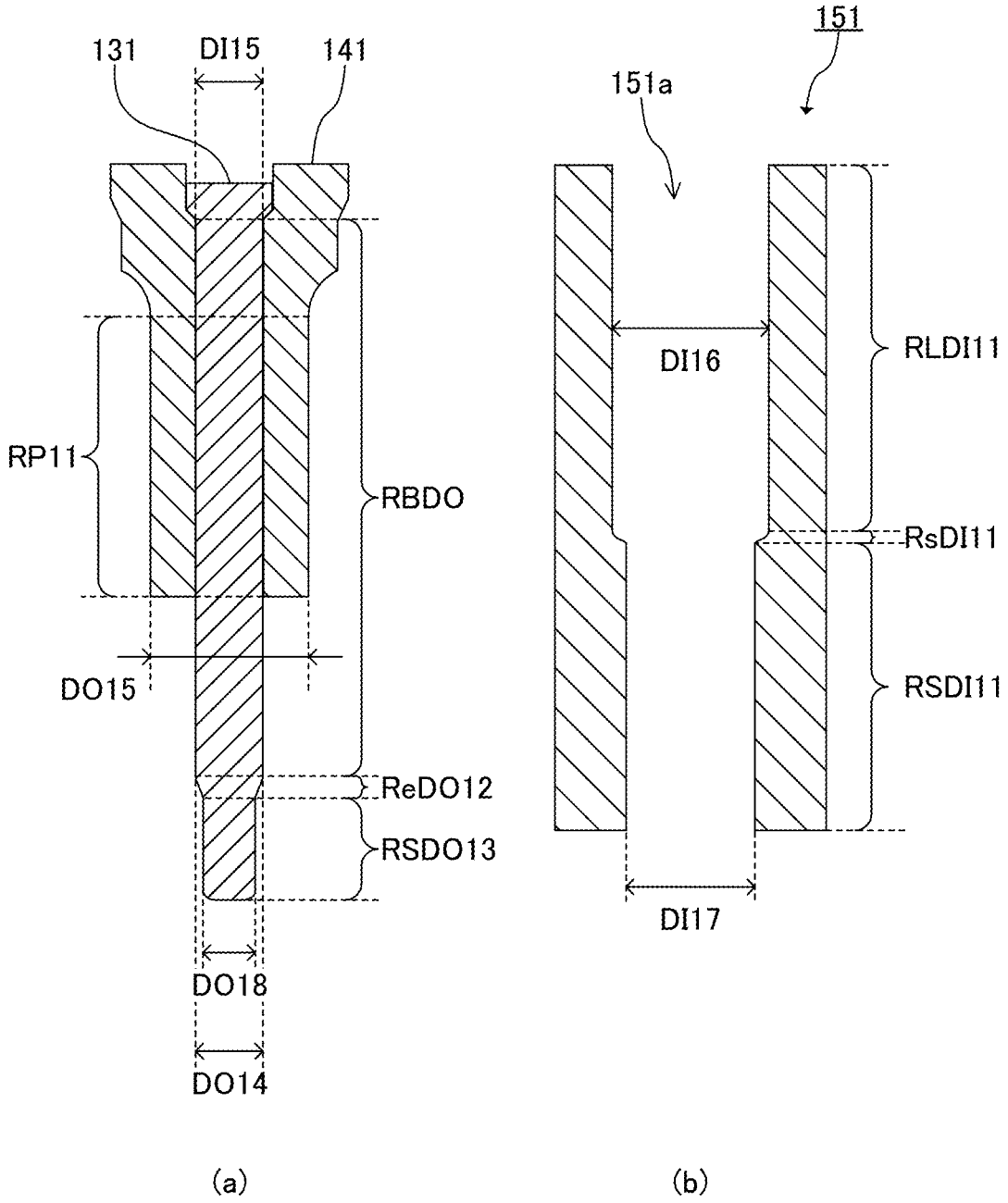
FIG. 14 is a schematic sectional view for showing an example of configurations of a mandrel, a sleeve and a container used in the sixth method according to a first aspect.

FIG. 14 is a schematic sectional view for showing an example of configurations of a mandrel, a sleeve and a container used in the sixth method according to the first aspect. (a) of FIG. 14 is a schematic sectional view for showing examples of the configurations of the mandrel and the sleeve used in the sixth method according to the first aspect. As shown in (a) of FIG. 14, the mandrel 131 used in the sixth method according to the first aspect has the same configuration as the mandrel 131 exemplified in (a) of FIG. 9 referred to in the explanation about the fifth method, except that the mandrel 131 further comprises the thirteenth small outer diameter region RSDO13 and the twelfth outer diameter increasing region ReDO12. As mentioned above, the thirteenth small outer diameter region RSDO13 is a circular columnar region formed on the tip end side rather than the basic outer diameter region RBDO of the mandrel 131 and having the eighteenth outer diameter DO18 that is an outer diameter corresponding to the eighteenth inner diameter DI18 that is an inner diameter of the twelfth small outer diameter region RSDO12 of the differential thickness pipe 121. The twelfth outer diameter increasing region ReDO12 is a region formed between the thirteenth small outer diameter region RSDO13 and basic outer diameter region RBDO of the mandrel 131 and having an outer diameter increasing from the eighteenth outer diameter DO18 to the fourteenth outer diameter DO14 as approaching from the thirteenth small outer diameter region RSDO13 to the basic outer diameter region RBDO.

The sleeve 141 used in the sixth method according to a first aspect comprises the eleventh pressing region RP11 which is a cylindrical region formed on the tip end side and having the fifteenth outer diameter DO15 that is an outer diameter equal to the thirteenth outer diameter DO13 that is an outer diameter of the eleventh large outer diameter region RLD11 of the differential thickness pipe 121 and the circular columnar inner space having the fifteenth inner diameter DI15 that is an inner diameter corresponding to the fourteenth outer diameter DO14 that is an outer diameter of the basic outer diameter region RBDO, similarly to the mandrel 131 exemplified in (a) of FIG. 9 referred to in the explanation about the fifth method.

Next, (b) of FIG. 14 is a schematic sectional view for showing an example of a configuration of the container used in the sixth method according to the first aspect. The container hole 151*a* formed in the container 151 exemplified in (b) of FIG. 14 comprises an eleventh large diameter region RLDI11, an eleventh small inner diameter region RSDI11 and an eleventh inner diameter decreasing region RsDI11, similarly to the container hole 151*a* formed in the container 151 exemplified in (b) of FIG. 9 referred to in the explanation about the fifth method. Since details of respective regions of the container hole 151*a* had been already mentioned in the explanation about the fifth method, explanation about them is omitted here.

Also in the sixth method, through execution of the eleventh to thirteenth processes similar to those in the fifth method, the above-mentioned differential thickness pipe 121 can be molded by pressing the end part on the base end side of the raw pipe 111 with the eleventh pressing region of the sleeve 141 to push the raw pipe 111 into the container hole 151*a*, in a state where the mandrel 131 is inserted through the inner space of the raw pipe 111 from the base end side (upper side in the drawing).

Figure 15:
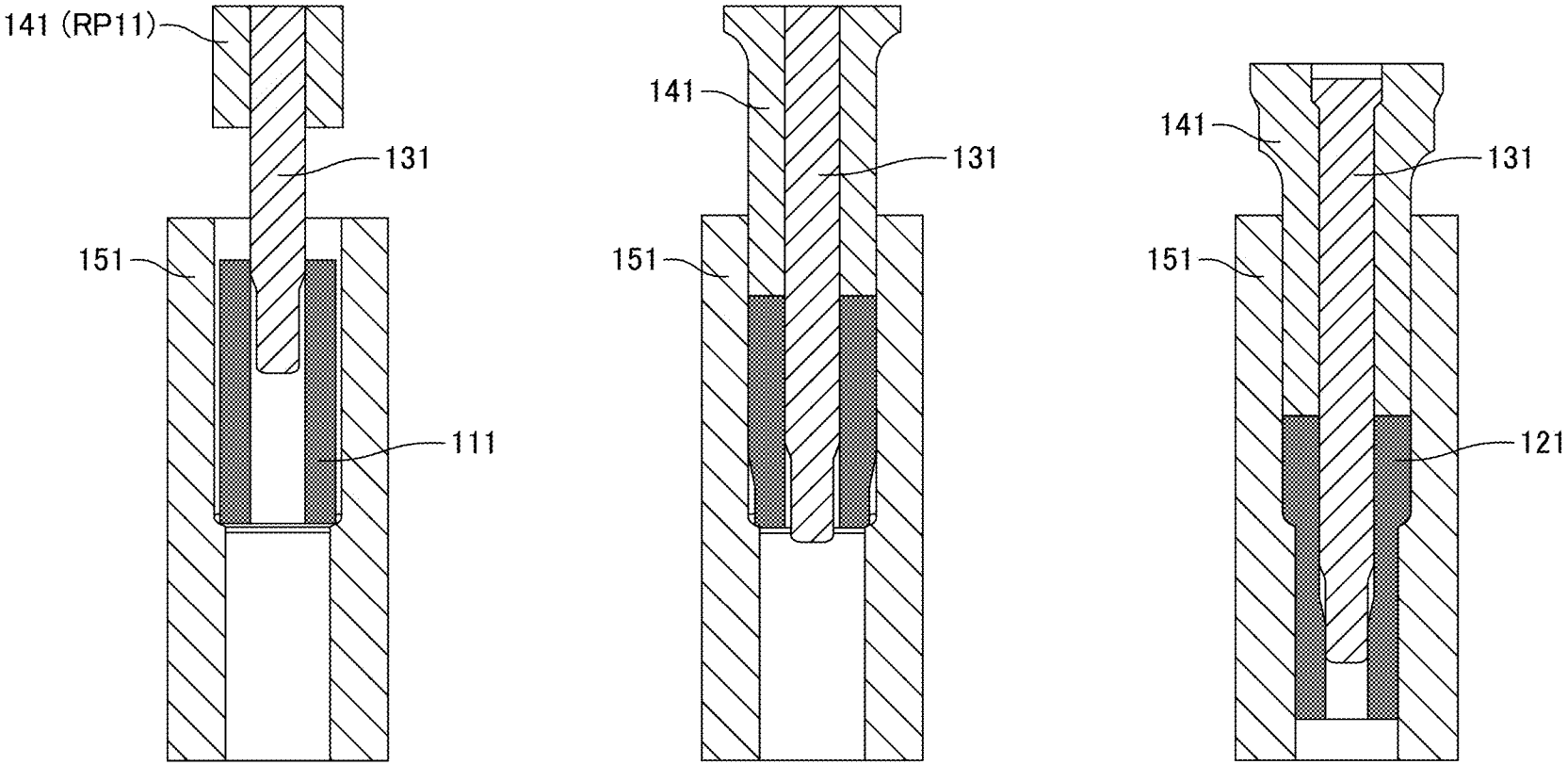
FIG. 15 is a schematic sectional view for showing an example of changes of a positional relation and shapes of a raw pipe, a mandrel, a sleeve, a container and a differential thickness pipe in association with progress of the sixth method according to the first aspect.

FIG. 15 is a schematic sectional view for showing an example of changes of a positional relation and shapes of a raw pipe, a mandrel, a sleeve, a container and a differential thickness pipe in association with progress of the sixth method according to the first aspect. In FIG. 15, in order to make the drawing brief, reference signs given to the respective parts shown in FIG. 13 and FIG. 14 are omitted. However, since the reference signs shown in FIG. 13 and FIG. 14 will be used in the following explanation regarding FIG. 15 for accuracy purposes, please refer to FIG. 13 and FIG. 14 if needed.

In (a) of FIG. 15, a state where the mandrel 131 is about to be inserted through the raw pipe 111 set at a predetermined position in the inside of the container hole 151*a* by execution of the eleventh process is shown. The outer diameter DO18 of the thirteenth small outer diameter region RSDO13 formed at the tip end of the mandrel 131 is smaller than the eleventh inner diameter DI11 of the raw pipe 111, and the inner diameter DI18 of the eleventh large inner diameter region RLDI11 of the container hole 151*a* is larger than the eleventh outer diameter DO11 of the raw pipe 111. Therefore, in the state shown in (a) of FIG. 15, there are gaps in both the outside of the outer peripheral surface and the inside of an inner peripheral surface of the raw pipe 111.

In (b) of FIG. 15, a state where the twelfth process is started, the base end side of the raw pipe 111 is pressed by the sleeve 141, and thereby the diameter expansion of the raw pipe 111 is in the process of being performed while the space between the container 151 and the mandrel 131 is being filled up with the material constituting the raw pipe 111 is shown. In the state shown in (b) of FIG. 15, the gap between the thirteenth small outer diameter region RSDO13 formed at the tip end of the mandrel 131 and the inner peripheral surface of the raw pipe 111 and the gap between the vicinity of the end part on the tip end side of the eleventh large inner diameter region RLDI11 of the container hole 151*a* and the outer peripheral surface of the raw pipe 111 have not yet been filled with the material constituting the raw pipe 111. However, by the base end side of the raw pipe 111 being further pressed with the sleeve 141, these gaps are filled up with the material constituting the raw pipe 111 to complete the diameter expansion of the raw pipe 111, and the twelfth process is finished.

In (c) of FIG. 15, a state where the tip end side of the raw pipe 111 has been pushed into the eleventh small inner diameter region RSDI11 of the container hole 151*a* through a gap between the end part on the base end side of the eleventh small inner diameter region RSDI11 of the container hole 151*a* and the mandrel 131 and the diameter reduction of the tip end side of the raw pipe 111 has been performed, by the base end side of the raw pipe 111 being further pressed with the sleeve 141 through execution of the thirteenth process is shown. As exemplified in (c) o FIG. 15, the twelfth small outer diameter region RSDO12 and eleventh inner diameter increasing region ReDI11 having a wall thickness larger than that of the eleventh small outer diameter region RSDO11 are formed in the tip end side rather than the eleventh small outer diameter region RSDO11 by the material constituting the raw pipe 111, which has flown into the eleventh small inner diameter region RSDI11 through a gap between the end part on the base end side of the eleventh small inner diameter region RSDI11 of the container hole 151*a* and the thirteenth small outer diameter region RSDO13 and twelfth outer diameter increasing region ReDO12 formed at the tip end of the mandrel 131. In other words, in the differential thickness pipe 121 molded by the sixth method according to the first aspect, the large diameter part (large outer diameter region) is subjected to diameter expansion due to thickening outward as a whole and its inner diameter does not change, the outer diameter on the base end side of the small diameter part (small outer diameter region) is subjected to diameter reduction due to thinning and its inner diameter does not change, and a part on the tip end side rather than a middle of the small diameter part is subjected to diameter reduction due to thinning and its inner diameter is subjected to diameter reduction due to thickening.

As mentioned above, the mandrel used in the sixth method comprises the thirteenth small outer diameter region that is a circular columnar region which is formed on the tip end side rather than the basic outer diameter region and is thinner than the basic outer diameter region and the twelfth outer diameter increasing region that is a region which is formed between the thirteenth small outer diameter region and the basic outer diameter region and has an outer diameter increasing as approaching from the thirteenth small outer diameter region to the basic outer diameter region. Furthermore, in the sixth method, at the twelfth time point that is a time point when the thirteenth process is started, the end part on the tip end side of the mandrel is at a position on the base end side rather than the eleventh position that is a position of the end part on the base end side of the eleventh small inner diameter region of the container hole. In addition in the sixth method according to the first aspect, at the thirteenth time point, the end part on the tip end side of the mandrel is at a position on the tip end side rather than the eleventh position that is a position of the end part on the base end side of the eleventh small inner diameter region of the container hole. Thereby, in accordance with the sixth method according to the first aspect, the differential thickness pipe with the twelfth small outer diameter region, which is thicker than the eleventh small outer diameter region, and the eleventh inner diameter increasing region formed on tits tip end can be molded.

<Modification of Sixth Method According to First Aspect>

As explained referring to FIG. 15 from FIG. 13, the mandrel used in the sixth method according to the first aspect further comprises the thirteenth small outer diameter region that is a circular columnar region which is formed on the tip end side rather than the basic outer diameter region and is thinner than the basic outer diameter region and the twelfth outer diameter increasing region that is a region which is formed between the thirteenth small outer diameter region and the basic outer diameter region and has an outer diameter increasing as approaching from the thirteenth small outer diameter region to the basic outer diameter region. As a result, the small diameter part (small outer diameter region) of the differential thickness pipe 121 exemplified in FIG. 13 and FIG. 15 has two small outer diameter regions with different inner diameters and thicknesses. However, the small diameter part (small outer diameter region) of the differential thickness pipe molded by the sixth method according to the first aspect may have three or more small outer diameter regions like the differential thickness pipe exemplified in FIG. 16, which is molded by a modification of the sixth method according to the first aspect.

Figure 16:
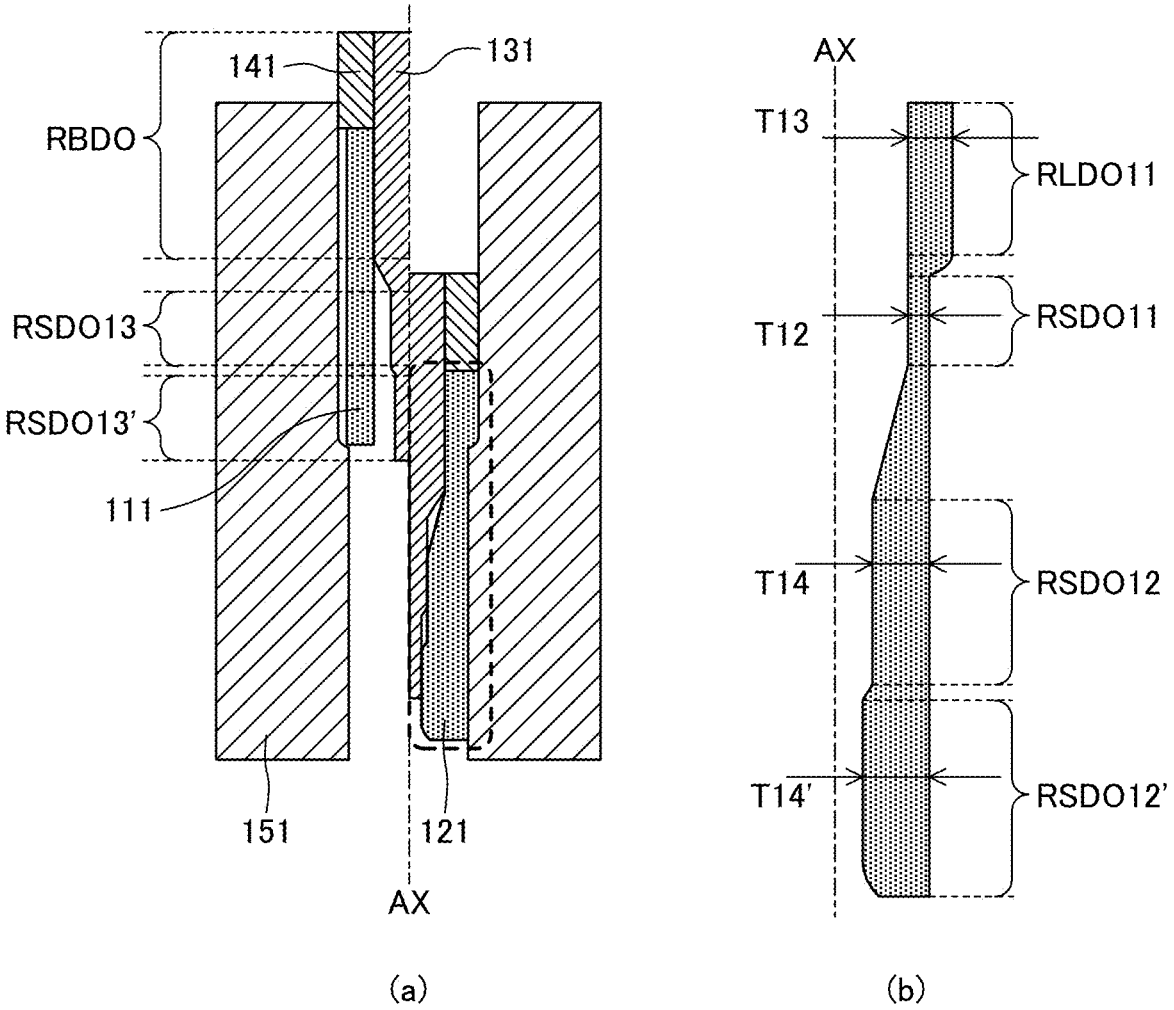
FIG. 16 is a schematic sectional view for showing an example of changes of a positional relation and shapes of a raw pipe, a mandrel, a sleeve, a container and a differential thickness pipe in association with progress of a modification of the sixth method according to the first aspect.

FIG. 16 is a schematic sectional view for showing an example of changes of a positional relation and shapes of a raw pipe, a mandrel, a sleeve, a container and a differential thickness pipe in association with progress of a modification of the sixth method according to the first aspect. Also in FIG. 16, in order to make the drawing brief, reference signs given to the respective parts shown in FIG. 13 and FIG. 14, etc., are omitted. However, since the reference signs shown in FIG. 13 and FIG. 14, etc., will be used in the following explanation regarding FIG. 16 for accuracy purposes, please refer to FIG. 13 and FIG. 14, etc., if needed.

As exemplified in the left side rather than a central axis AX in (a) of FIG. 16, in the mandrel 131 used in the above-mentioned aspect of the sixth method according to a modification, the thirteenth small outer diameter region is divided into the above-mentioned RSDO13 and an RSDO13' which is formed on the tip end side rather than the RSDO13 and is still thinner than RSDO13. When the thirteenth process is performed using the mandrel 131 which has such a configuration, in a process in which the material constituting the raw pipe 111 flows into the eleventh small inner diameter region RSDI11 of the container hole 151*a*, a part of the mandrel 131 opposing to the end part on the base end side of the eleventh small inner diameter region RSDI11 changes from the RSDO13' of the thirteenth small outer diameter region to the basic outer diameter region RBDO via the RSDO13. In association with this, since the size of the gap between the end part on the base end side of the eleventh small inner diameter region RSDI11 and the mandrel 131 is reduced gradually, the wall thickness of the small diameter part (differential thickness part whose diameter is reduced) of the differential thickness pipe 121 is also decreased gradually as approaching from the tip end side to the base end side as exemplified in the right side rather than the central axis AX of (a) of FIG. 16.

(b) of FIG. 16 is an enlarged view of the part surrounded by a thick dashed line in (a) of FIG. 16. As exemplified in (b) of FIG. 16, the small diameter part (differential thickness part whose diameter is reduced) of the differential thickness pipe 121 molded by the above-mentioned aspect of the sixth method according to the modification comprises a small diameter region RSDO12' which has the largest wall thickness T14', a twelfth small diameter region RSDO12 which has an intermediate wall thickness T14, and an eleventh small diameter region RSDO11 which has the smallest wall thickness T12, in order from the tip end side toward the base end side.

As the above, in accordance with the modification of the sixth method according to the first aspect, a multistage differential thickness pipe which has a small diameter part (differential thickness part whose diameter is reduced) divided into a plurality of small diameter regions with different wall thicknesses and inner diameters can be molded. In addition, configurations of multistage differential thickness pipes are not limited to the above. For example, depending on mechanical strength, an extent of work hardening and/or easiness of plastic flow of the material constituting the raw pipe, and/or mechanical strength of members constituting an extrusion molding apparatus and/or machining ability of an extrusion molding apparatus, etc., the outer peripheral surface of the eleventh small outer diameter region, the twelfth small outer diameter region and/or the eleventh large outer diameter region of the differential thickness pipe to be formed can be also formed to be multistage by preparing a plurality of parts which have different inner diameters in the eleventh large inner diameter region and/or eleventh small inner diameter region of the container, for example, as exemplified in FIG. 7 referred to in the explanation about the first method according to another modification.

<Sixth Method According to Second Aspect>

As mentioned above, the shape of the differential thickness pipe molded by the sixth method changes depending on the position of the mandrel at a thirteenth time point that is a time point when the thirteenth process is finished. For example, in the sixth method according to a second aspect, at the thirteenth time point, the end part on the base end side of the thirteenth small outer diameter region of a mandrel is on the base end side rather than the eleventh position that is a position of the end part on the base end side of the eleventh small inner diameter region of the container hole. The differential thickness pipe molded as the result of this comprises a twelfth small outer diameter region, an eleventh large outer diameter region, a twelfth large outer diameter region, a thirteenth outer diameter increasing region and a twelfth inner diameter increasing region.

The twelfth large outer diameter region is a region formed between the twelfth small outer diameter region and the eleventh large outer diameter region and having a nineteenth outer diameter that is an outer diameter equal to the thirteenth outer diameter, a nineteenth inner diameter that is an inner diameter equal to the eighteenth inner diameter and a fifteenth wall thickness that is a predetermined wall thickness larger than the thirteenth wall thickness. The thirteenth outer diameter increasing region is a region formed between the twelfth small outer diameter region and the twelfth large outer diameter region and having an outer diameter increasing from the sixteenth outer diameter to the nineteenth outer diameter and a wall thickness increasing from the fourteenth wall thickness to the fifteenth wall thickness as approaching from the twelfth small outer diameter region to the twelfth large outer diameter region and an inner diameter fixed at a twentieth inner diameter equal to the eighteenth inner diameter. The twelfth inner diameter increasing region is a region formed between the twelfth large outer diameter region and the eleventh large outer diameter region and having an inner diameter increasing from the nineteenth inner diameter to the thirteenth inner diameter and a wall thickness decreasing from the fifteenth wall thickness to the thirteenth wall thickness as approaching from the twelfth large outer diameter region to the eleventh large outer diameter region and an outer diameter fixed at a twentieth outer diameter equal to the thirteenth outer diameter.

Figure 17:
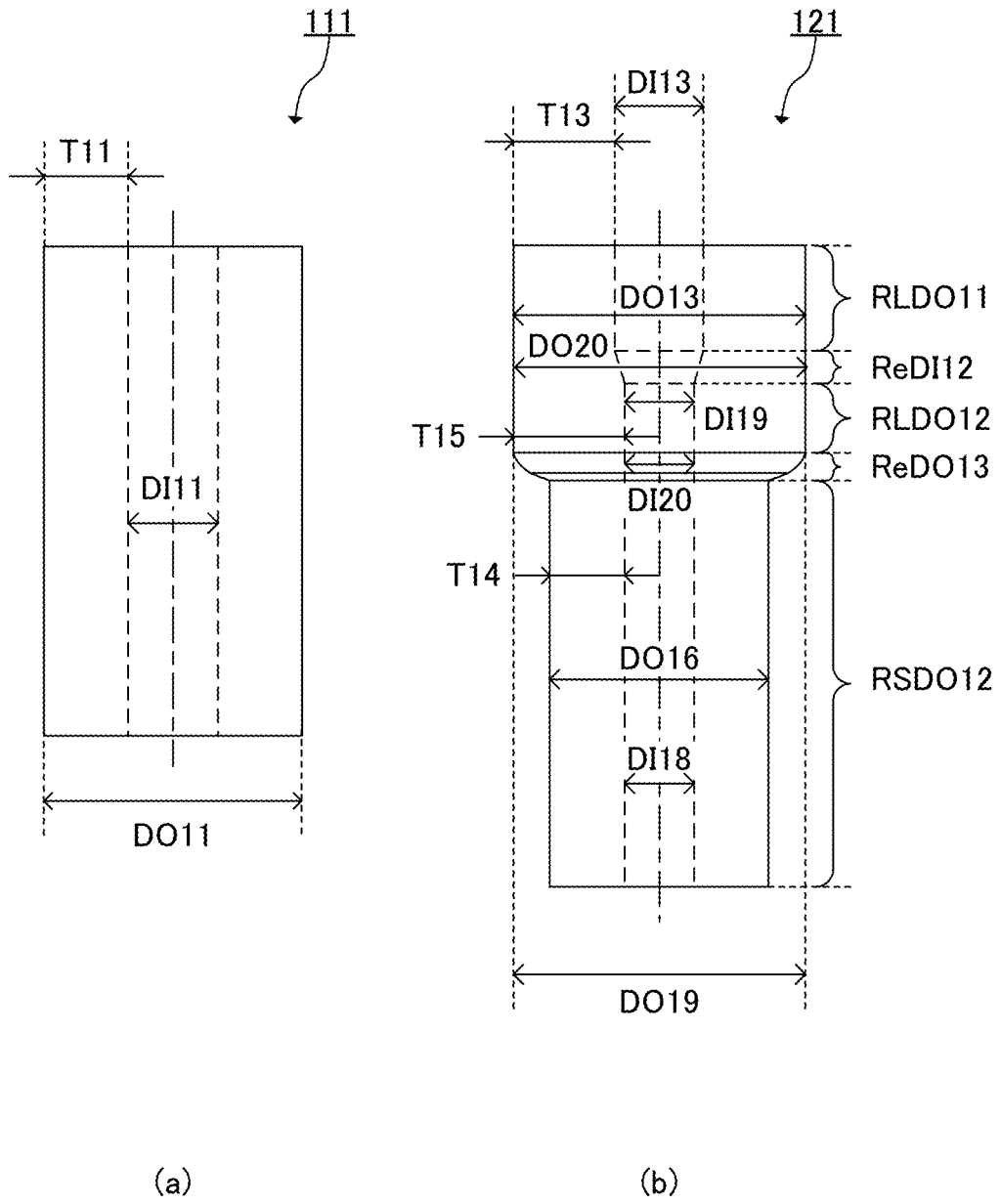
FIG. 17 is a schematic sectional view for showing an example of configurations of a raw pipe used in the sixth method according to a second aspect and a differential thickness pipe molded from the raw pipe.

FIG. 17 is a schematic sectional view for showing an example of configurations of a raw pipe used in the sixth method according to a second aspect and a differential thickness pipe molded from the raw pipe. The raw pipe 111 exemplified in (a) of FIG. 17 is a circular cylindrical member which has the eleventh outer diameter DO11 that is a predetermined outer diameter, the eleventh inner diameter DI11 that is a predetermined inner diameter and the eleventh wall thickness T11 that is a predetermined wall thickness, similarly to the raw pipe 111 exemplified in (a) of FIG. 13.

Next, as shown in (b) of FIG. 17, the differential thickness pipe 121 molded by the sixth method according to the second aspect comprises a twelfth small outer diameter region RSDO12, an eleventh large outer diameter region RLDO11, a twelfth large outer diameter region RLDO12, a thirteenth outer diameter increasing region ReDO13 and a twelfth inner diameter increasing region ReDI12.

The twelfth large outer diameter region RLDO12 is a region formed between the twelfth small outer diameter region RSDO12 and the eleventh large outer diameter region RLDO11 and having a nineteenth outer diameter DO19 that is an outer diameter equal to the thirteenth outer diameter DO13 (DO19=DO13), a nineteenth inner diameter DI19 that is an inner diameter equal to the eighteenth inner diameter DI18 (DI19=DI18) and a fifteenth wall thickness T15 that is a predetermined wall thickness larger than the thirteenth wall thickness T13 (T15>T13). The thirteenth outer diameter increasing region ReDO13 is a region formed between the twelfth small outer diameter region RSDO12 and the twelfth large outer diameter region RLDO12 and having an outer diameter increasing from the sixteenth outer diameter DO16 to the nineteenth outer diameter DO19 and a wall thickness increasing from the fourteenth wall thickness T14 to the fifteenth wall thickness T15 as approaching from the twelfth small outer diameter region RSDO12 to the twelfth large outer diameter region RLDO12 and an inner diameter fixed at a twentieth inner diameter DI20 equal to the eighteenth inner diameter DI18 (DI20=DI18). The twelfth inner diameter increasing region ReDI12 is a region formed between the twelfth large outer diameter region and the eleventh large outer diameter region RLDO11 and having an inner diameter increasing from the nineteenth inner diameter DI19 to the thirteenth inner diameter DI13 and a wall thickness decreasing from the fifteenth wall thickness T15 to the thirteenth wall thickness T13 as approaching from the twelfth large outer diameter region RLDO12 to the eleventh large outer diameter region RLDO11 and an outer diameter fixed at a twentieth outer diameter DO20 equal to the thirteenth outer diameter DO13.

Figure 18:
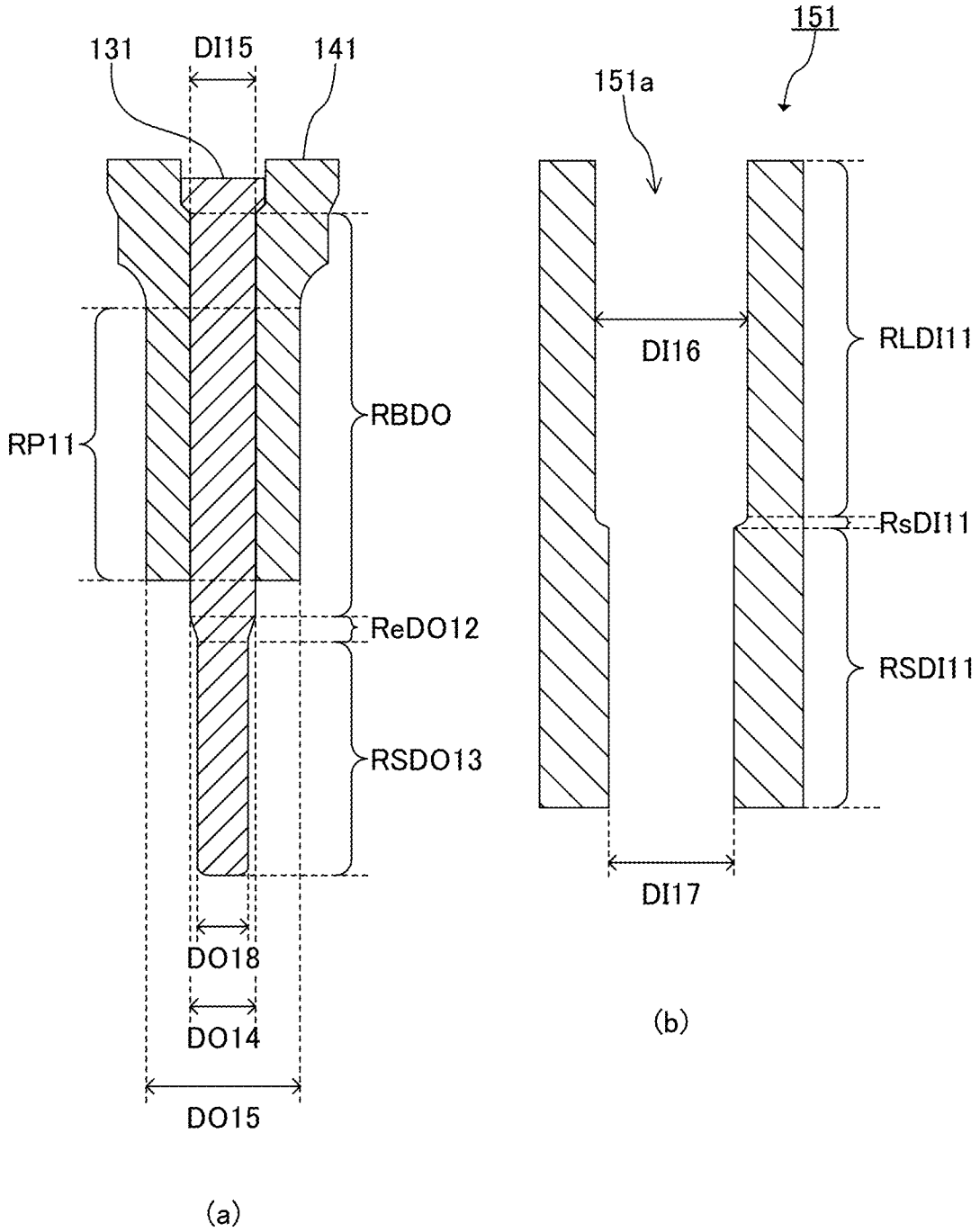
FIG. 18 is a schematic sectional view for showing an example of configurations of a mandrel, a sleeve and a container used in the sixth method according to the second aspect.

FIG. 18 is a schematic sectional view for showing an example of configurations of a mandrel, a sleeve and a container used in the sixth method according to the second aspect. (a) of FIG. 18 is a schematic sectional view for showing an example of configurations of a mandrel and a sleeve used in the sixth method according to the second aspect. As shown in (a) of FIG. 18, the mandrel 131 used in the sixth method according to the second aspect has the same configuration as the mandrel 131 exemplified in (a) of FIG. 14 referred to in the explanation about the sixth method according to the first aspect, except that a rate of the thirteenth small outer diameter region RSDO13 is high (long) and a rate of the basic outer diameter region RBDO is low (short) with respect to its whole length in the axis direction.

Similarly to the sleeve 141 exemplified in (a) of FIG. 9 and (a) of FIG. 14 referred to in the explanation about the fifth method and the sixth method according to the first aspect respectively, the sleeve 141 used in the sixth method according to the second aspect comprises the eleventh pressing region RP11 which is a cylindrical region formed on the tip end side and having the fifteenth outer diameter DO15 that is an outer diameter equal to the thirteenth outer diameter DO13 that is an outer diameter of the eleventh large outer diameter region RLD11 of the differential thickness pipe 121 and a circular columnar inner space having the fifteenth inner diameter DI15 that is an inner diameter corresponding to the fourteenth outer diameter DO14 that is an outer diameter of the basic outer diameter region RBDO.

Next, (b) of FIG. 18 is a schematic sectional view for showing an example of a configuration of a container used in the sixth method according to the second aspect. Similarly to the container hole 151*a* exemplified in (b) of FIG. 9 and (b) of FIG. 14 referred to in the explanation about the fifth method and the sixth method according to the first aspect respectively, the container hole 151*a* comprises the eleventh large diameter region RLDI11, the eleventh small inner diameter region RSDI11 and the eleventh inner diameter decreasing region RsDI11. Since details of respective regions of the container hole 151*a* had been already mentioned in the explanation about the fifth method, explanation thereof is omitted here.

Also in the sixth method according to the second aspect, by performing the eleventh to thirteenth processes which are the same as those in the fifth method, the above-mentioned differential thickness pipe 121 can be molded by pressing the end part on the base end side of the raw pipe 111 with the eleventh pressing region RP11 of the sleeve 141 to push the raw pipe 111 into the container hole 151*a*, in a state where the mandrel 131 is inserted through the inner space of the raw pipe 111 from the base end side (upper side in the drawing).

Figure 19:
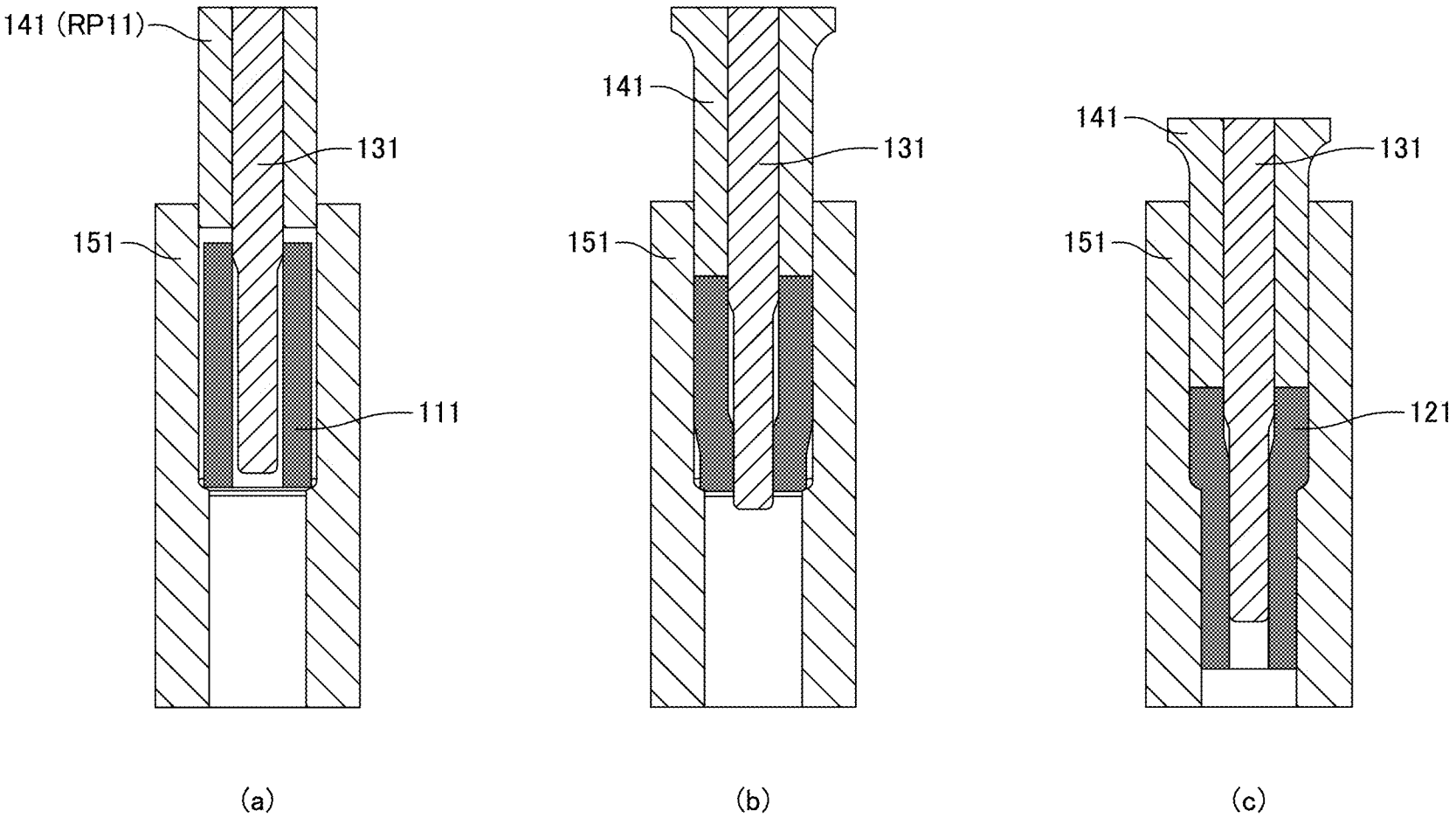
FIG. 19 is a schematic sectional view for showing an example of changes of a positional relation and shapes of a raw pipe, a mandrel, a sleeve, a container and a differential thickness pipe in association with progress of the sixth method according to the second aspect.

FIG. 19 is a schematic sectional view for showing an example of changes of a positional relation and shapes of a raw pipe, a mandrel, a sleeve, a container and a differential thickness pipe in association with progress of the sixth method according to the second aspect. In FIG. 19, in order to make the drawing brief, reference signs given to the respective parts shown in FIG. 17 and FIG. 18 are omitted. However, since the reference signs shown in FIG. 17 and FIG. 18 will be used in the following explanation regarding FIG. 19 for accuracy purposes, please refer to FIG. 17 and FIG. 18 if needed.

In (a) of FIG. 19, a state where the mandrel 131 has been inserted through the raw pipe 111 at a predetermined position in the inside of the container hole 151*a* by execution of the eleventh process is shown. The outer diameter DO18 of the thirteenth small outer diameter region RSDO13 formed at the tip end of the mandrel 131 is smaller than the eleventh inner diameter DI11 of the raw pipe 111, and the inner diameter DI18 of the eleventh large inner diameter region RLDI11 of the container hole 151*a* is larger than the eleventh outer diameter DO11 of the raw pipe 111. Therefore, in the state shown in (a) of FIG. 19, there are gaps in both the outside of the outer peripheral surface and the inside of an inner peripheral surface of the raw pipe 111.

In (b) of FIG. 19, a state where the twelfth process is started, the base end side of the raw pipe 111 is pressed by the sleeve 141, and thereby the diameter expansion of the raw pipe 111 is in the process of being performed while the space between the container 151 and the mandrel 131 is being filled up with the material constituting the raw pipe 111 is shown. In the state shown in (b) of FIG. 19, the gap between the thirteenth small outer diameter region RSDO13 formed at the tip end of the mandrel 131 and the inner peripheral surface of the raw pipe 111 and the gap between the vicinity of the end part on the tip end side of the eleventh large inner diameter region RLDI11 of the container hole 151*a* and the outer peripheral surface of the raw pipe 111 have not yet been filled with the material constituting the raw pipe 111. However, by the base end side of the raw pipe 111 being further pressed with the sleeve 141, these gaps are filled up with the material constituting the raw pipe 111 to complete the diameter expansion of the raw pipe 111, and the twelfth process is finished.

In (c) of FIG. 19, a state where execution of the thirteenth process has been completed, the tip end side of the raw pipe 111 has been pushed into the eleventh small inner diameter region RSDI11 of the container hole 151*a* through a gap between the end part on the base end side of the eleventh small inner diameter region RSDI11 of the container hole 151*a* and the mandrel 131 and the diameter reduction of the tip end side of the raw pipe 111 has been performed, by the base end side of the raw pipe 111 being further pressed with the sleeve 141 is shown. As mentioned above, in the sixth method according to the second aspect, at the thirteenth time point that is a time point when the thirteenth process is finished, the end part on the base end side of the thirteenth small outer diameter region RSDO13 of the mandrel 131 is on the base end side rather than the eleventh position that is a position of the end part on the base end side of the eleventh small inner diameter region RSDI11 of the container hole 151*a*.

Therefore, in the sixth method according to the second aspect, throughout the whole period of the thirteenth process, the material constituting the raw pipe 111 flows into the eleventh small inner diameter region RSDI11 of the container hole 151*a* through a gap between the end part on the base end side of the eleventh small inner diameter region RSDI11 of the container hole 151*a* and the thirteenth small outer diameter region RSDO13 formed at the tip end of the mandrel 131. Therefore, the small diameter part (small outer diameter region) of the differential thickness pipe 121 is constituted by only the twelfth small outer diameter region RSDO12 that is a region having the sixteenth outer diameter DO16 that is an outer diameter smaller than eleventh outer diameter DO11 that is an outer diameter of the raw pipe 111, the eighteenth inner diameter DI18 that is an inner diameter smaller than the eleventh inner diameter DI11 that is an inner diameter of the raw pipe 111 and the predetermined fourteenth wall thickness T14.

Furthermore, since the end part on the base end side of the thirteenth small outer diameter region RSDO13 of the mandrel 131 is still at a position on the base end side rather than the eleventh position that is a position of the end part on the base end side of the eleventh small inner diameter region RSDI11 of the container hole 151*a* at the thirteenth time, a part on the tip end side of the large diameter part (large outer diameter region) of the differential thickness pipe 121 is also thickened toward the inside and the twelfth large outer diameter region RLDO12 is formed. In other words, in the differential thickness pipe 121 molded by the sixth method according to the second aspect, as for the part on the base end side of the large diameter part (large outer diameter region), its outer diameter is expanded by thickening toward the outside, and its inner diameter does not change. As for a part on the tip end side rather than a middle of the large diameter part, its outer diameter is expanded by thickening toward the outside, and its inner diameter is reduced by thickening toward the inside. As for the small diameter part (small outer diameter region), as a whole, its outer diameter is reduced by thinning, and its inner diameter is reduced by thickening.

As mentioned above, the mandrel used in the sixth method comprises the thirteenth small outer diameter region that is a circular columnar region which is formed on the tip end side rather than the basic outer diameter region and is thinner than the basic outer diameter region and the twelfth outer diameter increasing region that is a region which is formed between the thirteenth small outer diameter region and the basic outer diameter region and has an outer diameter increasing as approaching from the thirteenth small outer diameter region to the basic outer diameter region. Furthermore, in the sixth method, at the twelfth time point that is a time point when the thirteenth process is started, the end part on the tip end side of the mandrel is at a position on the base end side rather than the eleventh position that is a position of the end part on the base end side of the eleventh small inner diameter region of the container hole. In addition in the sixth method according to the second aspect, at the thirteenth time point, the end part on the base end side of the thirteenth small outer diameter region of the mandrel is at a position on the base end side rather than the eleventh position that is a position of the end part on the base end side of the eleventh small inner diameter region RSD11 of the container hole 151*a*. Thereby, in accordance with the sixth method according to the second aspect, an inner diameter in a range from the middle of the large diameter part (large outer diameter region) whose outer diameter has been expanded by thickening outward to the end part on the tip end side of the small diameter part (small outer diameter region) can be reduced by thinning.

<Effects>

As mentioned above, in accordance with the sixth method, by suitably adjusting the size and/or length of the twelfth small outer diameter region that is a part formed on the tip end side of the mandrel and thinner than the inner diameter of the raw pipe as well as the position of the mandrel at the time point when the thirteenth process is finished, the range where its inner diameter is reduced by thickening in the differential thickness pipe molded by the sixth method can be changed. Therefore, structure, such as shape and distribution of wall thickness, for example, of a differential thickness pipe can be designed with high flexibility, depending on the uses.

Seventh Embodiment

Next, an extrusion molding method of a differential thickness pipe according to the seventh embodiment of the present invention (which may be referred to as a "seventh method" hereafter.) will be explained.

As mentioned above, the shapes of the raw pipe used in the extrusion molding methods of a differential thickness pipe according to the fifth and sixth embodiments of the present invention (the fifth and sixth methods) are not necessarily limited to a simple circular cylindrical shape as exemplified in FIGS. 8, 13 and 17, etc., a part having a different structure may be prepared at the end part on the tip end side and/or base end side of the raw pipe unless it hinders the execution of the fifth and sixth methods, for example. By molding a differential thickness pipe from such a raw pipe, structure prepared on the tip end side and/or base end side of the raw pipe can be incorporated into the differential thickness pipe.

<Configuration>

Then, the seventh method is a method for molding a differential thickness pipe by the fifth method or the sixth method using a raw pipe comprising a part having an outer diameter smaller than the outer diameter of the raw pipe and an inner diameter not less than the inner diameter of the raw pipe at its end part on the base end side. Specifically, the seventh method is the above-mentioned fifth method or sixth method, wherein the eleventh process to the thirteenth process are performed using the raw pipe further comprising an eleventh thin-walled part at the end part on the base end side. The eleventh thin-walled part is a part having a twenty-first outer diameter that is a predetermined outer diameter smaller than the eleventh outer diameter that is an outer diameter of the raw pipe, a twenty-first inner diameter that is a predetermined inner diameter not smaller than the eleventh inner diameter that is an inner diameter of the raw pipe, and a sixteenth wall thickness that is a predetermined wall thickness smaller than the eleventh wall thickness that is a wall thickness of the raw pipe.

The sleeve used in the seventh method comprises an accommodation part which is a space opened on an end surface on the tip end side and having a shape corresponding to the eleventh thin-walled part. In the seventh method, the eleventh thin-walled part of the raw pipe is left at the end part on the tip end side of the raw pipe by performing the twelfth process and the thirteenth process in a state where the eleventh thin-walled part is accommodated in the accommodation part. As a result, the differential thickness pipe molded by the seventh method further comprises the eleventh thin-walled part at the end part on the base end side.

Figure 20:
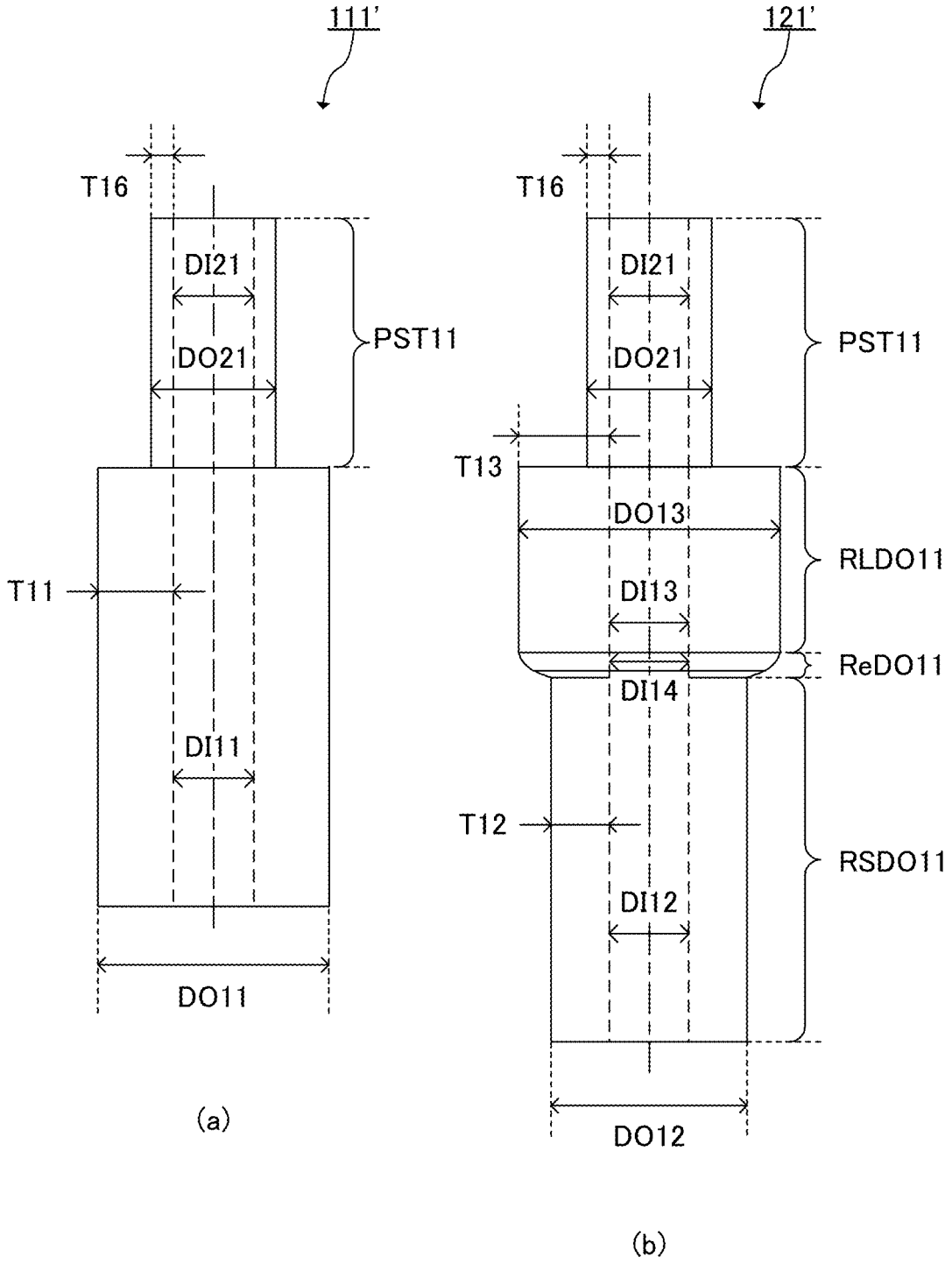
FIG. 20 is a schematic sectional view for showing an example of configurations of a raw pipe used in an extrusion molding method according to a seventh embodiment of the present invention (seventh method) and a differential thickness pipe molded from the raw pipe.

FIG. 20 is a schematic sectional view for showing an example of configurations of a raw pipe used in the seventh method and a differential thickness pipe molded from the raw pipe. The raw pipe 111' exemplified in (a) of FIG. 20 has the same configuration as the raw pipes 111 exemplified in (a) of FIG. 8, (a) of FIG. 13, and (a) of FIG. 17 referred to in the explanation about the fifth method and the sixth, except that the raw pipe 111' further comprises the eleventh thin-walled part PST11 at the end part on the base end side. The eleventh thin-walled part PST11 is a part having a twenty-first outer diameter DO21 that is an outer diameter smaller than the eleventh outer diameter DO11 that is an outer diameter of the raw pipe 111' (DO21<DO11), a twenty-first inner diameter DI21 that is an inner diameter not smaller than the eleventh inner diameter DI11 of the raw pipe 111' (DI21≥DI11. In FIG. 20, DI21=DI11) and a sixteenth wall thickness T16 that is a predetermined wall thickness smaller than the eleventh wall thickness T11 that is a wall thickness of the raw pipe 111' (T16<T11). Moreover, as shown in (b) of FIG. 20, the differential thickness pipe 121' molded by the seventh method has the same configuration as the differential thickness pipe 121 exemplified in (b) of FIG. 8 referred to in the explanation about the fifth method except that the differential thickness pipe 121' further comprises the eleventh thin-walled part PST11 at the end part on the base end side.

Figure 21:
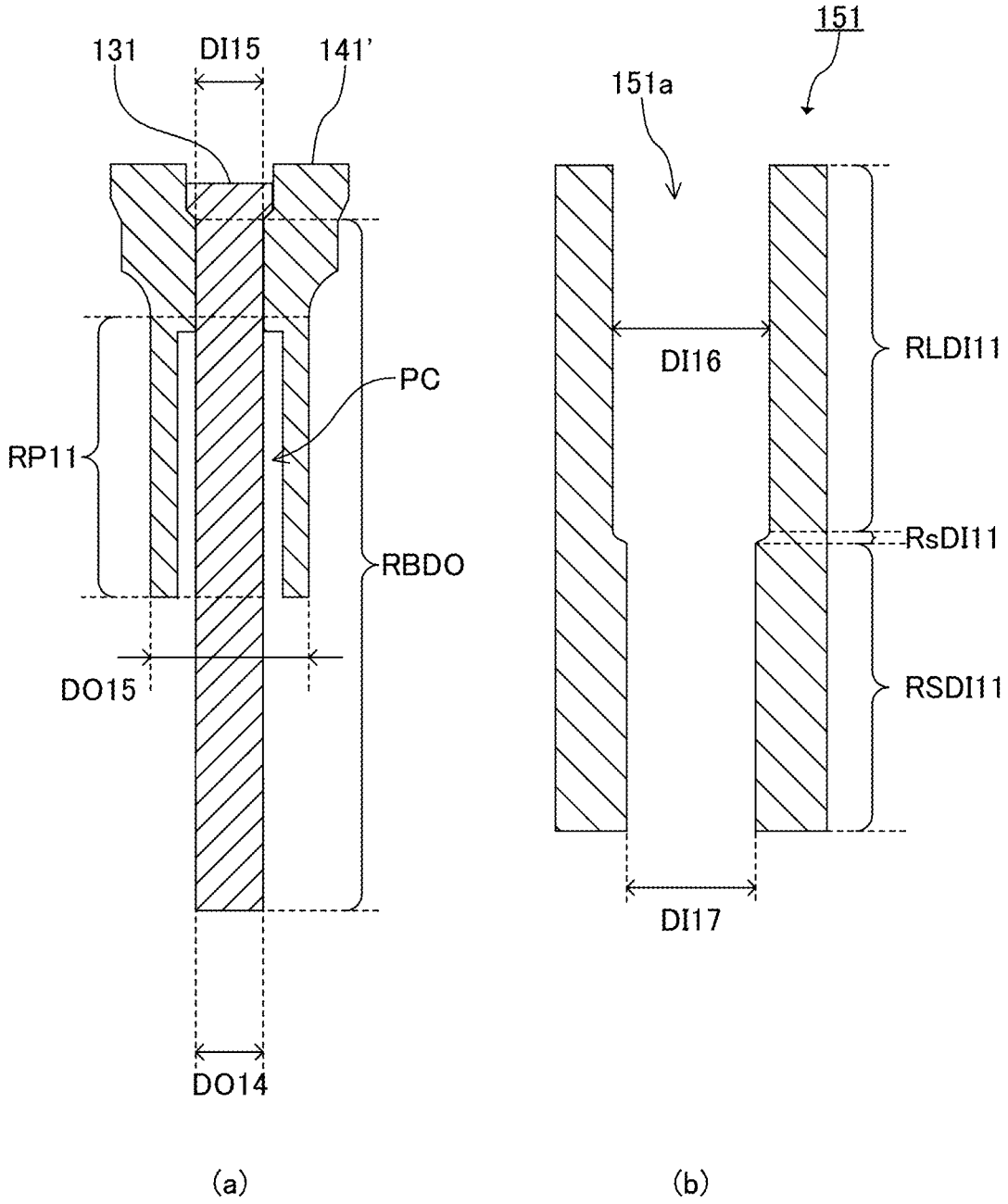
FIG. 21 is a schematic sectional view for showing an example of configurations of a mandrel, a sleeve and a container used in the seventh method.

FIG. 21 is a schematic sectional view for showing an example of configurations of a mandrel, a sleeve and a container used in the seventh method. (a) of FIG. 21 is a schematic sectional view for showing an example of the configurations of the mandrel and the sleeve used in the seventh method. As shown in (a) of FIG. 21, the mandrel 131 comprises a basic outer diameter region RBDO which is a circular columnar region formed on the tip end side and having a fourteenth outer diameter DO14 that is an outer diameter corresponding to the eleventh inner diameter DI11 which is an inner diameter of the raw pipe 111', similarly to the mandrel exemplified in (a) of FIG. 9 referred to in the explanation about the first method.

The sleeve 141' used in the seventh method has the same configuration as the sleeves 141 exemplified in (a) of FIG. 14 and (a) of FIG. 18 referred to in the explanation about the fifth method and the sixth method respectively, except that the sleeve 141' comprises an accommodation part PC which is a space opened on an end surface on the tip end side and having a shape corresponding to the eleventh thin-walled part PST11.

Next, (b) of FIG. 21 is a schematic sectional view for showing an example of the configuration of the container used in the seventh method. The container hole 151*a* formed in the container 151 exemplified in (b) of FIG. 21 comprises the eleventh large inner diameter region RLDI11, the eleventh small inner diameter region RSDI11 and the eleventh inner diameter decreasing region RsDI11, similarly to the container hole 151*a* formed in the container 151 exemplified in (b) of FIG. 9, (b) of FIG. 14 and (b) of FIG. 18 referred to in the explanation about the fifth method and the sixth method respectively. Since details of the respective regions of the container hole 151*a* had been already mentioned in the explanation about the first method, the explanation there of is omitted here.

In the seventh method, by using the above-mentioned raw pipe 111', mandrel 131, sleeve 141' and container 151 to perform the eleventh to thirteenth processes which are the same as those in the fifth method, the above-mentioned differential thickness pipe 121' can be molded by pressing the end part on the base end side of the raw pipe 111' with the eleventh pressing region RP11 of the sleeve 141' to push the raw pipe 111' into the container hole 151*a*, in a state where the mandrel 131 is inserted through the inner space of the raw pipe 111' from the base end side (upper side in the drawing). In addition, in the seventh method, the twelfth process and the thirteenth process are performed in the state where the eleventh thin-walled part PST11 of the raw pipe 111' is accommodated in the accommodation part PC of the sleeve 141', as mentioned above. Thereby, the eleventh thin-walled part PST11 is left at the end part on the tip end side of the raw pipe 111'. As a result, the differential thickness pipe 121' molded by the seventh method further comprises the eleventh thin-walled part PST11 at the end part on the base end side.

Figure 22:
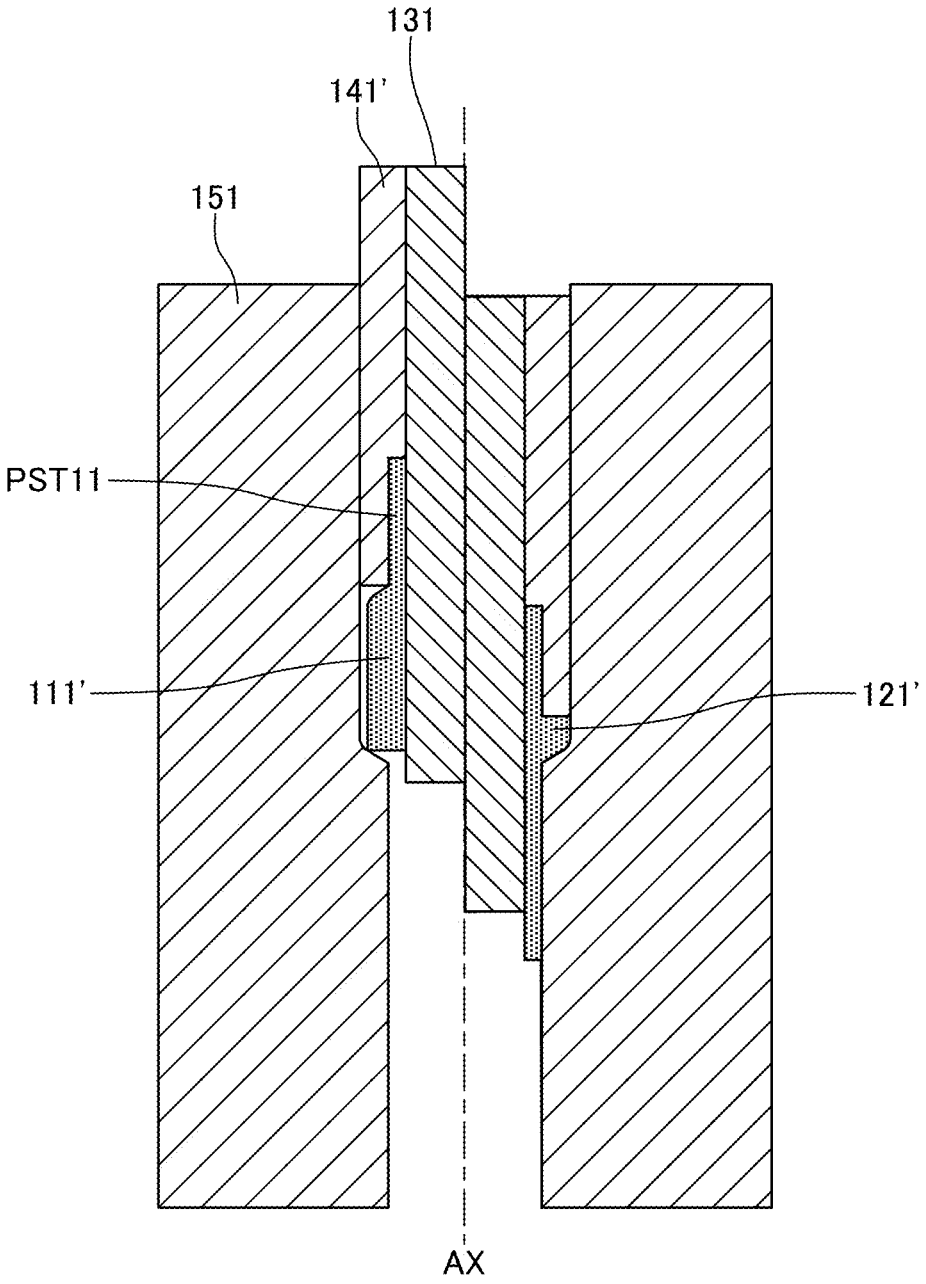
FIG. 22 is a schematic sectional view for showing an example of changes of a positional relation and shapes of a raw pipe, a mandrel, a sleeve, a container and a differential thickness pipe in association with progress of the seventh method.

FIG. 22 is a schematic sectional view for showing an example of changes of a positional relation and shapes of a raw pipe, a mandrel, a sleeve, a container and a differential thickness pipe in association with progress of the seventh method. In FIG. 22, in order to make the drawing brief, reference signs given to the respective parts shown in FIG. 20 and FIG. 21 are omitted. However, since the reference signs shown in FIG. 20 and FIG. 21 will be used in the following explanation regarding FIG. 22 for accuracy purposes, please refer to FIG. 21 and FIG. 22 if needed.

In the left side rather than a central axis AX in (a) of FIG. 22, a state where the raw pipe 111' comprising the eleventh thin-walled part PST11 at the end part on the base end side is set at a predetermined position in the inside of the container hole 151*a* by execution of the eleventh process and further the mandrel 131 is inserted through the raw pipe 111' and the eleventh thin-walled part PST11 is accommodated in the accommodation part PC of the sleeve 141' is shown. The twelfth process is started in this state, the end part on the base end side of the raw pipe 111' is pressed by the sleeve 141'. As a result, the material constituting the raw pipe 111' flows plastically into a space between the container 151 and the mandrel 131 in the eleventh large inner diameter region RLDI11 and the eleventh inner diameter decreasing region RsDI11 of the container hole 151*a* and the gap is filled up with the material. Thereby, the outer diameter of the raw pipe 111' can be expanded from the eleventh outer diameter DO11 to the thirteenth outer diameter DO13 while maintaining the inner diameter of the raw pipe 111' at the eleventh inner diameter DI11.

Then, in the thirteenth process, the base end side of the raw pipe 111' is further pressed by the sleeve 141', and the tip end side of the raw pipe 111' is pushed into the eleventh small inner diameter region RSDI11 of the container hole 151*a* to perform diameter reduction of this part. Thereby, the outer diameter of the part on the tip end side of the raw pipe 111' is reduced from the eleventh outer diameter DO11 to the twelfth outer diameter DO12. On the right side rather than the central axis AX of FIG. 22, a state where the thirteenth process is finished and the desired differential thickness pipe 121' has been molded is shown. As exemplified in FIG. 22, in accordance with the seventh method, the differential thickness pipe 121' comprising the eleventh thin-walled part PST11 at the end part on the base end side can be molded easily and certainly from the raw pipe 111' comprising the eleventh thin-walled part PST11 at the end part on the base end side.

In the differential thickness pipe 121' exemplified in FIG. 22, it appears that the wall thickness (sixteenth wall thickness T16) of the eleventh thin-walled part PST11 formed in the end part on the base end side and the wall thickness (twelfth wall thickness T12) of the eleventh small outer diameter region RSDO11 formed at the end part on the tip end side are almost equal to each other. However, the sixteenth wall thickness T16 and the twelfth wall thickness T12 may be equal to or different from each other, and both of them can be designed suitably depending on the use of the differential thickness pipe 121'. Moreover, the inner diameter of the differential thickness pipe 121' exemplified in FIG. 22 is identical with and fixed at the eleventh inner diameter DI11 that is an inner diameter of the raw pipe 111' throughout the eleventh small outer diameter region RSDO11, the eleventh outer diameter increasing region ReDO11, the eleventh large outer diameter region RLDO11 and the eleventh thin-walled part PST11. However, a plurality of regions with different inner diameters may be formed in the differential thickness pipe 121' by applying the seventh method to the above-mentioned sixth method, for example. Alternatively, as mentioned referring to FIG. 7 in the explanation about the first method according to another modification, a plurality of regions with different inner diameters may be formed in the differential thickness pipe 121' by making the large inner diameter region and/or small inner diameter region of the container hole multistage.

Figure 23:
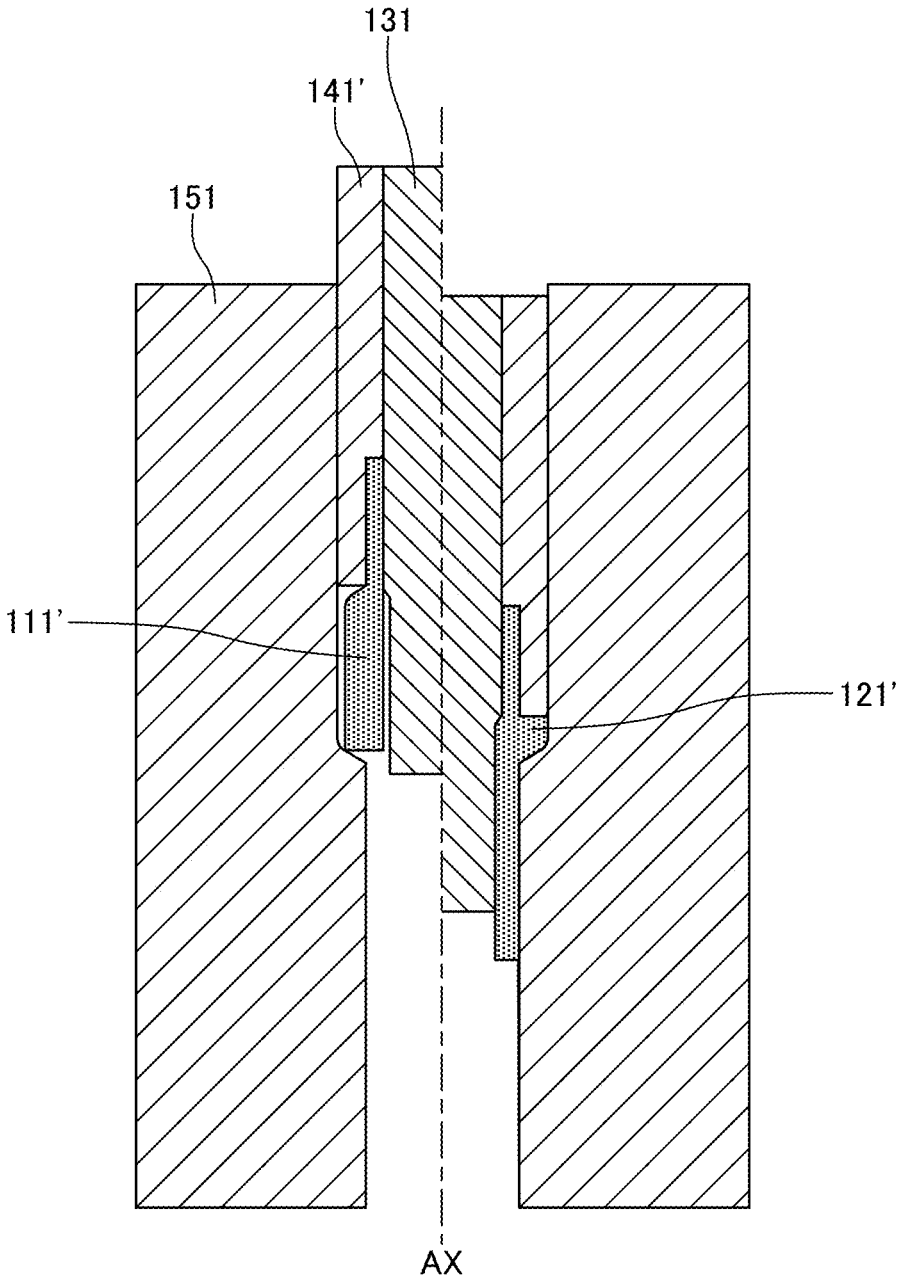
FIG. 23 is a schematic sectional view for showing an example of changes of a positional relation and shapes of a raw pipe, a mandrel, a sleeve, a container and a differential thickness pipe in association with progress of the processes when the seventh method is applied to the sixth method according to the second aspect.

FIG. 23 is a schematic sectional view for showing an example of changes of a positional relation and shapes of a raw pipe, a mandrel, a sleeve, a container and a differential thickness pipe in association with progress of the processes when the seventh method is applied to the sixth method according to the above-mentioned second aspect. Since states shown in the left and right sides rather than a central axis AX in FIG. 23 are the same as the states shown in the left and right sides rather than the central axis AX in FIG. 22 respectively, the explanation thereof is omitted here. In the differential thickness pipe 121' exemplified in FIG. 23, the inner diameter in a range from the eleventh large outer diameter region RLDO11 to the end part on the tip end side of the differential thickness pipe 121' is reduced due to thickening, by applying the seventh method to the sixth method according to the second aspect.

Figure 24:
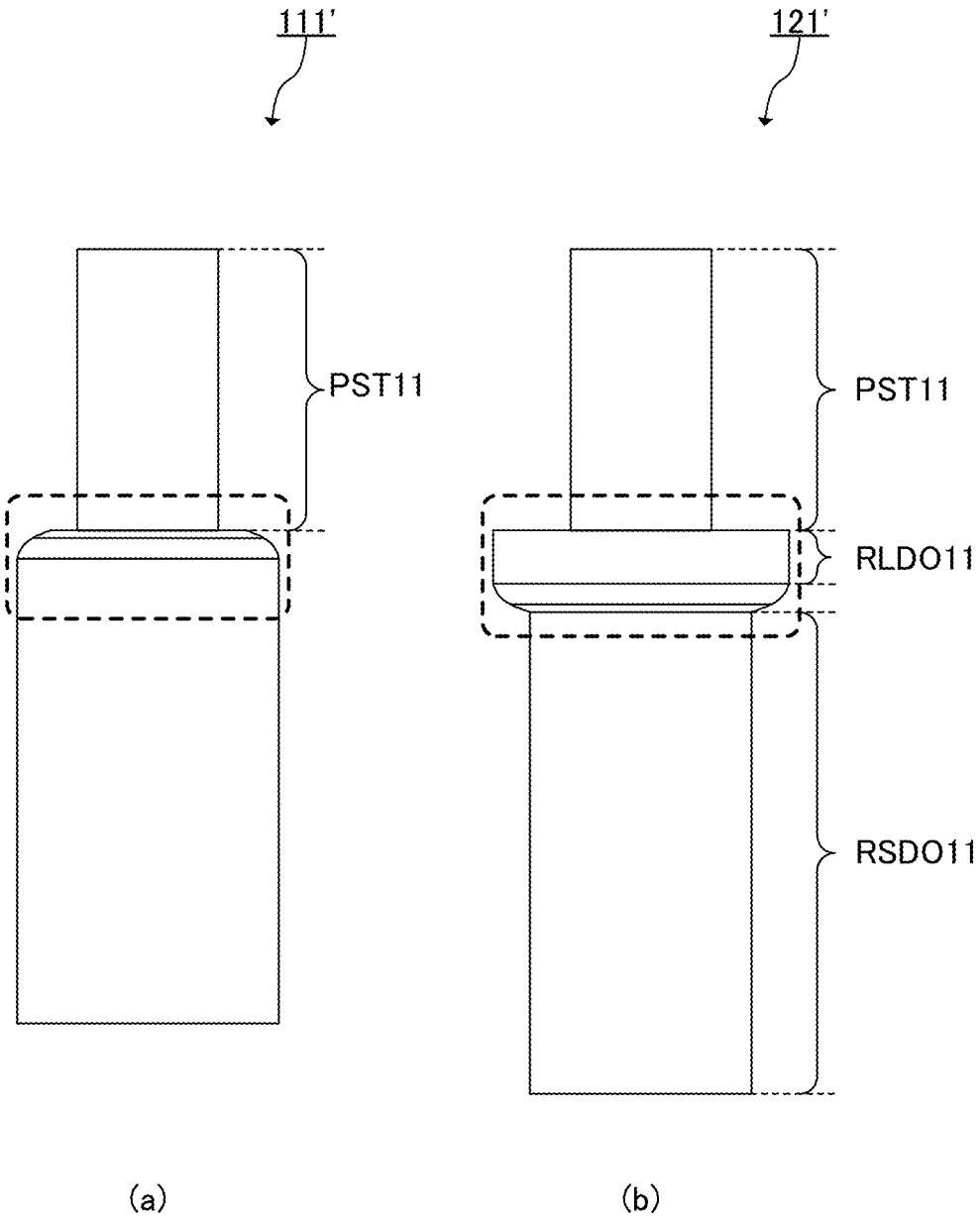
FIG. 24 is a schematic elevational view for showing appearances of the raw pipe 111' and the differential thickness pipe 121' exemplified in FIG. 23.

FIG. 24 is a schematic elevational view for showing appearances of the raw pipe 111' and the differential thickness pipe 121' exemplified in FIG. 23. By the seventh method exemplified in FIG. 23, the differential thickness pipe 121' which comprises the eleventh thin-walled part PST11 at the end part on the base end side as exemplified in (a) of FIG. 24 can be molded from the raw pipe 111' which comprises the eleventh thin-walled part PST11 at the end part on the base end side. In the differential thickness pipe 121' exemplified in FIG. 23 and FIG. 24, the length in its axis direction of the eleventh large outer diameter region RLDO11 is short, and the eleventh large outer diameter region RLDO11 has a flange-like shape.

Figure 25:
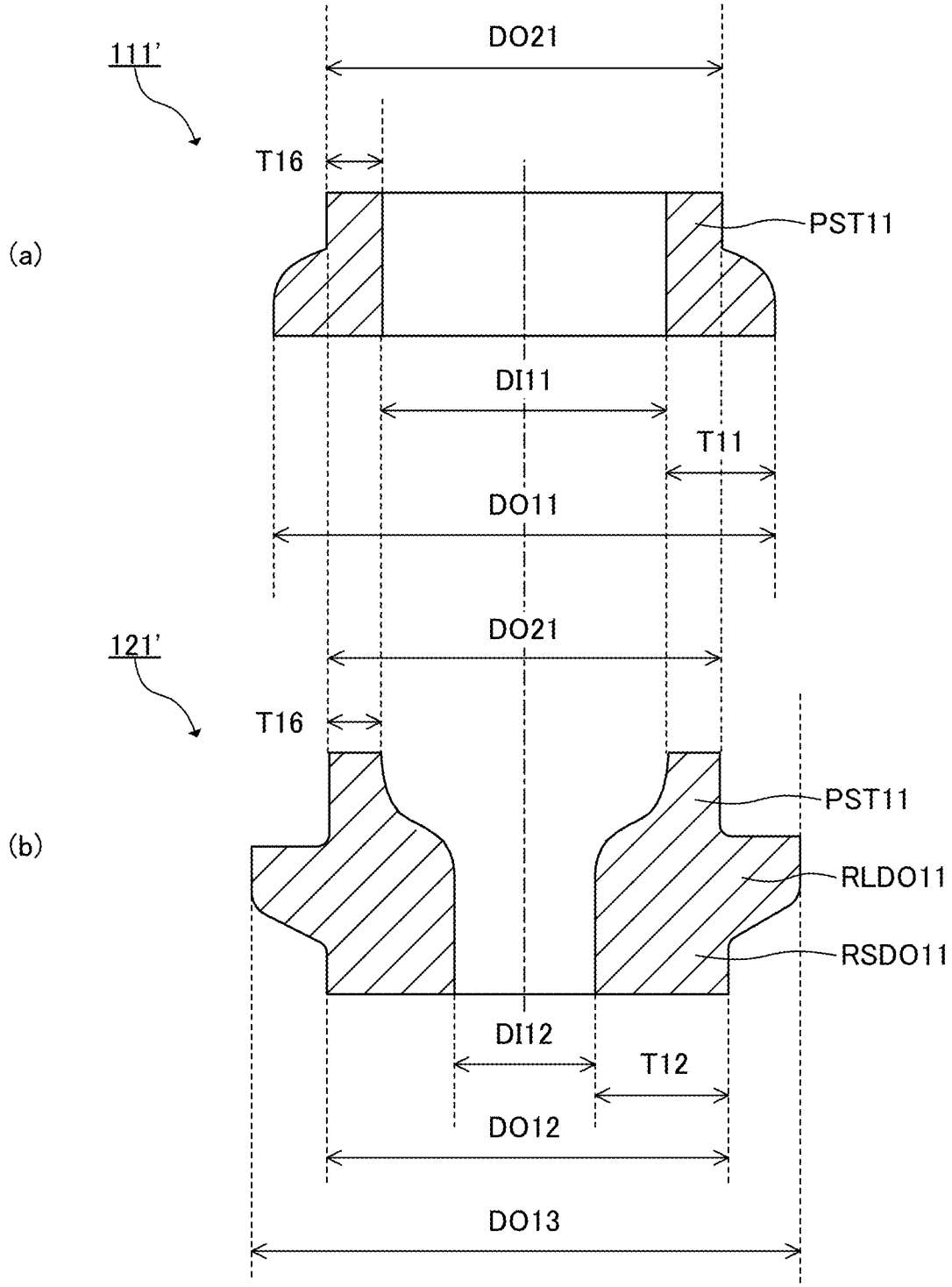
FIG. 25 is a sectional view of the part surrounded by a thick dashed line in FIG. 24.

FIG. 25 is a sectional view of the part surrounded by a thick dashed line in FIG. 24. (a) of FIG. 25 is a sectional view of the raw pipe 111' exemplified in (a) of FIG. 24, and (b) of FIG. 25 is a sectional view of the raw pipe 111' exemplified in (b) of FIG. 24. As mentioned above, in the seventh method, the twelfth process and the thirteenth process are performed in the state where the eleventh thin-walled part PST11 of the raw pipe 111' is accommodated in the accommodation part PC of the sleeve 141'. As a result, also in the differential thickness pipe 121', the eleventh thin-walled part PST11 is maintained at the end part on the base end side.

As mentioned above, in the example shown in FIG. 23, by applying the seventh method to the sixth method according to the second aspect, the inner diameter in the range from the eleventh large outer diameter region RLDO11 to the end part on the tip end side of the differential thickness pipe 121' is reduced due to thickening. Therefore, as exemplified in (b) of FIG. 25, in the eleventh large outer diameter region RLDO11 of the differential thickness pipe 121', the outer diameter is expanded by the thickening toward the outside, the inner diameter is reduced by the thickening toward the inside, and the wall thickness is largely increased. Moreover, in the eleventh small outer diameter region RSDO11 located in the tip end side rather than the eleventh large outer diameter region RLDO11 of the differential thickness pipe 121', the outer diameter is reduced by extrusion processing performed in the third process, the inner diameter is reduced by the thickening toward the inside, and the wall thickness becomes has thicker than that of the raw pipe 111'. Thus, in accordance with the molding method of a differential thickness pipe according to the present invention including the fifth to seventh methods, differential thickness pipes with various configurations can be molded.

<Effects>

As mentioned above, in the seventh method, the eleventh to thirteenth processes are performed using the raw pipe further comprising the eleventh thin-walled part that is a part having the twenty-first outer diameter that is a predetermined outer diameter smaller than the eleventh outer diameter that is an outer diameter of the raw pipe, the twenty-first inner diameter that is a predetermined inner diameter not smaller than the eleventh inner diameter that is an inner diameter of the raw pipe and the sixteenth wall thickness that is a predetermined wall thickness smaller than the eleventh wall thickness that is a wall thickness of the raw pipe. The sleeve used in the seventh method comprises the accommodation part which is a space opened on the end surface on the tip end side and having a shape corresponding to the eleventh thin-walled part. Therefore, in the seventh method, by performing the twelfth and thirteenth processes in a state where the eleventh thin-walled part of the raw pipe is accommodated in the accommodation part of the sleeve, the eleventh thin-walled part is left at the end part on the base end side of the raw pipe. As a result, in accordance with the seventh method, the differential thickness pipe which further comprises the eleventh thin-walled part at the end part on the base end side can be molded easily and certainly.

Eighth Embodiment

Next, an extrusion molding method of a differential thickness pipe according to an eighth embodiment of the present invention (which may be referred to as an "eighth method" hereafter.) will be explained.

As mentioned above, the shapes of the raw pipe used in the extrusion molding methods of a differential thickness pipe according to the fifth and sixth embodiments of the present invention (the fifth and sixth methods) are not necessarily limited to a simple circular cylindrical shape as exemplified in FIGS. 8, 13 and 17, etc., a part having a different structure may be prepared at the end part on the tip end side and/or base end side of the raw pipe unless it hinders the execution of the fifth and sixth methods.

Furthermore, as mentioned above, the shapes of the raw pipe used in the extrusion molding methods of a differential thickness pipe according to the first embodiment of the present invention (the first method) are not necessarily limited to a simple circular cylindrical shape as exemplified in FIG. 2, a part having a different structure may be prepared at the end part on the tip end side of the raw pipe unless it hinders the execution of the first method, for example. By molding a differential thickness pipe from such a raw pipe, structure prepared on the tip end side and/or base end side of the raw pipe can be incorporated into the differential thickness pipe.

<Configuration>

Then, the eighth method is a method for molding a differential thickness pipe by either one of the first, second and fifth to seventh methods, using a raw pipe comprising a part having an outer diameter smaller than the smallest inner diameter in the container hole and an inner diameter not smaller than the inner diameter of a raw pipe. Specifically, the eighth method is the above-mentioned first or second method, wherein the first process to the third process are performed using the raw pipe further comprising a twelfth thin-walled part at the end part on the tip end side. The twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the first inner diameter that is an inner diameter of the raw pipe and a seventeenth wall thickness that is a predetermined wall thickness smaller than the first wall thickness that is a wall thickness of the raw pipe. Alternatively, the eighth method is one of the above-mentioned fifth to seventh methods, wherein the eleventh process to the thirteenth process are performed using the raw pipe further comprising a twelfth thin-walled part at the end part on the tip end side. The twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the eleventh inner diameter that is an inner diameter of the raw pipe and a seventeenth wall thickness that is a predetermined wall thickness smaller than the eleventh wall thickness that is a wall thickness of the raw pipe.

In the eighth method, in a case where the twelfth thin-walled part which the raw pipe comprises at the end part on its tip end side satisfies the above-mentioned requirements, the differential thickness pipe which further comprise the twelfth thin-walled part at the end part on the tip end side can be molded by performing the first to third processes or the eleventh to thirteenth processes using the raw pipe without requiring particular configuration change in the mandrel, sleeve and container.

Figure 26:
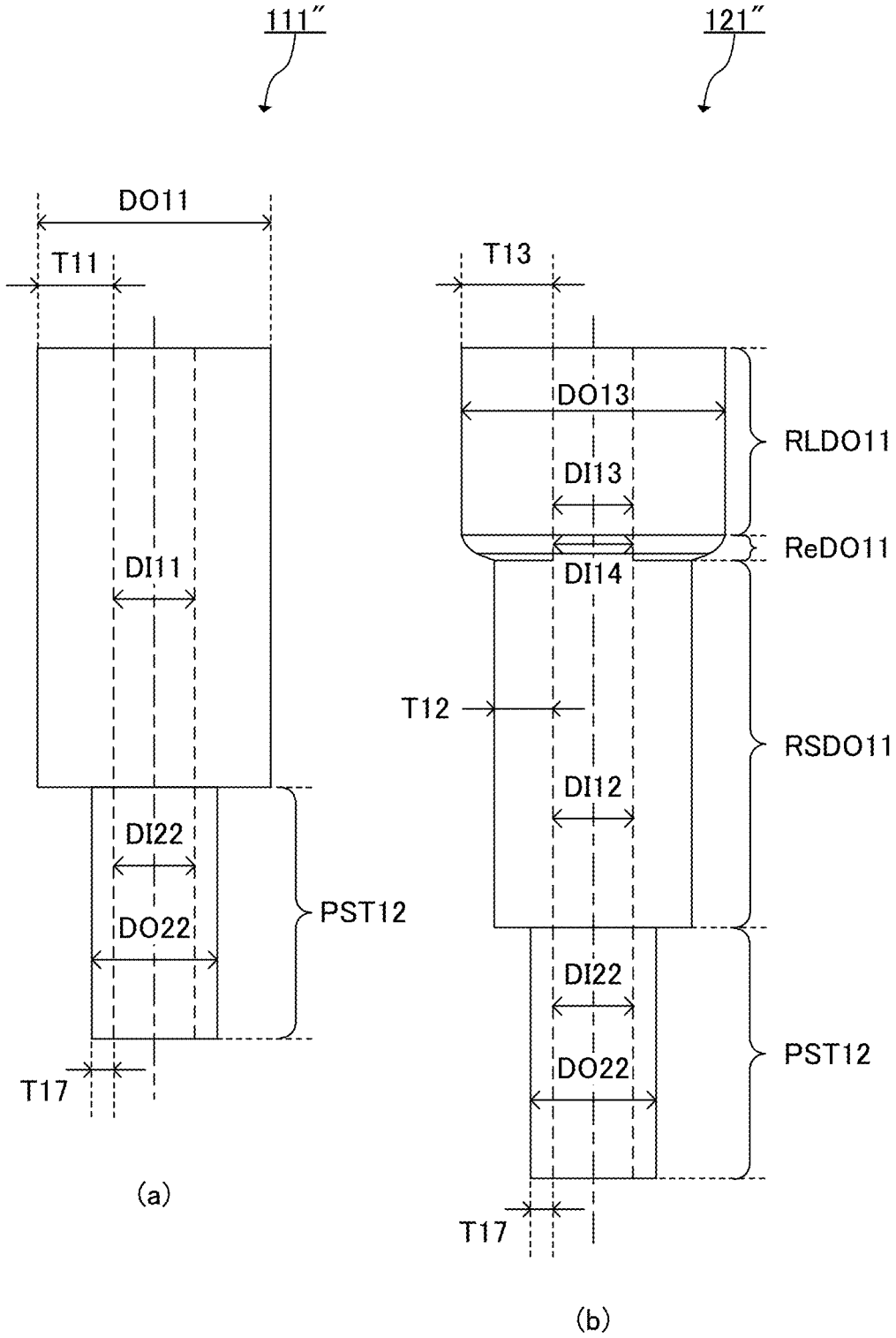
FIG. 26 is a schematic sectional view for showing an example of a configurations of a raw pipe used in an extrusion molding method according to an eighth embodiment of the present invention (eighth method) and a differential thickness pipe molded from the raw pipe.

FIG. 26 is a schematic sectional view for showing an example of a configurations of a raw pipe used in the eighth method according to the above-mentioned fifth method and a differential thickness pipe molded from the raw pipe. The raw pipe 111" exemplified in (a) of FIG. 26 as the same configuration as the raw pipes 111 exemplified in (a) of FIG. 8, (a) of FIG. 13 and (a) of FIG. 17, except that the raw pipe 111" further comprises the twelfth thin-walled part PST12 at the end part on the tip end side. The twelfth thin-walled part PST12 is a part having a twenty-second outer diameter DO22 that is a predetermined outer diameter not larger than an outer diameter corresponding to the smallest inner diameter (for example, the seventeenth inner diameter DI17) in the container hole 151*a* (DO22≤DI17), a twenty-second inner diameter DI22 that is a predetermined inner diameter not smaller than the eleventh inner diameter DI11 that is an inner diameter of the raw pipe 111" (DI22≥DI11. In FIG. 26, DI22=DI11) and a seventeenth wall thickness T17 that is a predetermined wall thickness smaller than the eleventh wall thickness T11 that is a wall thickness of the raw pipe 111" (T17<T11). Moreover, as shown in (b) of FIG. 26, the differential thickness pipe 121" molded by the eighth method has the same configuration as the differential thickness pipe 121 exemplified in (b) of FIG. 8 referred to in the explanation about the fifth method, except that the differential thickness pipe 121" further comprises the twelfth thin-walled part PST12 at the end part on the tip end side.

On the other hand, as for the mandrel, sleeve and container, they can be used without requiring particular configuration change in the eighth method using the raw pipe 111" having a configuration as mentioned above. Namely, in the eighth method, the mandrel 131, the sleeve 141 and the container 151 exemplified in FIG. 9 referred to in the explanation about the fifth method, for example, can be used. Therefore, explanation about the mandrel, sleeve, and container used in the eighth method is omitted here.

In the eighth method, by using the above-mentioned raw pipe 111", mandrel 131, sleeve 141 and container 151 to perform the eleventh to thirteenth processes which are the same as those in the fifth method, the above-mentioned differential thickness pipe 121" can be molded by pressing the end part on the base end side of the raw pipe 111" with the eleventh pressing region RP11 of the sleeve 141 to push the raw pipe 111" into the container hole 151*a*, in a state where the mandrel 131 is inserted through the inner space of the raw pipe 111" from the base end side (upper side in the drawing). Namely, the differential thickness pipe 121" molded by the eighth method further comprises the twelfth thin-walled part PST12 at the end part on the tip end side.

Figure 27:
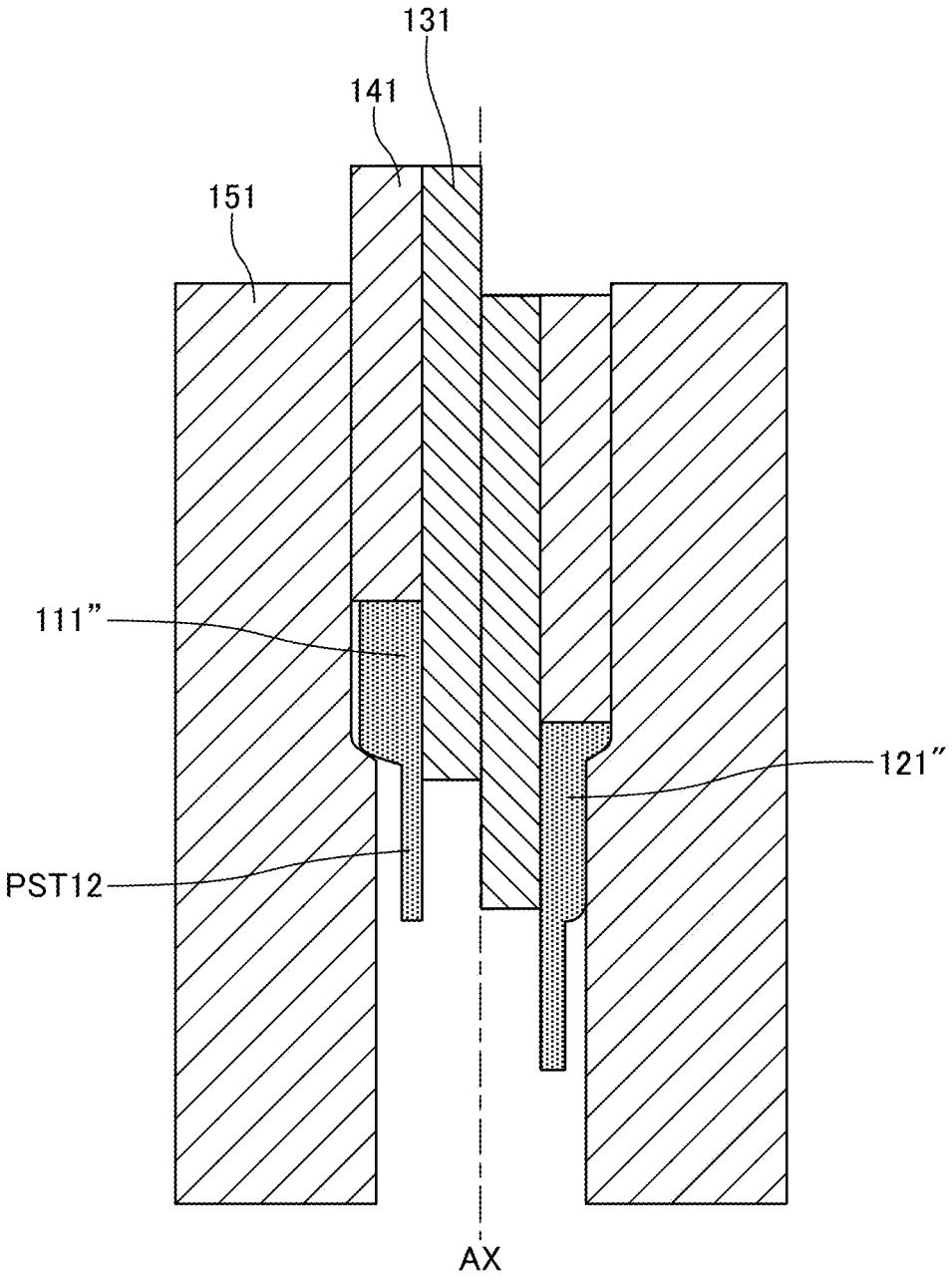
FIG. 27 is a schematic sectional view for showing an example of changes of a positional relation and shapes of a raw pipe, a mandrel, a sleeve, a container and a differential thickness pipe in association with progress of the eighth method.

FIG. 27 is a schematic sectional view for showing an example of changes of a positional relation and shapes of a raw pipe, a mandrel, a sleeve, a container and a differential thickness pipe in association with progress of the eighth method. In FIG. 27, in order to make the drawing brief, reference signs given to the respective parts shown in FIG. 26 and FIG. 9, etc., are omitted. However, since the reference signs shown in FIG. 26 and FIG. 9, etc., will be used in the following explanation regarding FIG. 27 for accuracy purposes, please refer to FIG. 26 and FIG. 9, etc., if needed.

In the left side rather than a central axis AX in (a) of FIG. 27, a state where the raw pipe 111" comprising the twelfth thin-walled part PST12 at the end part on the tip end side is set at a predetermined position in the inside of the container hole 151*a* by execution of the eleventh process and further the mandrel 131 is inserted through the raw pipe 111". The twelfth process is started in this state, the end part on the base end side of the raw pipe 111" is pressed by the sleeve 141. As a result, the material constituting the raw pipe 111" flows plastically into a space between the container 151 and the mandrel 131 in the eleventh large inner diameter region RLDI11 and the eleventh inner diameter decreasing region RsDI11 of the container hole 151*a* and the gap is filled up with the material. Thereby, the outer diameter of the raw pipe 111" can be expanded from the eleventh outer diameter DO11 to the thirteenth outer diameter DO13 while maintaining the inner diameter of the raw pipe 111" at the eleventh inner diameter DI11.

Then, in the thirteenth process, the base end side of the raw pipe 111" is further pressed by the sleeve 141, and the tip end side of the raw pipe 111" is pushed into the eleventh small inner diameter region RSDI11 of the container hole 151*a* to perform diameter reduction of this part. Thereby, the outer diameter of the part on the tip end side of the raw pipe 111" is reduced from the eleventh outer diameter DO11 to the twelfth outer diameter DO12. On the right side rather than the central axis AX of FIG. 27, a state where the thirteenth process is finished and the desired differential thickness pipe 121" has been molded is shown. As exemplified in FIG. 27, in accordance with the eighth method, the differential thickness pipe 121" comprising the twelfth thin-walled part PST12 at the end part on the tip end side can be molded easily and certainly from the raw pipe 111" comprising the twelfth thin-walled part PST12 at the end part on the tip end side.

In addition, the inner diameter of the differential thickness pipe 121" exemplified in FIG. 27 is identical with and fixed at the eleventh inner diameter DI11 that is an inner diameter of the raw pipe 111" throughout the twelfth thin-walled part PST12, the eleventh small outer diameter region RSDO11, the eleventh outer diameter increasing region ReDO11 and the eleventh large outer diameter region RLDO11. However, a plurality of regions with different inner diameters may be formed in the differential thickness pipe 121" by applying the eighth method to the above-mentioned sixth method, for example. Alternatively, as mentioned referring to FIG. 7 in the explanation about the first method according to another modification, a plurality of regions with different inner diameters may be formed in the differential thickness pipe 121" by making the large inner diameter region and/or small inner diameter region of the container hole multistage.

<Effects>

As mentioned above, in the eighth method, the first to third processes or the eleventh process to the thirteenth process are performed using the raw pipe further comprising a twelfth thin-walled part at the end part on the tip end side. The twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the inner diameter of the raw pipe and a seventeenth wall thickness that is a predetermined wall thickness smaller than the wall thickness of the raw pipe. In the eighth method, in a case where the twelfth thin-walled part which the raw pipe comprises at the end part on its tip end side satisfies the above-mentioned requirements, even when the first to third processes or the eleventh process to the thirteenth process are performed using the raw pipe without particular configuration change in the mandrel, sleeve and container, the twelfth thin-walled part is left at the end part on the tip end side of the raw pipe. As a result, in accordance with the eighth method, the differential thickness pipe which further comprise the twelfth thin-walled part at the end part on the tip end side can be molded easily and certainly.

Ninth Embodiment

As mentioned at the beginning of the present specification, the present invention relates not only to an extrusion molding method of a differential thickness pipe including the fifth to eighth methods but also to an extrusion molding apparatus of a differential thickness pipe. Therefore, the extrusion molding apparatus of a differential thickness pipe according to various embodiments of the present invention will be explained below.

First, an extrusion molding apparatus of a differential thickness pipe according to a ninth embodiment of the present invention (which may be referred to as a "ninth apparatus" hereafter.) will be explained.

<Configuration>

The ninth apparatus is an extrusion molding apparatus of a differential thickness pipe comprising a mandrel that is a core bar having a predetermined shape, a sleeve that is a cylindrical member disposed coaxially with the mandrel on the outside of the mandrel, a container that is a die in which a container hole that is a penetration hole having a predetermined shape is formed, and a drive mechanism configured so as to push at least the sleeve into the container hole. The ninth apparatus is configured so as to mold a differential thickness pipe having a predetermined shape by pushing a raw pipe having a predetermined shape into the container hole using the sleeve.

Since the configurations of the raw pipe, the mandrel, the sleeve and the container have been already mentioned in detail, referring to FIG. 8 to FIG. 12 in the explanation about the fifth method, the explanation thereof is omitted here.

Furthermore, the ninth apparatus is configured so as to mold a differential thickness pipe having a predetermined shape by performing the eleventh process, the twelfth process, and the thirteenth process. Since the eleventh to thirteenth processes have been also already described in detail in the explanation about the fifth method, the explanation thereof is omitted here.

Furthermore, the ninth apparatus is configured such that, at an eleven time point that is a time point when the twelfth process is started, an end part on the tip end side of the mandrel has reached an eleven position that is the same position in the pressing direction as a position of an end part on the base end side of the eleventh small inner diameter region of the container hole or a position on the tip end side rather than the eleventh position. In addition, the ninth apparatus is configured such that, at a twelfth time point that is a time point when the thirteenth process is started, the end part on the tip end side of the mandrel has reached a twelfth position that is a position on the tip end side by a predetermined distance rather than the end part on the base end side of the eleventh small inner diameter region of the container hole or a position on the tip end side rather than the twelfth position in the pressing direction.

<Effects>

By performing the eleventh to thirteenth processes in the ninth apparatus having the configuration as mentioned above, the eleventh large outer diameter region is formed by thickening from the raw pipe, and the eleventh small outer diameter region is formed by thinning from the raw pipe. Therefore, as compared with a case where a large outer diameter region is formed by holding an outer diameter of a raw pipe and a small outer diameter region is formed by largely reducing the outer diameter of the raw pipe, a larger diameter difference can be attained with smaller processing load. Furthermore, in accordance with the ninth apparatus, since the wall thickness of the large outer diameter region can be enlarged, a differential thickness pipe suitable for use in which high mechanical strength is demanded in a large diameter part or the like, for example, can be molded.

In addition, the length in its axial direction of the eleventh large outer diameter region and the eleventh small outer diameter region changes depending on the length in its axial direction and the diameter expansion amount in the twelfth process of the raw pipe, and the diameter reduction amount and the push-in amount of the raw pipe by the sleeve in the thirteenth process. Namely, in accordance with the ninth apparatus, the length in its axial direction of the eleventh large outer diameter region and the eleventh small outer diameter region of the differential thickness pipe can be set up arbitrarily.

Tenth Embodiment

Next, an extrusion molding apparatus of a differential thickness pipe according to a tenth embodiment of the present invention (which may be referred to as a "tenth apparatus" hereafter.) will be explained.

<Configuration>

The tenth apparatus is the above-mentioned ninth apparatus configured so as to mold a differential thickness pipe which comprises a twelfth mall outer diameter region having an wall thickness larger than the wall thickness of the eleventh small outer diameter region as a result of being thickened inward. At an end part on the tip end side of the differential thickness pipe molded by the tenth apparatus, the twelfth small outer diameter region that is a region which has a sixteenth outer diameter that is an outer diameter equal to the twelfth outer diameter, an eighteenth inner diameter that is a predetermined inner diameter smaller than the twelfth inner diameter and a fourteenth wall thickness that is a predetermined wall thickness larger than the twelfth wall thickness is formed.

In order to form the twelfth small outer diameter region as mentioned above, the mandrel which the tenth apparatus comprises further comprises a thirteenth small outer diameter region and a twelfth outer diameter increasing region. The thirteenth small outer diameter region is a circular columnar region formed on the tip end side rather than the basic outer diameter region and having an eighteenth outer diameter that is an outer diameter corresponding to the eighteenth inner diameter. The twelfth outer diameter increasing region is a region formed between the thirteenth small outer diameter region and the basic outer diameter region and having an outer diameter increasing from the eighteenth outer diameter to the fourteenth outer diameter as approaching from the thirteenth small outer diameter region to the basic outer diameter region.

Furthermore, the tenth apparatus is configured such that, at the twelfth time point, an end part on the base end side of the thirteenth small outer diameter region is at a position on the base end side rather than the eleventh position.

The tenth apparatus may be configured so as to perform the above-mentioned sixth method according to the first aspect. In this case, the tenth apparatus is configured such that the end part on the tip end side of the basic outer diameter region is at a position on the tip end side rather than the eleventh position at a thirteenth time point that is a time point when the thirteenth process is finished.

The differential thickness pipe molded by performing the above-mentioned sixth method according to the first aspect in the tenth apparatus comprises the eleventh large outer diameter region, the eleventh outer diameter increasing region, the eleventh small outer diameter region, the twelfth small outer diameter region formed on the tip end side rather than the eleventh small outer diameter region, and an eleventh inner diameter increasing region. The eleventh inner diameter increasing region is a region formed between the twelfth small outer diameter region and the eleventh small outer diameter region and having an inner diameter increasing from the eighteenth inner diameter to the twelfth inner diameter and a wall thickness decreasing from the fourteenth wall thickness to the twelfth wall thickness as approaching from the twelfth small outer diameter region to the eleventh small outer diameter region and an outer diameter fixed at a seventeenth outer diameter equal to the twelfth outer diameter.

Moreover, the tenth apparatus may be configured so as to perform the above-mentioned sixth method according to the second aspect. In this case, the tenth apparatus is configured such that the end part on the base end side of the thirteenth small outer diameter region is at a position on the base end side rather than the eleventh position at the thirteenth time point that is a time point when the thirteenth process is finished.

The differential thickness pipe molded by performing the above-mentioned sixth method according to the first aspect in the tenth apparatus comprises the twelfth small outer diameter region, the eleventh large outer diameter region, a twelfth large outer diameter region, a thirteenth outer diameter increasing region and a twelfth inner diameter increasing region. The twelfth large outer diameter region is a region formed between the twelfth small outer diameter region and the eleventh large outer diameter region and having a nineteenth outer diameter that is an outer diameter equal to the thirteenth outer diameter, a nineteenth inner diameter that is an inner diameter equal to the eighteenth inner diameter and a fifteenth wall thickness that is a predetermined wall thickness larger than the thirteenth wall thickness. The thirteenth outer diameter increasing region is a region formed between the twelfth small outer diameter region and the twelfth large outer diameter region and having an outer diameter increasing from the sixteenth outer diameter to the nineteenth outer diameter and a wall thickness increasing from the fourteenth wall thickness to the fifteenth wall thickness as approaching from the twelfth small outer diameter region to the twelfth large outer diameter region and an inner diameter fixed at a twentieth inner diameter equal to the eighteenth inner diameter. The twelfth inner diameter increasing region is a region formed between the twelfth large outer diameter region and the eleventh large outer diameter region and having an inner diameter increasing from the nineteenth inner diameter of the thirteenth inner diameter and a wall thickness decreasing from the fifteenth wall thickness to the thirteenth wall thickness as approaching from the twelfth large outer diameter region to the eleventh large outer diameter region and an outer diameter fixed at a twentieth outer diameter equal to the thirteenth outer diameter.

Since the details of the sixth method performed in the tenth apparatus and the differential thickness pipe molded by performing the sixth method in the tenth apparatus had been already mentioned in the explanation about the sixth method referring to FIG. 13 to FIG. 19, explanation thereof is omitted here.

<Effects>

As mentioned above, in accordance with the tenth apparatus, by suitably adjusting the size and/or length of the twelfth small outer diameter region that is a part formed on the tip end side of the mandrel and thinner than the inner diameter of the raw pipe as well as the position of the mandrel at the time point when the thirteenth process is finished, the range where its inner diameter is reduced by thickening in the differential thickness pipe molded by the sixth method can be changed. Therefore, structure, such as shape and distribution of wall thickness, for example, of a differential thickness pipe can be designed with high flexibility, depending on the uses.

Eleventh Embodiment

Next, an extrusion molding apparatus of a differential thickness pipe according to an eleventh embodiment of the present invention (which may be referred to as an "eleventh apparatus" hereafter.) will be explained.

<Configuration>

The eleventh apparatus is the above-mentioned ninth or tenth apparatus and is configured so as to mold the differential thickness pipe which comprises an eleventh thin-walled part having a predetermined shape at the end part on the base end side from the raw pipe which comprises the eleventh thin-walled part at the end part on the base end side by performing the above-mentioned seventh method.

The tenth apparatus is the above-mentioned ninth or tenth apparatus and is configured so as to perform the eleventh process to the thirteenth process using the raw pipe further comprising the eleventh thin-walled part at the end part on the base end side. The eleventh thin-walled part is a part having a twenty-first outer diameter that is a predetermined outer diameter smaller than the eleventh outer diameter, a twenty-first inner diameter that is a predetermined inner diameter not smaller than the eleventh inner diameter and a sixteenth wall thickness that is a predetermined wall thickness smaller than the eleventh wall thickness.

The sleeve which constitutes the eleventh apparatus comprises an accommodation part which is a space opened on an end surface on the tip end side and having a shape corresponding to the eleventh thin-walled part. Furthermore, the eleventh apparatus is configured so as to perform the twelfth process and the thirteenth process in a state where the eleventh thin-walled part is accommodated in the accommodation part. Thereby, the eleventh thin-walled part is left at the end part on the base end side of the raw pipe. As a result, the differential thickness pipe molded by the eleventh apparatus further comprises the eleventh thin-walled part at the end part on the base end side.

Since the details of the seventh method performed in the eleventh apparatus and the differential thickness pipe molded by performing the seventh method in the eleventh apparatus had been already mentioned in the explanation about the seventh method referring to FIG. 20 to FIG. 25, explanation thereof is omitted here.

<Effects>

As mentioned above, in the eleventh apparatus, the eleventh to thirteenth processes are performed using the raw pipe further comprising the eleventh thin-walled part that is a part having the twenty-first outer diameter that is a predetermined outer diameter smaller than the eleventh outer diameter that is an outer diameter of the raw pipe, the twenty-first inner diameter that is a predetermined inner diameter not smaller than the eleventh inner diameter that is an inner diameter of the raw pipe and the sixteenth wall thickness that is a predetermined wall thickness smaller than the eleventh wall thickness that is a wall thickness of the raw pipe. The sleeve which constitutes the eleventh apparatus comprises the accommodation part which is a space opened on the end surface on the tip end side and having a shape corresponding to the eleventh thin-walled part. Therefore, in the eleventh apparatus, by performing the twelfth and thirteenth processes in a state where the eleventh thin-walled part of the raw pipe is accommodated in the accommodation part of the sleeve, the eleventh thin-walled part is left at the end part on the base end side of the raw pipe. As a result, in accordance with the eleventh apparatus, the differential thickness pipe which further comprises the eleventh thin-walled part at the end part on the base end side can be molded easily and certainly.

Twelfth Embodiment

Next, an extrusion molding apparatus of a differential thickness pipe according to a twelfth embodiment of the present invention (which may be referred to as a "twelfth apparatus" hereafter.) will be explained.

<Configuration>

The twelfth apparatus is either one of the above-mentioned third, fourth, ninth and tenth apparatuses and is configured so as to mold the differential thickness pipe which comprises a twelfth thin-walled part having a predetermined shape at the end part on the tip end side from the raw pipe which comprises the twelfth thin-walled part at the end part on the tip end side by performing the above-mentioned eighth method.

In the twelfth apparatus according to the above-mentioned third or fourth apparatus, the twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the first inner diameter and a seventeenth wall thickness that is a predetermined wall thickness smaller than the first wall thickness. This twelfth apparatus is configured so as to perform the first process to the third process using the raw pipe further comprising the twelfth thin-walled part at the end part on the tip end side. On the other hand, in the twelfth apparatus according to the above-mentioned ninth or tenth apparatus, the twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the eleventh inner diameter and a seventeenth wall thickness that is a predetermined wall thickness smaller than the eleventh wall thickness. This twelfth apparatus is configured so as to perform the eleventh process to the thirteenth process using the raw pipe further comprising the twelfth thin-walled part at the end part on the tip end side. Thereby, the differential thickness pipe molded by the twelfth apparatus further comprises the twelfth thin-walled part at the end part on the tip end side.

Since the details of the eighth method performed in the twelfth apparatus and the differential thickness pipe molded by performing the eighth method in the twelfth apparatus had been already mentioned in the explanation about the eighth method referring to FIG. 26 and FIG. 27, explanation thereof is omitted here.

<Effects>

As mentioned above, in the twelfth apparatus, the first to third processes or the eleventh process to the thirteenth process are performed using the raw pipe further comprising a twelfth thin-walled part at the end part on the tip end side. The twelfth thin-walled part is a part having a twenty-second outer diameter that is a predetermined outer diameter not larger than an outer diameter corresponding to the smallest inner diameter in the container hole, a twenty-second inner diameter that is a predetermined inner diameter not smaller than the inner diameter of the raw pipe and a seventeenth wall thickness that is a predetermined wall thickness smaller than the wall thickness of the raw pipe. In the twelfth apparatus, in a case where the twelfth thin-walled part which the raw pipe comprises at the end part on its tip end side satisfies the above-mentioned requirements, even when the first to third processes or the eleventh process to the thirteenth process are performed using the raw pipe without particular configuration change in the mandrel, sleeve and container, the twelfth thin-walled part is left at the end part on the tip end side of the raw pipe. As a result, in accordance with the twelfth apparatus, the differential thickness pipe which further comprise the twelfth thin-walled part at the end part on the tip end side can be molded easily and certainly.

Although some embodiments and modifications which have specific configurations have been explained, sometimes referring to accompanying drawings, as the above, for the purpose of explaining the present invention, it should not be interpreted that the scope of the present invention is limited to these exemplary embodiments and modifications, and it is needless to say that modifications can be properly added within the limits of the matter described in the claims and the specification.

REFERENCE SIGNS LIST

- 11: Raw Pipe
  - DO1: First Outer Diameter
  - DI1: First Inner Diameter
  - T1: First Wall Thickness
- 21, 21', 21": Differential Thickness Pipe
  - RSD1: First Small Diameter Region
    - DO2: Second Outer Diameter
  - DI2: Second Inner Diameter
    - T2: Second Wall Thickness
  - RSD2: Second Small Diameter Region
    - DO3: Third Outer Diameter
    - DI3: Third Inner Diameter
    - T3: Third Wall Thickness
      - PSD1, PSD2: Part (Constituting Multistage RSD2)
      - PTDI: Taper-Shaped Part (Constituting Multistage RSD2)
  - RLD: Large Diameter Region
    - DO4: Fourth Outer Diameter
    - DI4: Fourth Inner Diameter
    - T4: Fourth Wall Thickness
  - RTDI1: First Tapered Region
  - RTDI2: Second Tapered Region
- 31, 31': Mandrel
  - RSC: Small Cross Section Region
    - DO5: Fifth Outer Diameter
  - RLC: Large Cross Section Region
    - DO6: Sixth Outer Diameter
  - ReC: Cross Section Expansion Region
- 41: Sleeve
  - RP: Pressing Region
    - DO7: Seventh Outer Diameter
    - DI5: Fifth Inner Diameter
- 51, 51': Container
  - 51*a*, 51*a*': Container Hole
    - RLDI: Large Inner Diameter Region
      - DI6: Sixth Inner Diameter
    - RSDI: Small Inner Diameter Region
      - DI7: Seventh Inner Diameter
    - RsDI: Inner Diameter Decreasing Region
- 111, 111', 111": Raw Pipe DO11: Eleventh Outer Diameter
DI11: Eleventh Inner Diameter
T11: Eleventh Wall Thickness
PST11: Eleventh Thin-Walled Part
DO21: Twenty-First Outer Diameter
DI21: Twenty-First Inner Diameter
T16: Sixteenth Wall Thickness
PST12: Twelfth Thin-Walled Part
DO22: Twenty-Second Outer Diameter
DI22: Twenty-Second Inner Diameter
T17: Seventeenth Wall Thickness
121, 121', 121": Differential Thickness Pipe
RSDO11: Eleventh Small Outer Diameter Region
DO12: Twelfth Outer Diameter
DI12: Twelfth Inner Diameter
T12: Twelfth Wall Thickness
RSDO12, RSDO12': Twelfth Small Outer Diameter Region
DO16: Sixteenth Outer Diameter
DI18: Eighteenth Inner Diameter
T14, T14': Fourteenth Wall Thickness
RLDO11: Eleventh Large Outer Diameter Region
DO13: Thirteenth Outer Diameter
DI13: Thirteenth Inner Diameter
T13: Thirteenth Wall Thickness
RLDO12: Twelfth Large Outer Diameter Region
DO19: Nineteenth Outer Diameter
DI19: Nineteenth Inner Diameter
T15: Fifteenth Wall Thickness
ReDO11: Eleventh Outer Diameter Increasing Region
DI14: Fourteenth Inner Diameter
ReDO13: Thirteenth Outer Diameter Increasing Region
DI20: Twentieth Inner Diameter
ReDI11: Eleventh Inner Diameter Increasing Region
DO17: Seventeenth Outer Diameter
ReDI12: Twelfth Inner Diameter Increasing Region
DO20: Twentieth Outer Diameter
131: Mandrel
RBDO: Basic Outer Diameter Region
DO14: Fourteenth Outer Diameter
RSDO13, RSDO13': Thirteenth Small Outer Diameter Region
DO18: Eighteenth Outer Diameter
REDO12: Twelfth Outer Diameter Increasing Region
141, 141': Sleeve
RP11: Eleventh Pressing Region
DO15: Fifteenth Outer Diameter
DI15: Fifteenth Inner Diameter
PC: Accommodation Part
151: Container
151*a*: Container Hole
RLDI11: Eleventh Large Diameter Region
DI16: Sixteenth Inner Diameter
RSDI11: Eleventh Small Inner Diameter Region
DI17: Seventeenth Inner Diameter
RsDI11: Eleventh Inner Diameter Decreasing Region

The invention claimed is:

1. An extrusion molding method of a differential thickness pipe, in an extrusion molding apparatus which comprises a mandrel that is a core bar having a predetermined shape, a sleeve that is a cylindrical member disposed coaxially with said mandrel on an outside of said mandrel, a container that is a die in which a container hole that is a penetration hole having a predetermined shape is formed, and a drive mechanism configured so as to push said mandrel and said sleeve into said container hole, including:

a first process that is a process in which a raw pipe having a predetermined shape is set at a predetermined position in the inside of said container hole, a second process that is a process in which said mandrel is pushed into said raw pipe by said drive mechanism to expand a diameter on a base end side of said raw pipe, and said base end side is an upstream side in an extrusion direction, and a third process that is a process in which a diameter on a tip end side of said raw pipe is reduced by pressing an end part on said base end side of said raw pipe with said sleeve to push said raw pipe into said tip end side of said container hole, and performing extrusion processing, after a first time point that is a time point when said second process is started, and said tip end side is a downstream side in said extrusion direction, wherein:

said raw pipe is a circular cylindrical member which has a first outer diameter that is a predetermined outer diameter, a first inner diameter that is a predetermined inner diameter and a first wall thickness that is a predetermined wall thickness, said differential thickness pipe comprises a first small diameter region, a second small diameter region and a large diameter region, in order toward said base end side from said tip end side, and said first small diameter region is a region having a second outer diameter that is a predetermined outer diameter smaller than said first outer diameter, a second inner diameter that is an inner diameter equal to said first inner diameter and a second wall thickness that is a predetermined wall thickness smaller than said first wall thickness, said second small diameter region is a region having a third outer diameter that is an outer diameter equal to said second outer diameter and a third wall thickness that is a predetermined wall thickness smaller than said second wall thickness, and said large diameter region is a region having a fourth outer diameter that is a predetermined outer diameter larger than said first outer diameter and a fourth wall thickness that is a predetermined wall thickness, said mandrel comprises a small cross section region, a large cross section region and a cross section expansion region, and said small cross section region is a circular columnar region formed on said tip end side and having a first cross section that is a circular cross section having a fifth outer diameter that is an outer diameter corresponding to said first inner diameter and said second inner diameter, said large cross section region is a columnar region formed on said base end side and having a second cross section that is a cross section corresponding to a cross section of inner spaces of said second small diameter region and said large diameter region, and said cross section expansion region is a region formed between said small cross section region and said large cross section region and having a cross section expanding from said first cross section to said second cross section as approaching from said small cross section region to said large cross section region, said sleeve comprises a pressing region which is a cylindrical region formed on said tip end side and having a seventh outer diameter that is an outer diameter equal to said fourth outer diameter and a columnar inner space having a third cross section that is a cross section corresponding to said second cross section, said container hole comprises a large inner diameter region, a small inner diameter region and an inner diameter decreasing region, and said large inner diameter region is a region formed on said base end side and having a sixth inner diameter that is an inner diameter corresponding to said fourth outer diameter, said small inner diameter region is a region formed on said tip end side and having a seventh inner diameter that is an inner diameter corresponding to said second outer diameter and said third outer diameter, and said inner diameter decreasing region is a region formed between said large inner diameter region and said small inner diameter region and having an inner diameter decreasing from said sixth inner diameter to said seventh inner diameter as approaching from said large inner diameter region to said small inner diameter region, and at a second time point that is a time point when said third process is started, an end part on said tip end side in said extrusion direction of said mandrel has reached an end part on said tip end side of said raw pipe or a position on said tip end side rather than said end part on said tip end side of said raw pipe, and an end part on said base end side of said small cross section region is located on said base end side rather than an end part on said base end side of said small inner diameter region.

2. The extrusion molding method of a differential thickness pipe according to claim 1, wherein:

an inner space of said second small diameter region of said differential thickness pipe has a circular columnar shape which has a third inner diameter that is a predetermined inner diameter larger than said first inner diameter, an inner space of said large diameter region of said differential thickness pipe has a circular columnar shape which has a fourth inner diameter that is an inner diameter equal to said third inner diameter, said large cross section region of said mandrel has a circular columnar shape which has a sixth outer diameter that is an outer diameter corresponding to said fourth inner diameter, said cross section expansion region of said mandrel has a truncated cone-like shape whose outer diameter increases from said fifth outer diameter to said sixth outer diameter as approaching from said small cross section region to said large cross section region, and said pressing region of said sleeve has a circular cylindrical shape which has said seventh outer diameter and a fifth inner diameter that is an inner diameter corresponding to said sixth outer diameter.

3. The extrusion molding method of a differential thickness pipe according to claim 1, wherein:

said mandrel and said sleeve are fixed such that a distance between the end part on said tip end side of said mandrel and the end part on said tip end side of said sleeve in said extrusion direction does not become larger than a distance between the end part on said tip end side of said mandrel and the end part on said tip end side of said sleeve at said second time point.

4. The extrusion molding method of a differential thickness pipe according to claim 1, wherein:

said first process to said third process are performed using said raw pipe further comprising a second thin-walled part at the end part on said tip end side, and said second thin-walled part is a part having a twenty-second outer diameter that is a predetermined outer diameter not larger than an outer diameter corresponding to the smallest inner diameter in said container hole, a twenty-second inner diameter that is a predetermined inner diameter not smaller than said first inner diameter and a seventeenth wall thickness that is a predetermined wall thickness smaller than said first wall thickness, and said differential thickness pipe further comprises said second thin-walled part at the end part on said tip end side.

5. An extrusion molding apparatus which comprises a mandrel that is a core bar having a predetermined shape, a sleeve that is a cylindrical member disposed coaxially with said mandrel on an outside of said mandrel, a container that is a die in which a container hole that is a penetration hole having a predetermined shape is formed, and a drive mechanism configured so as to push said mandrel and said sleeve into said container hole, and is configured so as to mold a differential thickness pipe having a predetermined shape by performing:

a first process that is a process in which a raw pipe having a predetermined shape is set at a predetermined position in the inside of said container hole, a second process that is a process in which said mandrel is pushed into said raw pipe by said drive mechanism to perform diameter expansion on a base end side of said raw pipe, which is an upstream side in an extrusion direction, and a third process that is a process in which diameter on a tip end side of said raw pipe, which is a downstream side in said extrusion direction, is reduced by pressing an end part on said base end side of said raw pipe with said sleeve to push said raw pipe into said tip end side of said container hole, and performing extrusion processing, after a first time point that is a time point when said second process is started, wherein:

said raw pipe is a circular cylindrical member which has a first outer diameter that is a predetermined outer diameter, a first inner diameter that is a predetermined inner diameter and a first wall thickness that is a predetermined wall thickness, said differential thickness pipe comprises a first small diameter region, a second small diameter region and a large diameter region, in order toward said base end side from said tip end side, and said first small diameter region is a region having a second outer diameter that is a predetermined outer diameter smaller than said first outer diameter, a second inner diameter that is an inner diameter equal to said first inner diameter and a second wall thickness that is a predetermined wall thickness smaller than said first wall thickness, said second small diameter region is a region having the third outer diameter that is an outer diameter equal to said second outer diameter and a third wall thickness that is a predetermined wall thickness smaller than said second wall thickness, and said large diameter region is a region having a fourth outer diameter that is a predetermined outer diameter larger than said first outer diameter and a fourth wall thickness that is a predetermined wall thickness, said mandrel comprises a small cross section region, a large cross section region and a cross section expansion region, and said small cross section region is a circular columnar region formed on said tip end side and having a first cross section that is a circular cross section having a fifth outer diameter that is an outer diameter corresponding to said second inner diameter, said large cross section region is a columnar region formed on said base end side and having a second cross section that is a cross section corresponding to a cross section of inner spaces of said second small diameter region and said large diameter region, and said cross section expansion region is a region formed between said small cross section region and said large cross section region and having a cross section expanding from said first cross section to said second cross section as approaching from said small cross section region to said large cross section region, said sleeve comprises a pressing region which is a cylindrical region formed on said tip end side and having a seventh outer diameter that is an outer diameter equal to said fourth outer diameter and a columnar inner space having a third cross section that is a cross section corresponding to said second cross section, said container hole comprises a large inner diameter region, a small inner diameter region and an inner diameter decreasing region, and said large inner diameter region is a region formed on said base end side and having a sixth inner diameter that is an inner diameter corresponding to said fourth outer diameter, said small inner diameter region is a region formed on said tip end side and having a seventh inner diameter that is an inner diameter corresponding to said second outer diameter and said third outer diameter, and said inner diameter decreasing region a region formed between said large inner diameter region and said small inner diameter region and having an inner diameter decreasing from said sixth inner diameter to said seventh inner diameter as approaching from said large inner diameter region to said small inner diameter region, and at a second time point that is a time point when said third process is started, a first position that is a position of an end part of said mandrel on said tip end side in said extrusion direction is located at a third position that is a position which is equal to a second position that is a position of an end part on said tip end side of said raw pipe or a position on said tip end side by a predetermined distance rather than said second position.

6. The extrusion molding apparatus of a differential thickness pipe according to claim 5, wherein:

an inner space of said second small diameter region of said differential thickness pipe has a circular columnar shape which has a third inner diameter that is a predetermined inner diameter larger than said first inner diameter, an inner space of said large diameter region of said differential thickness pipe has a circular columnar shape which has a fourth inner diameter that is an inner diameter equal to said third inner diameter, said large cross section region of said mandrel has a circular columnar shape which has a sixth outer diameter that is an outer diameter corresponding to said fourth inner diameter, said cross section expansion region of said mandrel has a truncated cone-like shape whose outer diameter increases from said fifth outer diameter to said sixth outer diameter as approaching from said small cross section region to said large cross section region, and said pressing region of said sleeve has a circular cylindrical shape which has said seventh outer diameter and a fifth inner diameter that is an inner diameter equal to said third inner diameter and said fourth inner diameter.

7. The extrusion molding apparatus of a differential thickness pipe according to claim 5, wherein:

said mandrel and said sleeve are fixed such that a distance between the end part on said tip end side of said mandrel and the end part on said tip end side of said sleeve in said extrusion direction does not become larger than a distance between the end part on said tip end side of said mandrel and the end part on said tip end side of said sleeve at said second time point.

8. An extrusion molding method of a differential thickness pipe, in which, in an extrusion molding apparatus which comprises a mandrel that is a core bar having a predetermined shape, a sleeve that is a cylindrical member disposed coaxially with said mandrel on an outside of said mandrel, a container that is a die in which a container hole that is a penetration hole having a predetermined shape is formed, and a drive mechanism configured so as to push at least said sleeve into said container hole, a differential thickness pipe having a predetermined shape is molded by pushing a raw pipe having a predetermined shape into said container hole using said sleeve, wherein:

said raw pipe is a circular cylindrical member which has an eleventh outer diameter that is a predetermined outer diameter, an eleventh inner diameter that is a predetermined inner diameter and an eleventh wall thickness that is a predetermined wall thickness, said differential thickness pipe comprises an eleventh small outer diameter region, an eleventh large outer diameter region and an eleventh outer diameter increasing region, and said eleventh small outer diameter region is a region formed on a tip end side which is a downstream side in an extrusion direction that is a direction in which said raw pipe is pushed into said container hole and having a twelfth outer diameter that is a predetermined outer diameter smaller than said eleventh outer diameter, a twelfth inner diameter that is an inner diameter equal to said eleventh inner diameter and a twelfth wall thickness that is a predetermined wall thickness smaller than said eleventh wall thickness, said eleventh large outer diameter region is a region formed on a base end side which is an upstream side in said extrusion direction and having a thirteenth outer diameter that is a predetermined outer diameter larger than said eleventh outer diameter, a thirteenth inner diameter that is an inner diameter equal to said eleventh inner diameter and a thirteenth wall thickness that is a predetermined wall thickness larger than said eleventh wall thickness, and said eleventh outer diameter increasing region is a region formed between said eleventh small outer diameter region and said eleventh large outer diameter region and having an outer diameter increasing from said twelfth outer diameter to said thirteenth outer diameter and a wall thickness increasing from said twelfth wall thickness to said thirteenth wall thickness as approaching from said eleventh small outer diameter region to said eleventh large outer diameter region, and an inner diameter fixed at a fourteenth inner diameter equal to said eleventh inner diameter, said mandrel comprises a basic outer diameter region which is a circular columnar region formed on said tip end side and having a fourteenth outer diameter that is an outer diameter corresponding to said eleventh inner diameter, said sleeve comprises an eleventh pressing region which is a cylindrical region formed on said tip end side and having a fifteenth outer diameter that is an outer diameter equal to said thirteenth outer diameter and a circular columnar inner space having a fifteenth inner diameter that is an inner diameter corresponding to said fourteenth inner diameter, said container hole comprises an eleventh large diameter region, an eleventh small inner diameter region and an eleventh inner diameter decreasing region, and said eleventh large inner diameter region is a region formed on said base end side and having a sixteenth inner diameter that is an inner diameter corresponding to said thirteenth outer diameter, said eleventh small inner diameter region is a region formed on said tip end side and having a seventeenth inner diameter that is an inner diameter corresponding to said twelfth outer diameter, and said eleventh inner diameter decreasing region is a region formed between said eleventh large inner diameter region and said eleventh small inner diameter region and having an inner diameter decreasing from said sixteenth inner diameter to said seventeenth inner diameter as approaching from said eleventh large inner diameter region to said eleventh small inner diameter region, and said extrusion molding method of a differential thickness pipe includes:

an eleventh process that is a process in which said raw pipe is set at a predetermined position in the inside of said container hole by making an end part on said tip end side of said raw pipe contact with said eleventh inner diameter decreasing region of said container hole, a twelfth process that is a process in which the outer diameter of said raw pipe is expanded to said thirteenth outer diameter while maintaining the inner diameter of said raw pipe at said eleventh inner diameter by pressing an end part on said base end side of said raw pipe with said sleeve to cause plastic flow of a material constituting said raw pipe to fill up a space between said container and said mandrel in said eleventh large inner diameter region and said eleventh inner diameter decreasing region of said container hole with said material in a state where said mandrel is inserted through said raw pipe, and a thirteenth process that is a process in which said tip end side of said raw pipe is subjected to diameter reduction by further pressing the end part on said base end side of said raw pipe with said sleeve to perform extrusion processing in which said material constituting said raw pipe is extruded into said eleventh small inner diameter region of said container hole through a gap between an end part on said base end side of said eleventh small inner diameter region of said container hole and said mandrel in a state where said mandrel is inserted through said raw pipe, and at an eleven time point that is a time point when said twelfth process is started, an end part on said tip end side of said mandrel has reached an eleven position that is the same position in said extrusion direction as a position of an end part on said base end side of said eleventh small inner diameter region of said container hole or a position on said tip end side rather than said eleventh position, and at a twelfth time point that is a time point when said thirteenth process is started, the end part on said tip end side of said mandrel has reached a twelfth position that is a position on said tip end side by a predetermined distance rather than the end part on said base end side of said eleventh small inner diameter region of said container hole or a position on said tip end side rather than said twelfth position in said extrusion direction.

9. The extrusion molding method of a differential thickness pipe according to claim 8, wherein:

a twelfth small outer diameter region which is a region having a sixteenth outer diameter that is an outer diameter equal to said twelfth outer diameter, an eighteenth inner diameter that is a predetermined inner diameter smaller than said twelfth inner diameter and a fourteenth wall thickness that is a predetermined wall thickness larger than said twelfth wall thickness is formed at an end part on said tip end side of said differential thickness pipe, said mandrel further comprises a thirteenth small outer diameter region and a twelfth outer diameter increasing region, and said thirteenth small outer diameter region is a circular columnar region formed on said tip end side rather than said basic outer diameter region and having an eighteenth outer diameter that is an outer diameter corresponding to said eighteenth inner diameter, and said twelfth outer diameter increasing region is a region formed between said thirteenth small outer diameter region and said basic outer diameter region and having an outer diameter increasing from said eighteenth outer diameter to said fourteenth outer diameter as approaching from said thirteenth small outer diameter region to said basic outer diameter region, and at said twelfth time point, an end part on said base end side of said thirteenth small outer diameter region is at a position on said base end side rather than said eleventh position.

10. The extrusion molding method of a differential thickness pipe according to claim 9, wherein:

at a thirteenth time point that is a time point when said thirteenth process is ended, an end part on said tip end side of said basic outer diameter region is at a position on said tip end side rather than said eleventh position, and said differential thickness pipe comprises said eleventh large outer diameter region, said eleventh outer diameter increasing region, said eleventh small outer diameter region, said twelfth small outer diameter region formed on said tip end side rather than said eleventh small outer diameter region, and an eleventh inner diameter increasing region, and said eleventh inner diameter increasing region is a region formed between said twelfth small outer diameter region and said eleventh small outer diameter region and having an inner diameter increasing from said eighteenth inner diameter to said twelfth inner diameter and a wall thickness decreasing from said fourteenth wall thickness to said twelfth wall thickness as approaching from said twelfth small outer diameter region to said eleventh small outer diameter region and an outer diameter fixed at a seventeenth outer diameter equal to said twelfth outer diameter.

11. The extrusion molding method of the differential thickness pipe according to claim 9, wherein:

at a thirteenth time point that is a time point when said thirteenth process is ended, an end part on said base end side of said thirteenth small outer diameter region is at a position on said base end side rather than said eleventh position, and said differential thickness pipe comprises said twelfth small outer diameter region, said eleventh large outer diameter region, a twelfth large outer diameter region, a thirteenth outer diameter increasing region and a twelfth inner diameter increasing region, and said twelfth large outer diameter region is a region formed between said twelfth small outer diameter region and said eleventh large outer diameter region and having a nineteenth outer diameter that is an outer diameter equal to said thirteenth outer diameter, a nineteenth inner diameter that is an inner diameter equal to said eighteenth inner diameter and a fifteenth wall thickness that is predetermined wall thickness larger than said thirteenth wall thickness, said thirteenth outer diameter increasing region is a region formed between said twelfth small outer diameter region and said twelfth large outer diameter region and having an outer diameter increasing from said sixteenth outer diameter to said nineteenth outer diameter and a wall thickness increasing from said fourteenth wall thickness to said fifteenth wall thickness as approaching from said twelfth small outer diameter region to said twelfth large outer diameter region and an inner diameter fixed at a twentieth inner diameter equal to said eighteenth inner diameter, and said twelfth inner diameter increasing region is a region formed between said twelfth large outer diameter region and said eleventh large outer diameter region and having an inner diameter increasing from said nineteenth inner diameter of said thirteenth inner diameter and a wall thickness decreasing from said fifteenth wall thickness to said thirteenth wall thickness as approaching from said twelfth large outer diameter region to said eleventh large outer diameter region and an outer diameter fixed at a twentieth outer diameter equal to said thirteenth outer diameter.

12. The extrusion molding method of a differential thickness pipe according to claim 8, wherein:

said eleventh process to said thirteenth process are performed using said raw pipe further comprising an eleventh thin-walled part at the end part on said base end side, and said eleventh thin-walled part is a part having a twenty-first outer diameter that is a predetermined outer diameter smaller than said eleventh outer diameter, a twenty-first inner diameter that is a predetermined inner diameter not smaller than said eleventh inner diameter and a sixteenth wall thickness that is a predetermined wall thickness smaller than said eleventh wall thickness, said sleeve comprises an accommodation part which is a space opened on an end surface on said tip end side and having a shape corresponding to said eleventh thin-walled part, said eleventh thin-walled part is left at the end part on said tip end side of said raw pipe by performing said twelfth process and said thirteenth process in a state where said eleventh thin-walled part is accommodated in said accommodation part, and said differential thickness pipe further comprises said eleventh thin-walled part at the end part on said base end side.

13. The extrusion molding method of a differential thickness pipe according to claim 8, wherein:

said eleventh process to said thirteenth process are performed using said raw pipe further comprising a twelfth thin-walled part at the end part on said tip end side, and said twelfth thin-walled part is a part having a twenty-second outer diameter that is a predetermined outer diameter not larger than an outer diameter corresponding to the smallest inner diameter in said container hole, a twenty-second inner diameter that is a predetermined inner diameter not smaller than said eleventh inner diameter and a seventeenth wall thickness that is a predetermined wall thickness smaller than said eleventh wall thickness, and said differential thickness pipe further comprises said twelfth thin-walled part at the end part on said tip end side.

14. An extrusion molding apparatus of a differential thickness pipe comprising a mandrel that is a core bar having a predetermined shape, a sleeve that is a cylindrical member disposed coaxially with said mandrel on an outside of said mandrel, a container that is a die in which a container hole that is a penetration hole having a predetermined shape is formed, and a drive mechanism configured so as to push at least said sleeve into said container hole, and configured so as to mold a differential thickness pipe having a predetermined shape by pushing a raw pipe having a predetermined shape into said container hole using said sleeve, wherein:

said raw pipe is a circular cylindrical member which has an eleventh outer diameter that is a predetermined outer diameter, an eleventh inner diameter that is a predetermined inner diameter and an eleventh wall thickness that is a predetermined wall thickness, said differential thickness pipe comprises a eleventh small outer diameter region, an eleventh large outer diameter region and an eleventh outer diameter increasing region, and said eleventh small outer diameter region is a region formed on a tip end side which is a downstream side in an extrusion direction that is a direction in which said raw pipe is pushed into said container hole and having a twelfth outer diameter that is a predetermined outer diameter smaller than said eleventh outer diameter, a twelfth inner diameter that is an inner diameter equal to said eleventh inner diameter and a twelfth wall thickness that is a predetermined wall thickness smaller than said eleventh wall thickness, said eleventh large outer diameter region is a region formed on a base end side which is an upstream side in said extrusion direction and having a thirteenth outer diameter that is a predetermined outer diameter larger than said eleventh outer diameter, a thirteenth inner diameter that is an inner diameter equal to said eleventh inner diameter and a thirteenth wall thickness that is a predetermined wall thickness larger than said eleventh wall thickness, and said eleventh outer diameter increasing region which is a region formed between said eleventh small outer diameter region and said eleventh large outer diameter region and having an outer diameter increasing from said twelfth outer diameter to said thirteenth outer diameter and a wall thickness increasing from said twelfth wall thickness to said thirteenth wall thickness as approaching from said eleventh small outer diameter region to said eleventh large outer diameter region, and an inner diameter fixed at a fourteenth inner diameter equal to said eleventh inner diameter, said mandrel comprises a basic outer diameter region which is a circular columnar region formed on said tip end side and having a fourteenth outer diameter that is an outer diameter corresponding to said eleventh inner diameter, said sleeve comprises an eleventh pressing region which is a cylindrical region formed on said tip end side and having a fifteenth outer diameter that is an outer diameter equal to said thirteenth outer diameter and a circular columnar inner space having a fifteenth inner diameter that is an inner diameter corresponding to said fourteenth inner diameter, said container hole comprises an eleventh large diameter region, an eleventh small inner diameter region and an eleventh inner diameter decreasing region, and said eleventh large inner diameter region is a region formed on said base end side and having a sixteenth inner diameter that is an inner diameter corresponding to said thirteenth outer diameter, said eleventh small inner diameter region is a region formed on said tip end side and having a seventeenth inner diameter that is an inner diameter corresponding to said twelfth outer diameter, and said eleventh inner diameter decreasing region is a region formed between said eleventh large inner diameter region and said eleventh small inner diameter region and having an inner diameter decreasing from said sixteenth inner diameter to said seventeenth inner diameter as approaching from said eleventh large inner diameter region to said eleventh small inner diameter region, and said extrusion molding apparatus of a differential thickness pipe is configured so as to mold said differential thickness pipe by performing an eleventh process to a thirteen process, and an eleventh process that is a process in which said raw pipe is set at a predetermined position in the inside of said container hole by making an end part on said tip end side of said raw pipe contact with said eleventh inner diameter decreasing region of said container hole, a twelfth process that is a process in which the outer diameter of said raw pipe is expanded to said thirteenth outer diameter while maintaining the inner diameter of said raw pipe at said eleventh inner diameter by pressing an end part on said base end side of said raw pipe with said sleeve to cause plastic flow of a material constituting said raw pipe to fill up a space between said container and said mandrel in said eleventh large inner diameter region and said eleventh inner diameter decreasing region of said container hole with said material in a state where said mandrel is inserted through said raw pipe, and a thirteenth process that is a process in which said base end side of said raw pipe is subjected to diameter reduction by further pressing the end part on said base end side of said raw pipe with said sleeve to extrude said material constituting said raw pipe into said eleventh small inner diameter region of said container hole through a gap between an end part on said base end side of said eleventh small inner diameter region of said container hole and said mandrel in a state where said mandrel is inserted through said raw pipe, and at an eleven time point that is a time point when said twelfth process is started, an end part on said tip end side of said mandrel has reached an eleven position that is the same position in said extrusion direction as a position of an end part on said base end side of said eleventh small inner diameter region of said container hole or a position on said tip end side rather than said eleventh position, and at a twelfth time point that is a time point when said thirteenth process is started, the end part on said tip end side of said mandrel has reached a twelfth position that is a position on said tip end side by a predetermined distance rather than the end part on said base end side of said eleventh small inner diameter region of said container hole or a position on said tip end side rather than said twelfth position in said extrusion direction.

15. The extrusion molding apparatus of a differential thickness pipe according to claim 14, wherein:

a twelfth small outer diameter region which is a region having a sixteenth outer diameter that is an outer diameter equal to said twelfth outer diameter, an eighteenth inner diameter that is a predetermined inner diameter smaller than said twelfth inner diameter and a fourteenth wall thickness that is a predetermined wall thickness larger than said twelfth wall thickness is formed at an end part on said tip end side of said differential thickness pipe, said mandrel further comprises a thirteenth small outer diameter region and a twelfth outer diameter increasing region, and said thirteenth small outer diameter region is a circular columnar region formed on said tip end side rather than said basic outer diameter region and having an eighteenth outer diameter that is an outer diameter corresponding to said eighteenth inner diameter, and said twelfth outer diameter increasing region is a region formed between said thirteenth small outer diameter region and said basic outer diameter region and having an outer diameter increasing from said eighteenth outer diameter to said fourteenth outer diameter as approaching from said thirteenth small outer diameter region to said basic outer diameter region, and at said twelfth time point, an end part on said base end side of said thirteenth small outer diameter region is at a position on said base end side rather than said eleventh position.

16. The extrusion molding apparatus of a differential thickness pipe according to claim 15, wherein:

at a thirteenth time point that is a time point when said thirteenth process is ended, an end part on said tip end side of said basic outer diameter region is at a position on said tip end side rather than said eleventh position, and said differential thickness pipe comprises said eleventh large outer diameter region, said eleventh outer diameter increasing region, said eleventh small outer diameter region, said twelfth small outer diameter region formed on said tip end side rather than said eleventh small outer diameter region, and an eleventh inner diameter increasing region, and said eleventh inner diameter increasing region is a region formed between said twelfth small outer diameter region and said eleventh small outer diameter region and having an inner diameter increasing from said eighteenth inner diameter to said twelfth inner diameter and a wall thickness decreasing from said fourteenth wall thickness to said twelfth wall thickness as approaching from said twelfth small outer diameter region to said eleventh small outer diameter region and an outer diameter fixed at a seventeenth outer diameter equal to said twelfth outer diameter.

17. The extrusion molding apparatus of a differential thickness pipe according to claim 15, wherein:

at a thirteenth time point that is a time point when said thirteenth process is ended, an end part on said base end side of said thirteenth small outer diameter region is at a position on said base end side rather than said eleventh position, and said differential thickness pipe comprises said twelfth small outer diameter region, said eleventh large outer diameter region, a twelfth large outer diameter region, a thirteenth outer diameter increasing region and a twelfth inner diameter increasing region, and said twelfth large outer diameter region is a region formed between said twelfth small outer diameter region and said eleventh large outer diameter region and having a nineteenth outer diameter that is an outer diameter equal to said thirteenth outer diameter, a nineteenth inner diameter that is an inner diameter equal to said eighteenth inner diameter and a fifteenth wall thickness that is a predetermined wall thickness larger than said thirteenth wall thickness, said thirteenth outer diameter increasing region is a region formed between said twelfth small outer diameter region and said twelfth large outer diameter region and having an outer diameter increasing from said sixteenth outer diameter to said nineteenth outer diameter and a wall thickness increasing from said fourteenth wall thickness to said fifteenth wall thickness as approaching from said twelfth small outer diameter region to said twelfth large outer diameter region and an inner diameter fixed at a twentieth inner diameter equal to said eighteenth inner diameter, and said twelfth inner diameter increasing region is a region formed between said twelfth large outer diameter region and said eleventh large outer diameter region and having an inner diameter increasing from said nineteenth inner diameter of said thirteenth inner diameter and a wall thickness decreasing from said fifteenth wall thickness to said thirteenth wall thickness as approaching from said twelfth large outer diameter region to said eleventh large outer diameter region and an outer diameter fixed at a twentieth outer diameter equal to said thirteenth outer diameter.

18. The extrusion molding apparatus of a differential thickness pipe according to claim 14, wherein:

said extrusion molding apparatus is configured so as to perform said eleventh process to said thirteenth process using said raw pipe further comprising an eleventh thin-walled part at the end part on said base end side, and said eleventh thin-walled part is a part having a twenty-first outer diameter that is a predetermined outer diameter smaller than said eleventh outer diameter, a twenty-first inner diameter that is a predetermined inner diameter not smaller than said eleventh inner diameter and a sixteenth wall thickness that is a predetermined wall thickness smaller than said eleventh wall thickness, said sleeve comprises an accommodation part which is a space opened on an end surface on said tip end side and having a shape corresponding to said eleventh thin-walled part, said eleventh thin-walled part is left at the end part on said tip end side of said raw pipe by performing said twelfth process and said thirteenth process in a state where said eleventh thin-walled part is accommodated in said accommodation part, and said differential thickness pipe further comprises said eleventh thin-walled part at the end part on said base end side.

19. The extrusion molding apparatus of a differential thickness pipe according to claim 14, wherein:

said extrusion molding apparatus is configured so as to perform said first process to said third process using said raw pipe further comprising second thin-walled part at the end part on said tip end side, and said second thin-walled part is a part having a twenty-second outer diameter that is a predetermined outer diameter not larger than an outer diameter corresponding to the smallest inner diameter in said container hole, a twenty-second inner diameter that is a predetermined inner diameter not smaller than said first inner diameter and a seventeenth wall thickness that is a predetermined wall thickness smaller than said first wall thickness, and said differential thickness pipe further comprises said second thin-walled part at the end part on said tip end side.

20. The extrusion molding apparatus of a differential thickness pipe according to claim 14, wherein:

said extrusion molding apparatus is configured so as to perform said eleventh process to said thirteenth process using said raw pipe further comprising a twelfth thin-walled part at the end part on said tip end side, and said twelfth thin-walled part is a part having a twenty-second outer diameter that is a predetermined outer diameter not larger than an outer diameter corresponding to the smallest inner diameter in said container hole, a twenty-second inner diameter that is a predetermined inner diameter not smaller than said eleventh inner diameter and a seventeenth wall thickness that is a predetermined wall thickness smaller than said eleventh wall thickness, and said differential thickness pipe further comprises said twelfth thin-walled part at the end part on said tip end side.

* * * * *